US012782064B2

(12) United States Patent
Poeppelman et al.

(10) Patent No.: US 12,782,064 B2
(45) Date of Patent: Nov. 3, 2026

(54) THREE-WAY HEAT EXCHANGE MODULE WITH CONTROLLED CLAMPING OF PANEL ASSEMBLIES

(71) Applicant: Copeland LP, Sidney, OH (US)

(72) Inventors: David Poeppelman, Troy, OH (US); Chris Cicenas, Sidney, OH (US); Douglas P. Pelsor, Plain City, OH (US); Jason M. Warner, Greenville, OH (US)

(73) Assignee: Copeland LP, Sidney, OH (US)

( * ) Notice: Subject to any disclaimer, the term of this patent is extended or adjusted under 35 U.S.C. 154(b) by 459 days.

(21) Appl. No.: 18/490,984

(22) Filed: Oct. 20, 2023

(65) Prior Publication Data

US 2025/0129997 A1 Apr. 24, 2025

(51) Int. Cl.

| | |
|---|---|
| ***F28F 9/00*** | (2006.01) |
| ***F28D 1/02*** | (2006.01) |
| ***F28D 1/06*** | (2006.01) |
| ***F28F 9/007*** | (2006.01) |
| ***F28F 17/00*** | (2006.01) |
| *F28D 1/03* | (2006.01) |
| *F28F 9/02* | (2006.01) |

(52) U.S. Cl.

CPC ..... *F28F 9/002* (2013.01); *F28D 1/0233* (2013.01); *F28D 1/06* (2013.01); *F28F 9/0075* (2013.01); *F28F 17/005* (2013.01); *F28D 1/035* (2013.01); *F28F 9/0221* (2013.01); *F28F 2230/00* (2013.01); *F28F 2275/08* (2013.01); *F28F 2275/205* (2013.01)

(58) Field of Classification Search

CPC ..... F28F 2275/205; F28F 9/0132

See application file for complete search history.

(56) References Cited

U.S. PATENT DOCUMENTS

| | | | |
|---|---|---|---|
| 2,537,276 | A | 1/1951 | Mcmahon et al. |
| 3,814,172 | A | 6/1974 | Shore |
| 3,973,621 | A | 8/1976 | Bow et al. |
| 4,373,347 | A | 2/1983 | Howell et al. |
| 4,582,126 | A | 4/1986 | Cory |

(Continued)

FOREIGN PATENT DOCUMENTS

| | | | |
|---|---|---|---|
| CN | 102213471 | B | 1/2013 |
| CN | 103063076 | B | 3/2015 |

(Continued)

*Primary Examiner* — Devon Lane

(74) *Attorney, Agent, or Firm* — Armstrong Teasdale LLP

(57) ABSTRACT

A three-way heat exchanger includes panel assemblies arranged in series. Each panel assembly includes a frame defining a heat transfer fluid channel and a vapor-permeable membrane positioned on the frame to define a desiccant channel separated from the heat transfer fluid channel. The three-way heat exchanger also includes clamping assemblies for exerting a clamping force on the panel assemblies. Each clamping assembly includes a tie rod extending through the frames of the panel assemblies and including opposite ends, retainers connected to the opposite ends of the tie rod, and a resilient element positioned between one of the retainers and one of the panel assemblies at one of the ends of the tie rod. The resilient element is deformable to accommodate size variations of the panel assemblies.

18 Claims, 21 Drawing Sheets

(56) References Cited

U.S. PATENT DOCUMENTS 4,653,287 A 3/1987 Martin, Jr.
4,903,503 A 2/1990 Meckler
4,941,324 A 7/1990 Peterson et al.
5,005,371 A 4/1991 Yonezawa et al.
5,320,166 A 6/1994 Swenson
5,580,454 A * 12/1996 Zaiter ..... B01D 29/15 210/488
5,943,874 A 8/1999 Maeda
6,039,112 A 3/2000 Ruppel et al.
6,134,903 A 10/2000 Potnis et al.
6,178,762 B1 1/2001 Flax
6,216,483 B1 4/2001 Potnis et al.
6,282,919 B1 9/2001 Rockenfeller et al.
6,315,257 B1 11/2001 Fennesz
6,494,053 B1 12/2002 Forkosh et al.
6,497,107 B2 12/2002 Maisotsenko et al.
6,837,056 B2 1/2005 Potnis et al.
6,848,265 B2 2/2005 Lowenstein et al.
6,892,797 B2 * 5/2005 Beddome ..... F28D 9/0043 165/145
7,086,249 B2 8/2006 Bae et al.
7,147,071 B2 12/2006 Gering et al.
7,163,052 B2 1/2007 Taras et al.
7,260,945 B2 8/2007 Landry
7,269,966 B2 9/2007 Lowenstein et al.
7,306,650 B2 12/2007 Slayzak et al.
7,398,819 B2 7/2008 Taras et al.
7,806,171 B2 10/2010 Taras et al.
7,819,177 B2 10/2010 Beamer et al.
7,905,107 B2 3/2011 Forkosh et al.
8,171,986 B2 5/2012 Klein
8,171,987 B2 5/2012 Jiang et al.
8,205,668 B2 6/2012 Freese, V
8,222,514 B2 7/2012 Hanoka
8,268,060 B2 9/2012 Hargis et al.
8,800,308 B2 8/2014 Vandermeulen et al.
8,999,045 B2 4/2015 Ericson et al.
9,101,874 B2 8/2015 Vandermeulen
9,109,808 B2 8/2015 Gerber et al.
9,130,503 B2 9/2015 Vandermeulen
9,140,471 B2 9/2015 Kozubal et al.
9,234,665 B2 1/2016 Erb et al.
9,267,696 B2 2/2016 Gerlach et al.
9,276,274 B2 3/2016 Boersma et al.
9,423,140 B2 8/2016 Betts et al.
9,470,426 B2 10/2016 Vandermeulen
9,506,697 B2 11/2016 Vandermeulen
9,518,765 B2 12/2016 Laughman et al.
9,631,848 B2 4/2017 Vandermeulen et al.
9,709,285 B2 7/2017 Vandermeulen
9,746,174 B2 8/2017 Wilhelm et al.
9,810,439 B2 11/2017 Coutu et al.
10,012,444 B2 7/2018 Eplee
10,024,558 B2 7/2018 Vandermeulen
10,041,708 B2 8/2018 Sedlak et al.
10,323,867 B2 6/2019 Vandermeulen
10,352,574 B2 7/2019 Hamlin et al.
10,386,084 B2 8/2019 Bahar et al.
10,465,996 B2 11/2019 Wintersteen et al.
10,619,867 B2 4/2020 Vandermeulen
10,655,870 B2 5/2020 Lowenstein
10,712,024 B2 7/2020 LePoudre et al.
10,739,079 B2 8/2020 Lowenstein
10,782,045 B2 9/2020 LePoudre et al.
10,905,997 B2 2/2021 McGee et al.
10,921,001 B2 2/2021 Allen et al.
10,941,948 B2 3/2021 Vandermeulen et al.
10,950,877 B2 3/2021 Staeck
10,962,252 B2 3/2021 LePoudre et al.
11,022,330 B2 * 6/2021 Allen ..... F28D 9/0037
11,029,045 B2 6/2021 Woods et al.
11,035,618 B2 6/2021 LePoudre et al.
11,092,349 B2 8/2021 LePoudre et al.
11,131,468 B2 9/2021 Edström et al.
11,143,467 B2 10/2021 Lynn et al.
11,408,681 B2 8/2022 LePoudre
11,608,996 B2 3/2023 Meggers et al.
11,737,239 B2 8/2023 LePoudre
11,781,775 B2 10/2023 Abdel-Salam et al.
11,815,283 B2 11/2023 Ghadiri Moghaddam et al.
2003/0029185 A1 2/2003 Kopko
2004/0101736 A1 * 5/2004 Tawfik ..... H01M 8/241 429/458
2004/0211207 A1 10/2004 Forkosh et al.
2006/0201188 A1 9/2006 Kopko
2010/0090356 A1 4/2010 Sines et al.
2010/0132930 A1 6/2010 Izenson et al.
2011/0139218 A1 6/2011 Hanoka et al.
2012/0006483 A1 1/2012 Hanoka et al.
2013/0022848 A1 * 1/2013 Schroeter ..... H01M 10/0525 429/90
2013/0227982 A1 9/2013 Forkosh
2014/0260367 A1 9/2014 Coutu et al.
2015/0260420 A1 9/2015 Forkosh
2015/0300754 A1 * 10/2015 Vandermeulen ..... F28D 3/04 29/890.03
2016/0138817 A1 5/2016 Hamlin et al.
2016/0377302 A1 12/2016 Hamlin et al.
2017/0106639 A1 4/2017 Vandermeulen et al.
2017/0205090 A1 7/2017 Hollering et al.
2017/0205154 A1 7/2017 Torre La et al.
2017/0363305 A1 * 12/2017 Hamlin ..... F24F 3/1417
2018/0156544 A1 6/2018 Alahyari et al.
2019/0145640 A1 5/2019 Vandermeulen et al.
2019/0154281 A1 5/2019 Rosenblum et al.
2019/0162429 A1 5/2019 Armatis et al.
2020/0096212 A1 3/2020 LePoudre
2020/0173671 A1 6/2020 Rowe et al.
2020/0182493 A1 6/2020 Luttik
2020/0363091 A1 11/2020 Umekage et al.
2022/0003464 A1 1/2022 Sakaguchi
2022/0099390 A1 3/2022 Dean
2022/0376329 A1 * 11/2022 Nakamura ..... H01M 10/625
2022/0393260 A1 12/2022 Nakamura et al.

FOREIGN PATENT DOCUMENTS

CN 105737302 A 7/2016
DE 102006024796 B4 11/2009
EP 0672235 A1 9/1995
EP 1769207 A1 4/2007
EP 1810856 A3 11/2008
EP 2309193 A1 4/2011
EP 2966386 A1 1/2016
EP 2796802 B1 3/2016
EP 3117157 B1 8/2018
EP 2960953 B1 11/2018
EP 3361171 B1 8/2019
EP 3764021 A1 1/2021
FR 2886388 B1 10/2007
GB 479311 A 2/1938
GB 757856 A 9/1956
SG 10201605802 A1 2/2017
WO 1995010746 A1 4/1995
WO 1996019708 A1 6/1996
WO 2001073366 A1 10/2001
WO 2006010463 A1 2/2006
WO 2013094206 A1 6/2013
WO 2013172789 A1 11/2013
WO 2017185002 A1 10/2017
WO 2017185005 A1 10/2017
WO 2018191805 A1 10/2018
WO 2019162949 A1 8/2019
WO 2020026040 A1 2/2020
WO 2020026084 A3 5/2020
WO 2022216155 A1 10/2022

* cited by examiner

THREE-WAY HEAT EXCHANGE MODULE WITH CONTROLLED CLAMPING OF PANEL ASSEMBLIES

FIELD

The field relates generally to heating, ventilation, and air conditioning (HVAC) systems, and more particularly, to HVAC systems and methods including three-way heat exchange modules for transferring heat between a heat transfer fluid, a liquid desiccant, and air.

BACKGROUND

Heating, ventilation, and air conditioning (HVAC) systems are known for their heating, cooling, and moisture removal capabilities for treating outside air that is circulated through an indoor space. The vapor compression cycle is widely used in HVAC systems to regulate the temperature and humidity of the outside air. Typically, outside air is cooled below its dew point temperature to allow moisture in the air to condense on an evaporator coil, thus dehumidifying the air. Since this process often leaves the dehumidified air at an uncomfortably cold temperature, the air is then reheated to a temperature more comfortable to a user. The process of overcooling and reheating the air can become very energy-intensive and costly.

In some applications, HVAC systems include a vapor compression system used in combination with a liquid desiccant dehumidification system to remove moisture from the outside air without cooling it below its dew point temperature. For example, HVAC systems may include a refrigerant sub-system that operates under the vapor compression cycle and an air treatment sub-system that uses heat transfer fluid and liquid desiccant to simultaneously absorb heat (sensible cooling) and moisture (latent cooling) from warm outside air to produce cooled and dehumidified indoor air. The air treatment sub-system may include three-way heat transfer equipment that facilitates sensible and latent cooling of the warm outdoor air using the heat transfer fluid and the liquid desiccant.

In operation of a three-way heat exchanger, the liquid desiccant and heat transfer fluid are channeled through the heat exchanger and heat is transferred between the liquid desiccant and the heat transfer fluid. An outdoor air stream is directed through the heat exchanger, and heat transfer fluid absorbs heat from the air stream while the liquid desiccant absorbs moisture from the air stream. The liquid desiccant may circulate between the three-way heat exchanger and a regeneration system, in which diluted liquid desiccant rejects the absorbed moisture into a sacrificial fluid. The refrigerant sub-system interfaces with the air treatment sub-system, whereby refrigerant in an evaporation stage of the vapor compression cycle absorbs heat from the heat transfer fluid in the three-way heat exchanger. The refrigerant is then channeled to a condensing stage in which the refrigerant rejects the absorbed heat into another fluid. Liquid desiccant treated by the regeneration system and heat transfer fluid treated by the refrigerant sub-system is then channeled back toward the three-way heat exchanger to again provide sensible and latent cooling of outside air.

Known three-way heat exchangers include panel assemblies that channel the heat transfer fluid and the liquid desiccant therethrough for absorbing heat and moisture from the air stream that flows between the panel assemblies. In operation, the panel assemblies may experience a wide range of temperature changes depending on the operational environment of the three-way heat exchanger. The panel assemblies may include a thermoplastic or other material that is resistant to corrosion and/or other chemical interactions with the liquid desiccant and heat transfer fluid. These materials may expand at higher temperatures and contract at lower temperatures, causing size variations in the panel assemblies over the range of operating temperatures. Size variations of the panel assemblies may negatively impact performance of the three-way heat exchanger if proper accommodations for the size variations are not included. For example, thermal contraction of the panel assemblies may result in inadequate spacing and/or sealing between adjacent panel assemblies, reducing the efficiency of the three-way heat exchanger and creating the propensity for heat transfer fluid and/or liquid desiccant to leak into the treated air stream. Thermal expansion may cause the panel assemblies to experience stresses in locations where the panel assemblies are fastened together, as fastener assemblies used to connect the panel assemblies may include metal materials that do not thermally expand at the same rate as the panel assemblies.

Accordingly, a need exists for a three-way heat exchanger that addresses the above-described problems and adequately accommodates the size variations that may occur in the panel assemblies during operation of the heat exchanger over wide temperature ranges. In particular, a need exists for the three-way heat exchangers that facilitates maintaining spacing and seals between the panel assemblies during thermal contraction and reducing or eliminating the stresses created in the panel assemblies during thermal expansion.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect is a three-way heat exchanger operable to transfer heat between a heat transfer fluid, a liquid desiccant, and air. The three-way heat exchanger includes panel assemblies arranged in series, airflow gaps being defined between adjacent panel assemblies to allow the air to flow through the three-way heat exchanger. Each panel assembly includes a frame defining a heat transfer fluid channel, and a vapor-permeable membrane positioned on the frame to define a desiccant channel separated from the heat transfer fluid channel. The three-way heat exchanger also includes clamping assemblies for exerting a clamping force on the panel assemblies. Each clamping assembly includes a tie rod extending through the frames of the panel assemblies and including opposite ends, retainers connected to the opposite ends of the tie rod, and a resilient element positioned between one of the retainers and one of the panel assemblies at one of the ends of the tie rod. The resilient element is deformable to accommodate size variations of the panel assemblies.

Another aspect is a heat exchanger operable to transfer heat between a heat transfer fluid and air. The heat exchanger includes panel assemblies arranged in series, airflow gaps being defined between adjacent panel assemblies to allow the air to flow through the heat exchanger. Each panel assembly includes a frame defining a heat transfer fluid channel, a heat transfer fluid inlet port, and a heat transfer fluid outlet port. The heat transfer fluid inlet ports define a heat transfer fluid inlet manifold of the heat exchanger and the heat transfer fluid outlet ports define a heat transfer fluid outlet manifold of the heat exchanger. The heat exchanger also includes clamping assemblies for exerting a clamping force on the panel assemblies. Each clamping assembly includes a tie rod extending through the frames of the panel assemblies and including opposite ends, retainers connected to the opposite ends of the tie rod, and a resilient element positioned between one of the retainers and one of the panel assemblies at one of the ends of the tie rod. The resilient element is deformable to accommodate size variations of the panel assemblies. The tie rod of a first clamping assembly extends adjacent the heat transfer fluid inlet manifold and the tie rod of a second clamping assembly extends adjacent the heat transfer fluid outlet manifold.

Another aspect is a heat exchanger operable to transfer heat between a heat transfer fluid and air. The heat exchanger includes panel assemblies arranged in succession, airflow gaps being defined between adjacent panel assemblies to allow the air to flow through the heat exchanger. Each panel assembly includes a frame defining a heat transfer fluid channel, a first alignment hole, and a second alignment hole. The first and second alignment holes are defined on opposite sides of the heat transfer fluid channel. The heat exchanger also includes clamping assemblies for exerting a clamping force on the panel assemblies. Each clamping assembly includes a tie rod extending through the frames of the panel assemblies, retainers connected to opposite ends of the tie rod, and a resilient element between one of the retainers and one of the panel assemblies at one of the ends of the tie rod. The resilient element is deformable to accommodate size variations of the panel assemblies. The tie rod of a first clamping assembly extends through the first alignment holes of the panel assemblies and the tie rod of a second clamping assembly extends through the second alignment holes of the panel assemblies. Each tie rod and the respective alignment holes have a complementing anti-rotation shape.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the drawings.

DETAILED DESCRIPTION

Figure 1:
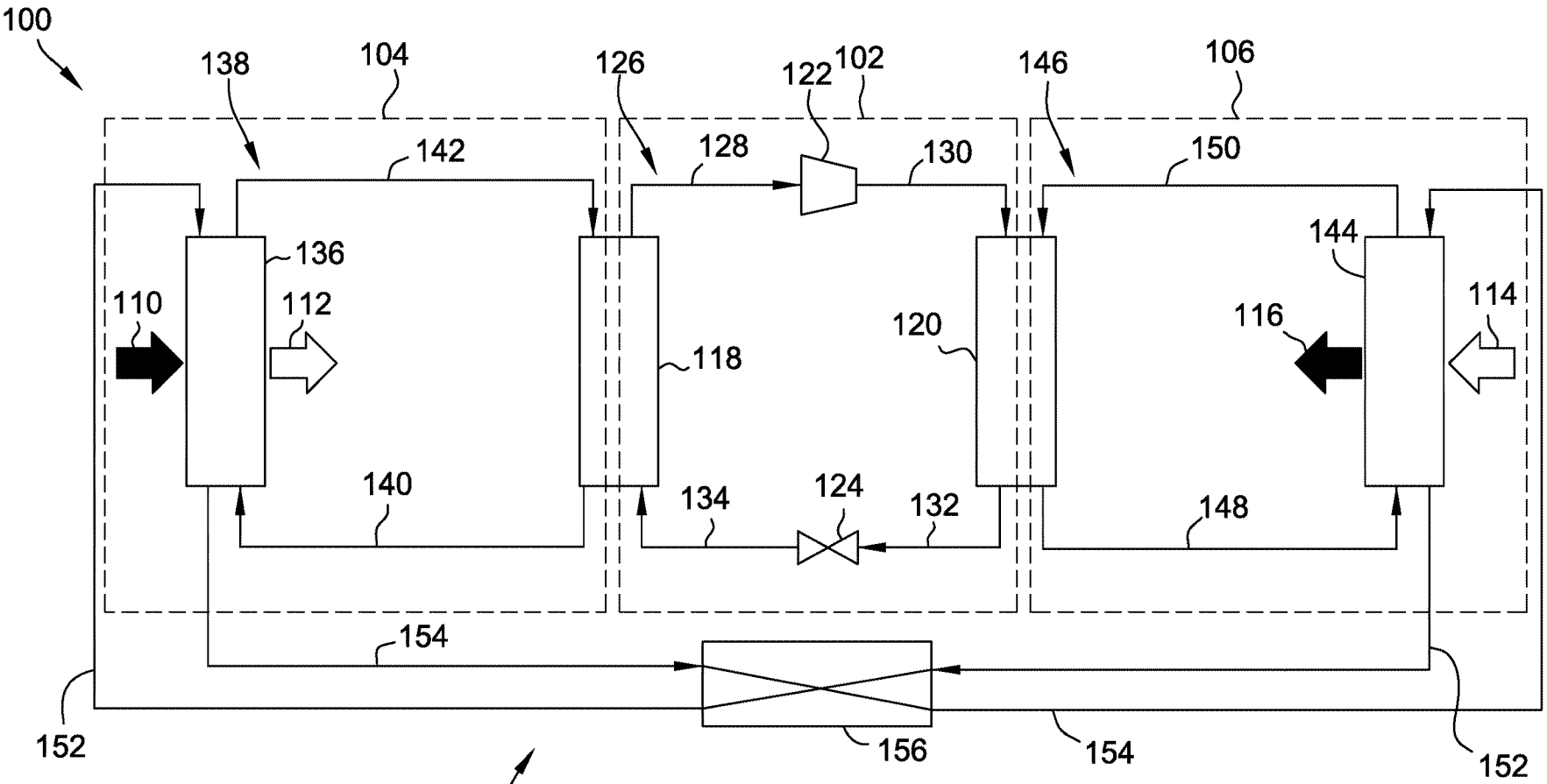
FIG. 1 is a schematic flow diagram of a heating, ventilation, and air conditioning (HVAC) system.

FIG. 1 is a schematic diagram of a heating, ventilation, and air conditioning (HVAC) system 100. The HVAC system 100 includes sub-systems 102-106 and a liquid desiccant circuit 108 which facilitate the heating, cooling, and moisture removal capabilities of the system 100. The sub-systems of the HVAC system 100 include a refrigerant sub-system 102, a conditioner sub-system 104, and a regenerator sub-system 106. The conditioner sub-system 104 and the regenerator sub-system 106 are usable to respectively treat first and second inlet air streams 110 and 114, and may be referred to herein as air treatment sub-systems 104 and 106. The HVAC system 100 may include additional components or other components than those shown and described with reference to FIG. 1.

In an example operating mode of the HVAC system 100, the conditioner sub-system 104 removes heat from the first inlet air stream 110 and channels a conditioned outlet air stream 112 to a conditioned space (not shown), such as an interior of a building structure or vehicle. The conditioned outlet air stream 112 exiting the conditioner sub-system 104 may have a lower temperature than the first inlet air stream 110. Heat removed from the first inlet air stream 110 is transferred from the conditioning sub-system 104, to the refrigerant sub-system 102, and finally to the regenerator sub-system 106. The regenerator sub-system 106 transfers the heat into the second inlet air stream 114 and channels a heated outlet air stream 116 to the atmosphere.

The refrigerant sub-system 102 includes an evaporator 118, a condenser 120, a compressor 122, and an expansion valve 124. The compressor 122 may be any suitable compressor including, but not limited to, scroll, reciprocating, rotary, screw, and centrifugal compressors. The expansion valve 124 may be any suitable expansion valve, such as a thermal expansion valve. The expansion valve 124 may alternatively be any suitable expansion device, such as an orifice or capillary tube for example. The refrigerant sub-system 102 also includes a refrigerant loop 126 that circulates a working fluid, such as a refrigerant, between the evaporator 118, the compressor 122, the condenser 120, and the expansion valve 124. The refrigerant sub-system 102 may include additional components or other components than those shown and described with reference to FIG. 1.

In operation of the refrigerant sub-system 102, the refrigerant in the loop 126 is channeled as a low pressure gas refrigerant 128 toward the compressor 122. The compressor 122 compresses the gas refrigerant 128, which raises the temperature and pressure of the refrigerant. Pressurized, high temperature gas refrigerant 130 exits the compressor 122 and is channeled toward the condenser 120, where the high pressure gas refrigerant 130 is condensed to a high pressure liquid refrigerant 132. The liquid refrigerant 132 exiting the condenser 120 is channeled toward the expansion valve 124 that reduces the pressure of the liquid. The reduced pressure fluid refrigerant 134, which may be a gas or a mixture of gas and liquid after passing through the expansion valve 124, is then channeled toward the evaporator 118. The fluid refrigerant 134 evaporates to a gas in the evaporator 118, exiting the evaporator as the low pressure gas refrigerant 128. The gas refrigerant 128 is then channeled back toward the compressor 122, where the gas refrigerant 128 is again compressed and the process repeats. Circulation of the refrigerant in the loop 126 may be driven by the compressor 122, and, more particularly, by a pressure differential that exists between the pressurized, high temperature gas refrigerant 130 exiting the compressor 122 and the low pressure gas refrigerant 128 entering the compressor 122. The direction of flow of the refrigerant through the loop 126, as shown in FIG. 1, may be reversed to switch the heat transfer functions of the evaporator 118 and the condenser 120, and enable the HVAC system 100 to operate in various operating modes.

The conditioner sub-system 104 includes a first three-way heat exchanger 136 and a conditioner heat transfer fluid loop 138 that circulates a conditioner heat transfer fluid (e.g., water, a glycol-based fluid, or any combination thereof) to and from the first three-way heat exchanger 136. The conditioner sub-system 104 interfaces with the refrigerant sub-system 102 via the evaporator 118. In particular, the evaporator 118 is included in the refrigerant loop 126 and the conditioner heat transfer loop 138, and facilitates transfer of heat from the conditioner heat transfer fluid in the loop 138 into the fluid refrigerant 134 in the refrigerant loop 126. The conditioner sub-system 104 may include additional components or other components than those shown and described with reference to FIG. 1. For example, the conditioner sub-system 104 may include one or more pumps (not shown) for circulating the conditioner heat transfer fluid in the loop 138 between the first three-way heat exchanger 136 and the evaporator 118. Suitable pumps that may be included in the conditioner sub-system 104 include, for example, centrifugal pumps, diaphragm pumps, positive displacement pumps, or any type of pump suitable for transferring liquid. The conditioner sub-system 104 may include additional heat transfer equipment that transfers heat from the conditioner heat transfer fluid into the atmosphere, or vice versa, depending on the operational requirements of the HVAC system 100 and other factors (e.g., a temperature and/or humidity of the first air inlet stream 110).

In operation of the conditioner sub-system 104, the conditioner heat transfer fluid in the loop 138 is channeled toward the evaporator 118. The conditioner heat transfer fluid is cooled in the evaporator 118 as heat is transferred from the conditioner heat transfer fluid into the fluid refrigerant 134 in the loop 126 to produce the gas refrigerant 128. Cooled conditioner heat transfer fluid 140 exiting the evaporator 118 is channeled toward and enters the first three-way heat exchanger 136. The first inlet air stream 110 is also directed through the first three-way heat exchanger 136. The first three-way heat exchanger 136 transfers heat from the first inlet air stream 110 into the conditioner heat transfer fluid 140, thus heating the conditioner heat transfer fluid. The heated conditioner heat transfer fluid 142 exiting the first three-way heat exchanger 136 is channeled back toward the evaporator 118 and the process repeats.

The regenerator sub-system 106 includes a second three-way heat exchanger 144 and a regenerator heat transfer fluid loop 146 that circulates a regenerator heat transfer fluid (e.g., water, a glycol-based fluid, or any combination thereof) to and from the second three-way heat exchanger 144. The regenerator sub-system 106 interfaces with the refrigerant sub-system 102 via the condenser 120. In particular, the condenser 120 is included in the refrigerant loop 126 and the regenerator heat transfer loop 146, and facilitates transfer of heat from the pressurized gas refrigerant 130 in the refrigerant loop 126 into the regenerator heat transfer fluid. The regenerator sub-system 106 may include additional components or other components than those shown and described with reference to FIG. 1. For example, the regenerator sub-system 106 may include one or more pumps (not shown) for circulating the regenerator heat transfer fluid in the loop 146 between the three-way heat exchanger 144 and the condenser 120. Suitable pumps that may be included in the regenerator sub-system 106 include, for example, centrifugal pumps, diaphragm pumps, positive displacement pumps, or any type of pump suitable for transferring liquid. The regenerator sub-system 106 may include additional heat transfer equipment that transfers heat from the atmosphere into the regenerator heat transfer fluid, or vice versa, depending on the operational requirements of the HVAC system 100 and other factors (e.g., a temperature and/or humidity of the first air inlet stream 110).

In operation of the regenerator sub-system 106, the regenerator heat transfer fluid in the loop 146 is channeled toward the condenser 120. The regenerator heat transfer fluid is heated in the condenser as heat is transferred from the pressurized gas refrigerant 130 in the loop 126 into the regenerator heat transfer fluid to produce the liquid refrigerant 132. Heated regenerator heat transfer fluid 148 exiting the condenser is channeled toward and enters the second three-way heat exchanger 144. The second inlet air stream 114 is also directed through the second three-way heat exchanger 144. The second three-way heat exchanger 144 transfers heat from the regenerator heat transfer fluid into the second inlet air stream 114, thus cooling the regenerator heat transfer fluid. The heated outlet air stream 116 exiting the second three-way heat exchanger 144 has a greater temperature than the second inlet air stream 114. The cooled regenerator heat transfer fluid 150 exiting the three-way heat exchanger 144 is channeled back toward the condenser 120 and the process repeats.

The HVAC system 100 also includes the liquid desiccant circuit 108 that operates in conjunction with the sub-systems 102-106 to facilitate cooling the first inlet air stream 110 by latent and sensible cooling. Sensible cooling reduces the temperature of the conditioned outlet air stream 112 by removing heat from the first inlet air stream 110. Latent cooling reduces the temperature of the conditioned outlet air stream 112 by removing moisture from the first inlet air stream 110. The liquid desiccant circuit 108 includes a liquid desiccant that is channeled between the first and second three-way heat exchangers 136 and 144. Suitable liquid desiccants that may be used in the liquid desiccant circuit 108 include, for example, desiccant salt solutions, such as solutions of water and lithium chloride (LiCl), lithium bromide (LiBr), calcium chloride ($CaCl_2$), or any combination thereof, triethylene glycol, sodium hydroxide, sulfuric acid, and so-called ionic liquid desiccants, or organic salts that are liquid at room temperature and have organic cations and organic or inorganic anions.

The liquid desiccant circuit 108 may include one or more pumps (not shown) for channeling the liquid desiccant between the first three-way heat exchanger 136 and the second three-way heat exchanger 144. Suitable pumps that may be included in the liquid desiccant circuit 108 include, for example, centrifugal pumps, diaphragm pumps, positive displacement pumps, or any type of pump suitable for transferring liquid. The liquid desiccant circuit 108 may include one or more pumps for transferring the liquid desiccant from the second heat exchanger 144 toward the first heat exchanger 136 and one or more pumps for transferring the diluted liquid desiccant 154 from the first heat exchanger 136 toward the second heat exchanger 144.

Concentrated liquid desiccant 152 in the liquid desiccant circuit 108 is channeled toward the first three-way heat exchanger 136 of the conditioner sub-system 104, where the concentrated liquid desiccant 152 removes moisture from the first inlet air stream 110. The concentrated liquid desiccant 152 cooperates with the cooled conditioner heat transfer fluid 140 in the first three-way heat exchanger 136 to absorb heat and moisture from the first inlet air stream 110. The conditioned outlet air stream 112 exiting the first three-way heat exchanger 136 may have a lower humidity and/or a lower temperature than the first inlet air stream 110. The liquid desiccant, having absorbed moisture from the first inlet air stream 110, exits the first three-way heat exchanger 136 as diluted liquid desiccant 154.

The diluted liquid desiccant 154 is channeled toward the second three-way heat exchanger 144 of the regenerator sub-system 106, where the diluted liquid desiccant 154 rejects moisture into the second inlet air stream 114. The diluted liquid desiccant 154 cooperates with the heated regenerator heat transfer fluid 148 in the second three-way heat exchanger 144 to reject heat and moisture into the second inlet air stream 114. The heated outlet air stream 116 exiting the second three-way heat exchanger 144 thus has a greater humidity as well as a higher temperature than the second inlet air stream 114. The liquid desiccant, having rejected moisture into the second inlet air stream 114, exits the regenerator sub-system 106 as concentrated liquid desiccant 152. The concentrated liquid desiccant 152 exiting the second three-way heat exchanger 144 is channeled back toward the first three-way heat exchanger 136, and the process repeats.

The liquid desiccant circuit 108 may also include a desiccant-desiccant heat exchanger 156 for transferring heat from the concentrated liquid desiccant 152 that has exited the second three-way heat exchanger 144 to the diluted liquid desiccant 154 that has exited the first three-way heat exchanger 136. The desiccant-desiccant heat exchanger 156 may facilitate improving the functions of the liquid desiccant in the three-way heat exchangers 136 and 144. For example, the desiccant-desiccant heat exchanger 156 may reduce a temperature of the concentrated liquid desiccant 152 to provide greater cooling and dehumidifying capabilities of the first three-way heat exchanger 136. Additionally and/or alternatively, the desiccant-desiccant heat exchanger 156 may increase a temperature of the diluted liquid desiccant 154 to enable the diluted liquid desiccant 154 to desorb a greater amount of moisture in the second three-way heat exchanger 144. The desiccant-desiccant heat exchanger 156 may be an inline heat exchanger or any suitable heat exchanger that facilitates direct heat transfer between the concentrated liquid desiccant 152 and the diluted liquid desiccant 154. The desiccant-desiccant heat exchanger 156 may alternatively facilitate indirect heat exchange between the concentrated liquid desiccant 152 and the diluted liquid desiccant 154, such as via a vapor compression heat pump. Auxiliary heating and cooling sources (e.g., heating and cooling fluid, such as water) may also be utilized, in addition to or in lieu of the heat exchanger 156, to respectively heat the diluted liquid desiccant 154 and cool the concentrated liquid desiccant 152. The liquid desiccant circuit 108 may include additional components or other components than those shown and described with reference to FIG. 1.

Thus, in the example operating mode of the HVAC system 100, sensible cooling of the first inlet air stream 110 is facilitated by the first three-way heat exchanger 136 of the conditioner sub-system 104, which transfers heat from the inlet air stream 110 into the conditioner heat transfer fluid. The heat removed from the first inlet air stream 110 is then transferred sequentially between the sub-systems 104, 102, and 106 via the evaporator 118 and the condenser 120, and eventually is rejected into the second inlet air stream 114 via the second three-way heat exchanger 144. Latent cooling of the first inlet air stream 110 is also facilitated by the first three-way heat exchanger 136, which removes moisture from the inlet air stream 110 using the concentrated liquid desiccant 152. The moisture absorbed by the diluted liquid desiccant 154 is desorbed in the second three-way heat exchanger 144 into the second inlet air stream 114, which regenerates the concentrated liquid desiccant 152 that is then channeled back toward the first three-way heat exchanger 136.

The HVAC system 100 may operate in alternative operating modes than the example operating mode described above with reference to FIG. 1. The example operating mode of the HVAC system 100 described above may be considered a warm weather operating mode of the HVAC system 100, in which warm, humid air in the first inlet air stream 110 is cooled and dehumidified using the conditioner sub-system 104 and the heat and moisture removed is transferred by the sub-systems 102 and 106 and the liquid desiccant circuit 108 and rejected into the second inlet air stream 114 to produce the heated, humidified outlet air stream 116 that is directed into the warm, humid ambient. In a cold weather operating mode of the HVAC system 100, the operation of the sub-systems 102-106 and the liquid desiccant circuit 108 may be reversed such that the first three-way heat exchanger 136 heats and humidifies cool, dry air in the first inlet air stream 110 to produce warm air with a comfortable humidity level in the outlet air stream 112 that is channeled to a conditioned space. In the cold weather operating mode, the direction of flow of the refrigerant in the loop 126 and the liquid desiccant in the liquid desiccant circuit 108 may be reversed, such that the air treatment sub-systems 104 and 106 switch their respective functions, or intake and outlet vents for the first and second inlet air streams 110 and 114 may be rearranged and/or reconfigured such that the direction of airflow directed through the first and second three-way heat exchangers 136 and 144 is reversed, with the outlet air stream 112 being channeled toward the ambient environment and the outlet air stream 116 being channeled toward the conditioned space. In still other operating modes of the HVAC system 100, depending on the operational requirements and desired setpoint temperature and humidity level within the conditioned space, one of the air treatment sub-system 104 and 106 may be idle or omitted from the HVAC system 100. For example, the air treatment sub-system 106 may be omitted and the refrigerant sub-system 104 may reject or absorb heat from a refrigerant-air heat exchanger 120, depending on the operating mode of the HVAC system 100. Where the regenerator sub-system 106 is omitted or idle, liquid desiccant in the liquid desiccant circuit 108 that is cycled through the first three-way heat exchanger 136 may be regenerated or diluted, depending on the operating mode of the HVAC system 100, using auxiliary regeneration equipment, dilution tanks, or the like.

Still with reference to FIG. 1, the first three-way heat exchanger 136 and the second three-way heat exchanger 144 have substantially the same configuration. In alternative embodiments, the first three-way heat exchanger 136 and the second three-way heat exchanger 144 may have a different configuration. Although the conditioner sub-system 104 and the regenerator sub-system 106 are shown in FIG. 1 to include one three-way heat exchanger 136 and 144, respectively, any suitable number of three-way heat exchangers 136 and 144 may be included in the respective sub-system 104 and 106. The number of three-way heat exchangers 136 included in the conditioner sub-system 104 may be the same or different than the number of three-way heat exchangers 144 included in the regenerator sub-system 106. Where the conditioner sub-system 104 includes multiple three-way heat exchangers 136, the heat exchangers 136 may operate in series, in parallel, or any combination thereof. Where the regenerator sub-system 106 includes multiple three-way heat exchangers 144, the heat exchangers 144 may operate in series, in parallel, or any combination thereof.

Figure 2:
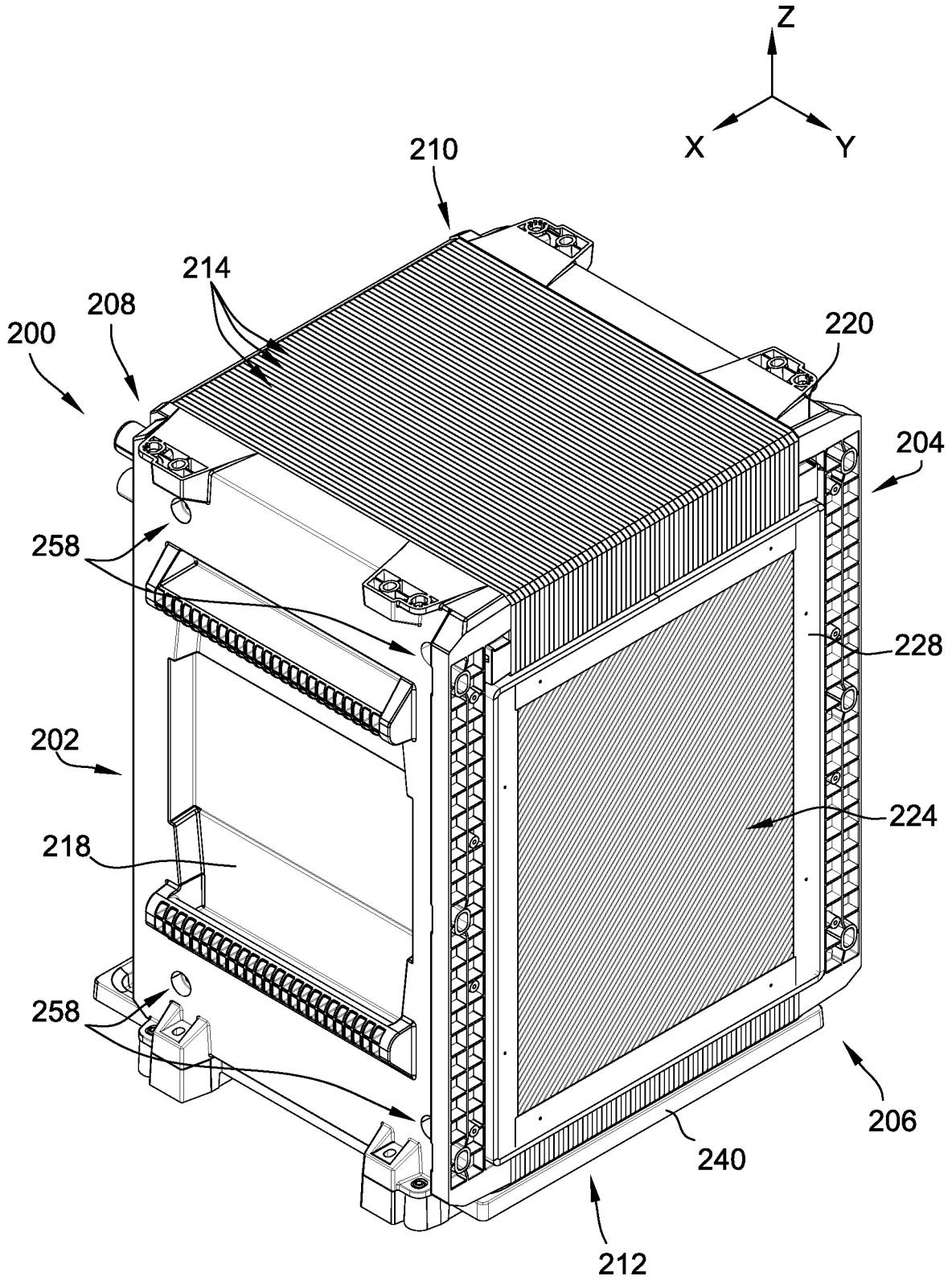
FIG. 2 is a front perspective of a three-way heat exchanger included in the HVAC system of FIG. 1.
Figure 3:
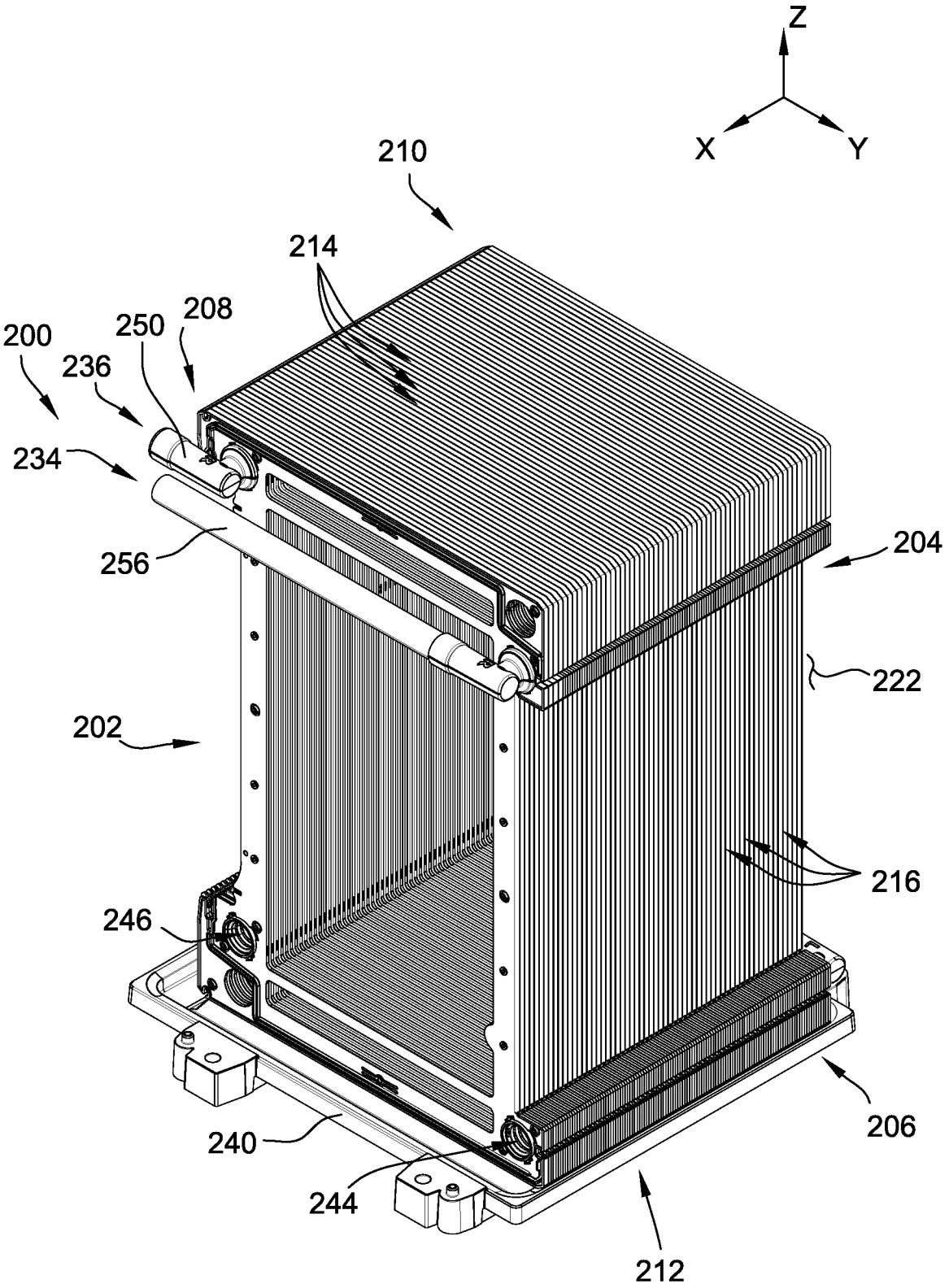
FIG. 3 is a front perspective of the three-way heat exchanger, with various components omitted to show internal components.
Figure 4:
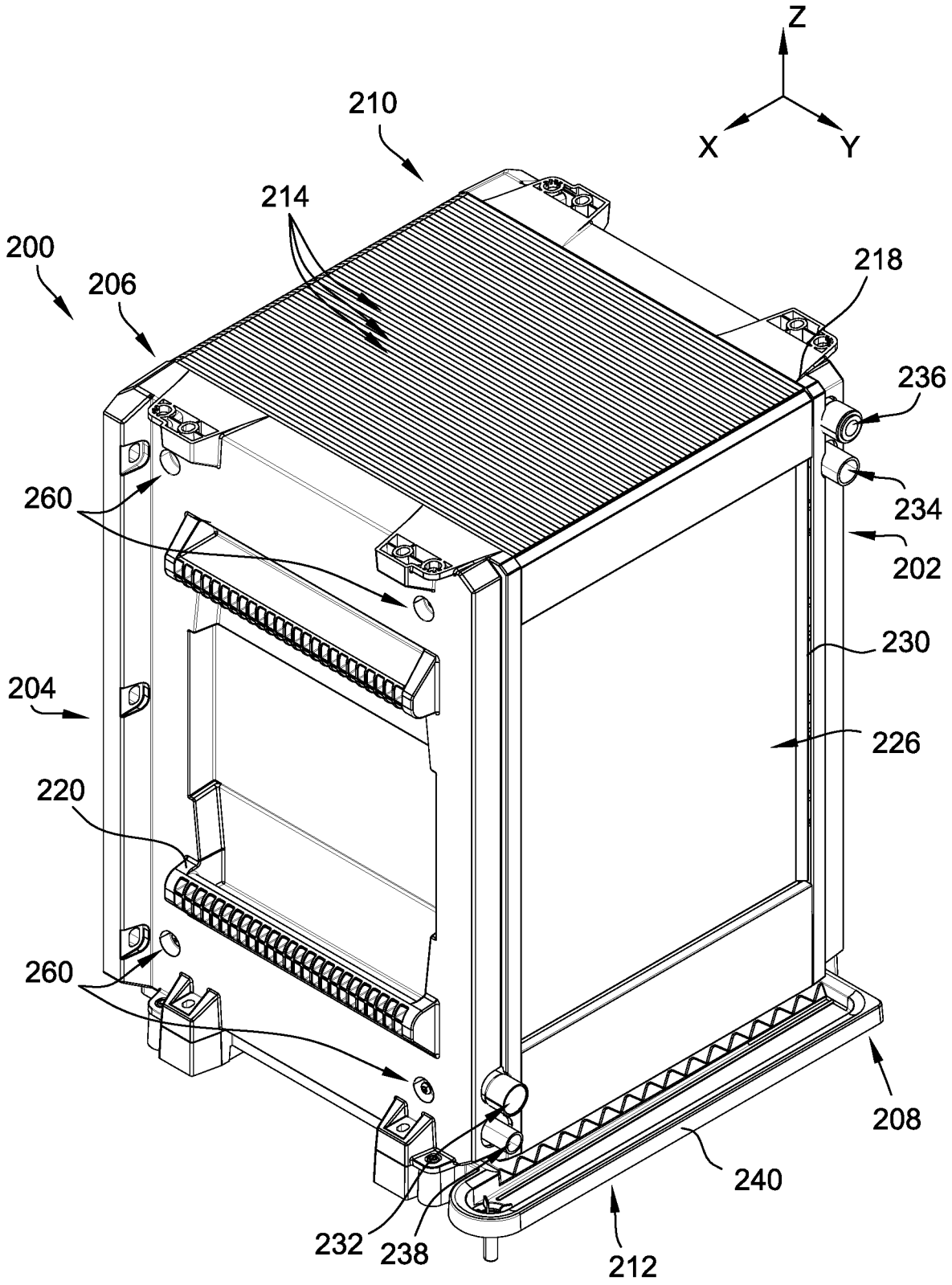
FIG. 4 is a rear perspective of the three-way heat exchanger.
Figure 5:
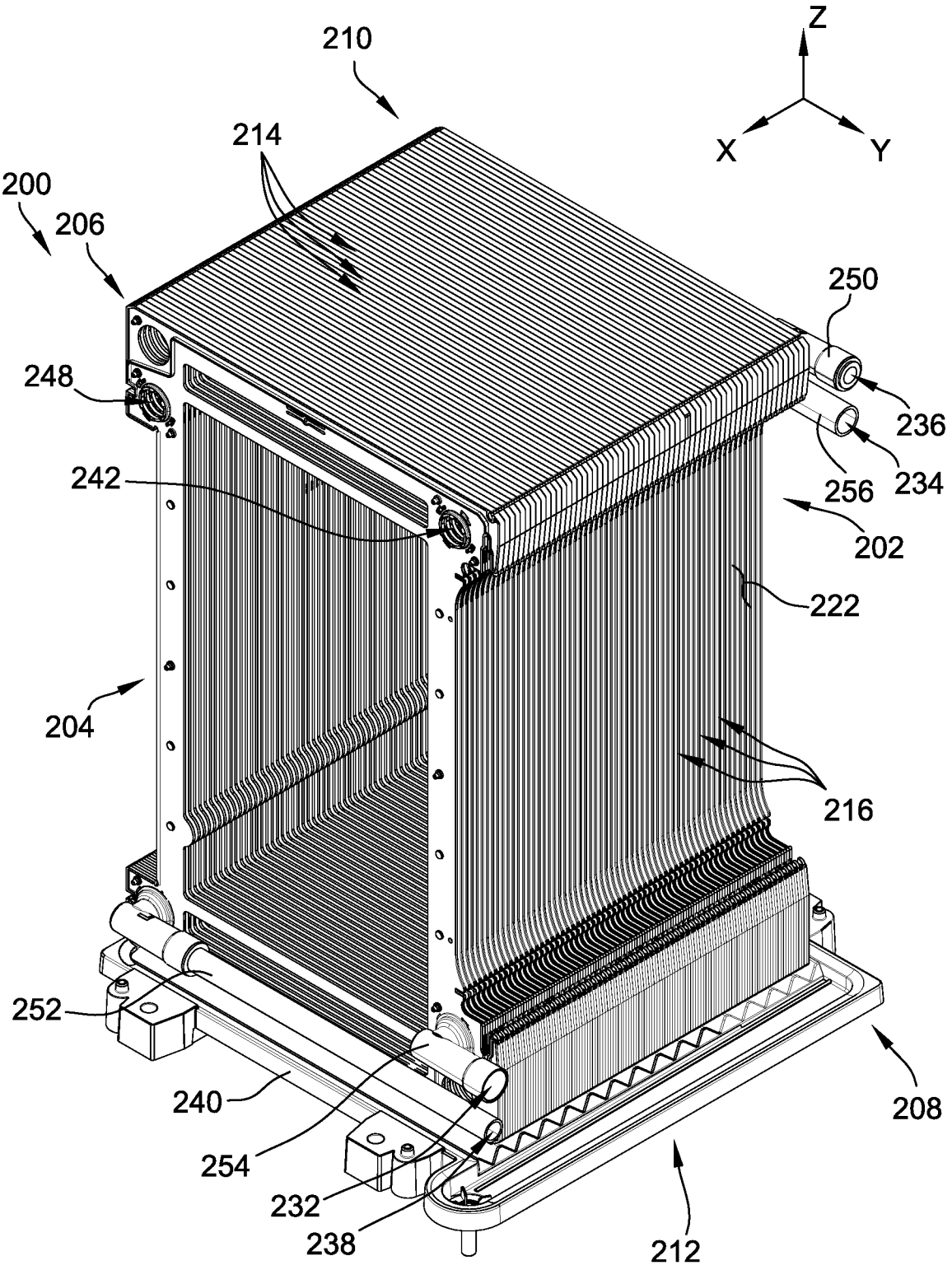
FIG. 5 is a rear perspective of the three-way heat exchanger with various components omitted, similar to FIG. 3.

Referring now to FIGS. 2-5, an example three-way heat exchanger 200 for use in an air treatment sub-system of the HVAC system 100 of FIG. 1 will now be described. The three-way heat exchanger 200 may be implemented as a first three-way heat exchanger 136 in the conditioner sub-system 104 and/or as a second three-way heat exchanger 144 in the regenerator sub-system 106. FIG. 2 is a front perspective of the three-way heat exchanger 200. FIG. 3 is a front perspective of the three-way heat exchanger 200 with various components omitted to show internal components of the three-way heat exchanger 200. FIG. 4 is a rear perspective of the three-way heat exchanger 200. FIG. 5 is a rear perspective of the three-way heat exchanger 200 with various components omitted, similar to FIG. 3.

The three-way heat exchanger 200 has a dimension in the X-axis, Y-axis and Z-axis, respectively. The X-axis, Y-axis and Z-axis are each mutually perpendicular. As described herein with respect to the three-way heat exchanger 200 and components of the heat exchanger 200 when assembled, dimensions in the Z-axis may be referred to as a "height," dimensions in the Y-axis may be referred to as a "length," and dimensions in the X-axis may be referred to as a "width." The three-way heat exchanger 200 defines a lateral direction in the X-axis, a longitudinal direction in the Y-axis, and a vertical direction in the Z-axis. The X-axis may also be referred to herein as a lateral axis, the Y-axis may also be referred to herein as a longitudinal axis, and the Z-axis may also be referred to herein as a vertical axis. The three-way heat exchanger 200 has respectively opposite first and second lateral sides 202 and 204, first and second longitudinal sides 206 and 208, and first and second vertical sides 210 and 212. The first and second lateral sides 202 and 204 are spaced apart in the lateral direction, the first and second longitudinal sides 206 and 208 are spaced apart in the longitudinal direction, and the first and second vertical sides 210 and 212 are spaced apart in the vertical direction. Directional terms are used for solely for description of the three-way heat exchanger 200 and the spatial relation of the components of the heat exchanger. The examples shown and described are not limited to any particular orientation.

The three-way heat exchanger 200 includes a set of panel assemblies 214 arranged in succession or series in the lateral direction between the first lateral side 202 and the second lateral side 204. The individual panel assemblies 214 will be described in more detail below with reference to FIGS. 7-10. Each panel assembly 214 is in the form of a plate structure that has an internal heat transfer fluid channel through which a heat transfer fluid, such as the conditioner heat transfer fluid in the loop 138 or regenerator heat transfer fluid in the loop 146, flows. Each panel assembly 214 also includes liquid desiccant channels on opposite sides of the heat transfer fluid channel. A liquid desiccant, such as the concentrated liquid desiccant 152 or the diluted liquid desiccant 154 in the liquid desiccant circuit 108, flows through the liquid desiccant channels. Liquid desiccant flowing through the liquid desiccant channels is separated from the heat transfer fluid flowing through the heat transfer fluid channel of the respective panel assembly, and heat is exchanged between the liquid desiccant in the liquid desiccant channels and the heat transfer fluid flowing through the heat transfer fluid channel. Airflow gaps 216, also referred to as air gaps 216, are defined between adjacent panel assemblies 214 in the lateral direction. Each airflow gap 216 extends primarily in the vertical and longitudinal directions.

Any suitable number of panel assemblies 214 may be included in the three-way heat exchanger 200. For example, the three-way heat exchanger 200 may include from 1 to 200 panel assemblies 214, from 1 to 100 panel assemblies 214, from 50 to 200 panel assemblies 214, from 50 to 100 panel assemblies 214, such as one panel assembly, ten panel assemblies 214, twenty panel assemblies 214, thirty panel assemblies 214, forty panel assemblies 214, fifty panel assemblies 214, sixty panel assemblies 214, seventy panel assemblies 214, eighty panel assemblies 214, ninety panel assemblies 214, 100 panel assemblies 214, or greater than 100 panel assemblies 214.

The panel assemblies 214 are supported on a base 240 at the second vertical side 212 of the three-way heat exchanger 200. The panel assemblies 214 extend substantially parallel to one another between the base 240 and the first vertical side 210 of the three-way heat exchanger 200. The panel assemblies 214 may, in operation of the three-way heat exchanger 200, deviate from a substantially parallel extent as fluid flows through the panel assemblies 214 and/or as air flows through the air gaps 216 between adjacent panel assemblies 214.

The three-way heat exchanger 200 includes a first end plate 218 and a second end plate 220 at the first and second lateral sides 202 and 204, respectively. The end plates 218, 220 may also be referred to as end covers or end sheets. The end plates 218 and 220 may provide lateral support for the set of panel assemblies 214 and enclose an interior 222 of the three-way heat exchanger 200 at the first and second lateral sides 202 and 204. The end plates 218 and 220 are omitted from FIGS. 3 and 5 to show the arrangement of the panel assemblies 214, the airflow gaps 216 defined between adjacent panel assemblies 214, and the interior 222 of the three-way heat exchanger 200 in greater detail.

Each end plate 218 and 220 includes alignment apertures 258 and 260, respectively, for receiving clamping assemblies 400*a* (shown in FIGS. 12-18) used to clamp the panel assemblies 214 together. The clamping assemblies 400*a* will be described in more detail below. The alignment apertures 258 are each defined at one of the four corners of the first end plate 218 and the alignment apertures 260 are each defined at one of the four corners of the second end plate 220 in the illustrated example. Each alignment aperture 258 in the first end plate 218 corresponds to an alignment aperture 260 in the second end plate 220, such that a corresponding clamping assembly 400*a* extends through each end plate 218 and 220 and the panel assemblies 214, described in more detail below. In other examples, the alignment apertures 258 and 260 may be defined at different locations in the respective end plate 218 and 220. Each end plate 218 and 220 includes four alignment apertures 258 and 260, but may have more or fewer alignment apertures 258 and 260 in other examples. The first end plate 218 may, in other examples, have a different number of alignment apertures 258 than the number of alignment apertures 260 in the second end plate 220.

The interior 222 of the three-way heat exchanger 200 may be enclosed at the first and second vertical sides 210 and 212 of the three-way heat exchanger by the set of panel assemblies 214. For example, adjacent panel assemblies 214 may be connected and/or in contact with one another at opposite vertical ends to seal the respective airflow gap 216 defined therebetween at the opposite vertical ends and to enclose the interior 222 of the three-way heat exchanger at the first and second vertical sides 210 and 212. As described in more detail below, adjacent panel assemblies 214 are clamped together at the first and second vertical sides 210 and 212 by the clamping assemblies 400*a* and 400*b* (shown in FIGS. 12-18). The clamping assemblies 400*a* and 400*b* may suitably maintain the adjacent panel assemblies 214 sealed at the first and second vertical sides 210 and 212 during operation of the three-way heat exchanger 200 to seal the respective airflow gap 216 defined therebetween. Additionally and/or alternatively, the three-way heat exchanger 200 may include vertical end plates (not shown) to enclose the interior 222 at the first and second vertical sides 210 and 212.

The three-way heat exchanger 200 includes an airflow inlet 224 on the first longitudinal side 206 and an airflow outlet 226 on the second longitudinal side 208. The airflow inlet 224 and the airflow outlet 226 are respectively defined by longitudinal side panels 228 and 230 of the three-way heat exchanger 200. For example, the longitudinal side panels 228 and 230 may include openings in the form of grated or grille openings, shutters, louvers, dampers, or may have any other suitable open configuration to enable airflow to enter into and exit the three-way heat exchanger 200. In some examples, one or both of the longitudinal side panels 228 and 230 may include a filter to filter particulate and/or contaminants from an air stream that is treated by the three-way heat exchanger 200. The airflow inlet 224 and the airflow outlet 226 are in communication with the airflow gaps 216 defined between the adjacent panel assemblies 214, and allow an inlet air stream (e.g., the first or second inlet airstream 110 or 114 in FIG. 1) to flow through the three-way heat exchanger 200 in the longitudinal direction. The longitudinal side panels 228 and 230 are omitted from FIGS. 3 and 5 to show the arrangement of the panel assemblies 214, the airflow gaps 216 defined between adjacent panel assemblies 214, and the interior 222 of the three-way heat exchanger 200 in greater detail.

The three-way heat exchanger 200 also includes heat transfer fluid inlet 232 and outlet 234 and liquid desiccant inlet 236 and outlet 238. Heat transfer fluid (e.g., circulating in one of the heat transfer fluid loops 138 or 146 in FIG. 1) enters into and exits the three-way heat exchanger 200 via the heat transfer fluid inlet 232 and outlet 234, respectively. Liquid desiccant (e.g., circulating the liquid desiccant circuit 108 in FIG. 1) enters into and exits the three-way heat exchanger 200 via the liquid desiccant inlet 236 and outlet 238, respectively.

As shown in FIG. 4, the heat transfer fluid inlet 232 and outlet 234 and the liquid desiccant inlet 236 and outlet 238 are each located on the same longitudinal side (e.g., the second longitudinal side 208) of the three-way heat exchanger 200. This may simplify installation of the three-way heat exchanger 200 and/or reduce bulk of the heat exchanger 200 in an air treatment sub-system when installed. Locating the heat transfer fluid inlet 232 and outlet 234 and the liquid desiccant inlet 236 and outlet 238 on the second longitudinal side 208 may further simplify installation and/or reduce bulk of the three-way heat exchanger 200 because the second longitudinal side 208 may suitably be oriented toward the other components of the air treatment sub-system when installed. The second longitudinal side 208 includes the airflow outlet 226, which is oriented opposite the external environment toward which the airflow inlet 224 is oriented. Thus, the second longitudinal side 208 may be oriented toward and/or connected to ductwork and other components of the air treatment sub-system, so that when installed, may suitably be located opposite the first longitudinal side 206 and the airflow inlet 224 of the three-way heat exchanger 200.

Additionally, as shown in FIG. 4, the heat transfer fluid inlet 232 and outlet 234 are located on opposite lateral and vertical sides of the three-way heat exchanger 200. The liquid desiccant inlet 236 and outlet 238 are also located on opposite lateral and vertical sides of the three-way heat exchanger 200. In the illustrated example, the heat transfer fluid inlet 232 and the liquid desiccant outlet 238 are both located proximate the second vertical side 212 and the second lateral side 204, and the heat transfer fluid outlet 234 and the liquid desiccant inlet 236 are both located proximate the first vertical side 210 and the first lateral side 202. The respective locations of the heat transfer fluid inlet 232 and outlet 234 and/or the respective locations of the liquid desiccant inlet 236 and outlet 238 may be swapped in some examples. For example, the heat transfer fluid inlet 232 and the liquid desiccant inlet 236 may both be located proximate the second vertical side 212 and the second lateral side 204, and the heat transfer fluid outlet 234 and the liquid desiccant outlet 238 may both be located proximate the first vertical side 210 and the first lateral side 202. Alternatively, the heat transfer fluid inlet 232 and the liquid desiccant inlet 236 may both be located proximate the first vertical side 210 and the first lateral side 202, and the heat transfer fluid outlet 234 and the liquid desiccant outlet 238 may both be located proximate the second vertical side 212 and the second lateral side 204. Alternatively, the heat transfer fluid inlet 232 and the liquid desiccant outlet 238 may both be located proximate the first vertical side 210 and the first lateral side 202, and the heat transfer fluid outlet 234 and the liquid desiccant inlet 236 may both be located proximate the second vertical side 212 and the second lateral side 204. The locations of the heat transfer fluid inlet 232 and outlet 234 and the liquid desiccant inlet 236 and outlet 238 may vary depending on a desired flow direction of the heat transfer fluid and the liquid desiccant through the panel assemblies 214. The liquid desiccant inlet 236 and the heat transfer fluid outlet 234 may be defined by (e.g., made integral with) the end plate 218 and the liquid desiccant outlet 238 and the heat transfer fluid inlet 232 may be defined by (e.g., made integral with) the end plate 220. Alternatively, the heat transfer fluid inlet 232 and outlet 234 and the liquid desiccant inlet 236 and outlet 238 may each be defined by a conduit (e.g., a pipe, tube, hose, or other suitable fluid conduit) that extends longitudinally through an opening in the respective end plate 218 and 220.

Figure 7:
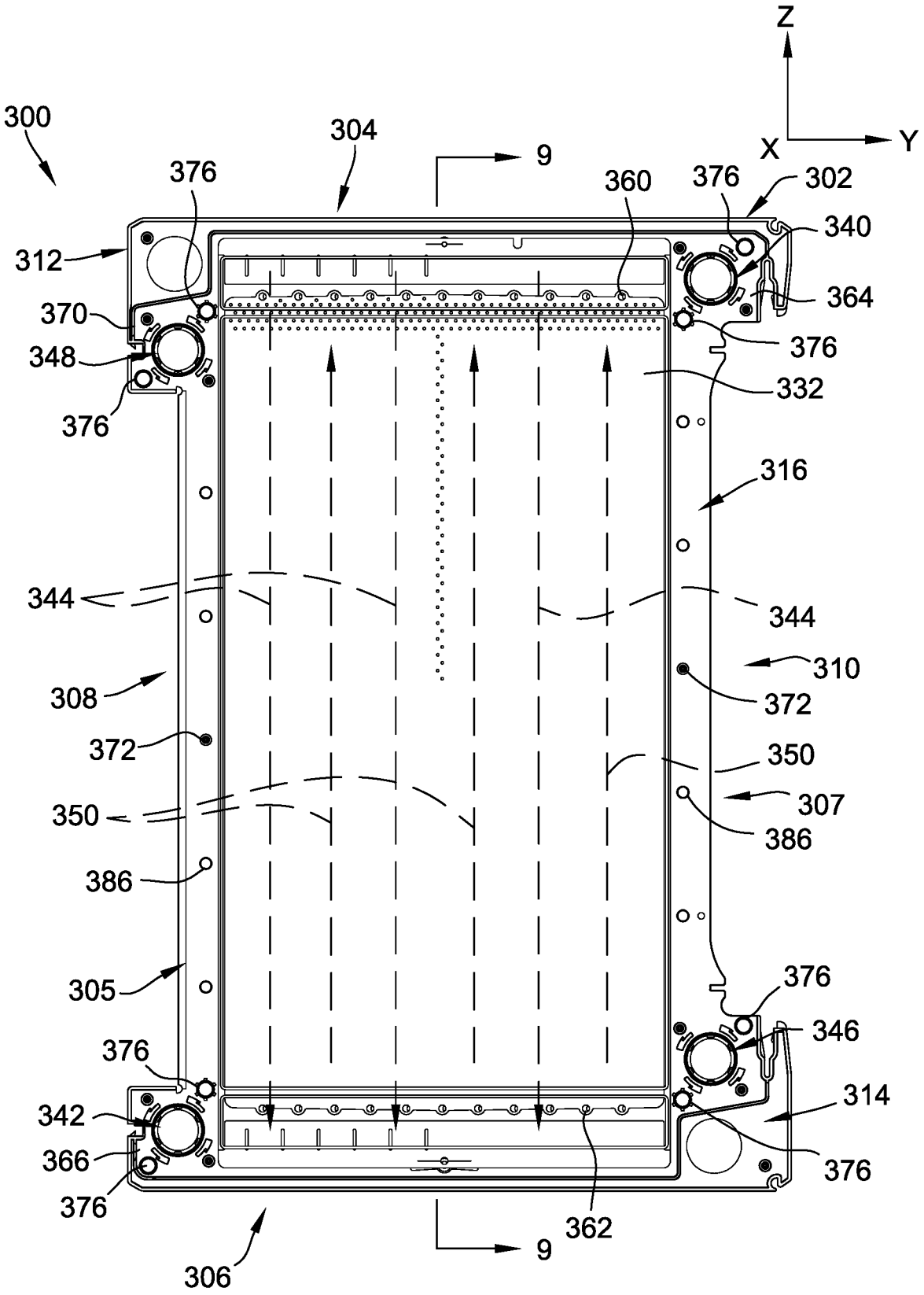
FIG. 7 is a right side elevation of an example panel assembly included in the three-way heat exchanger of FIGS. 2-6.
Figure 8:
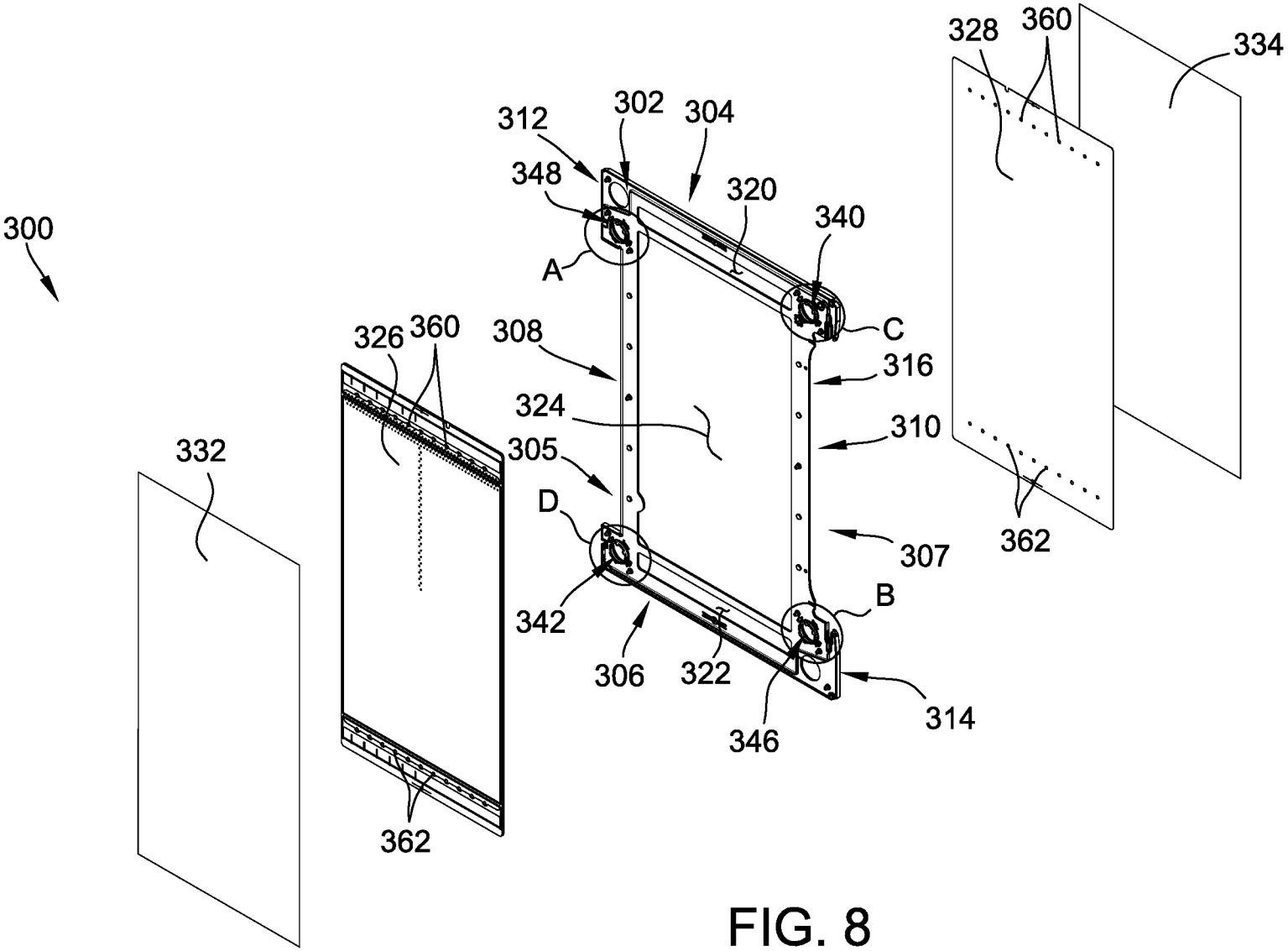
FIG. 8 is an exploded view of the panel assembly of FIG. 7.
Figure 9:
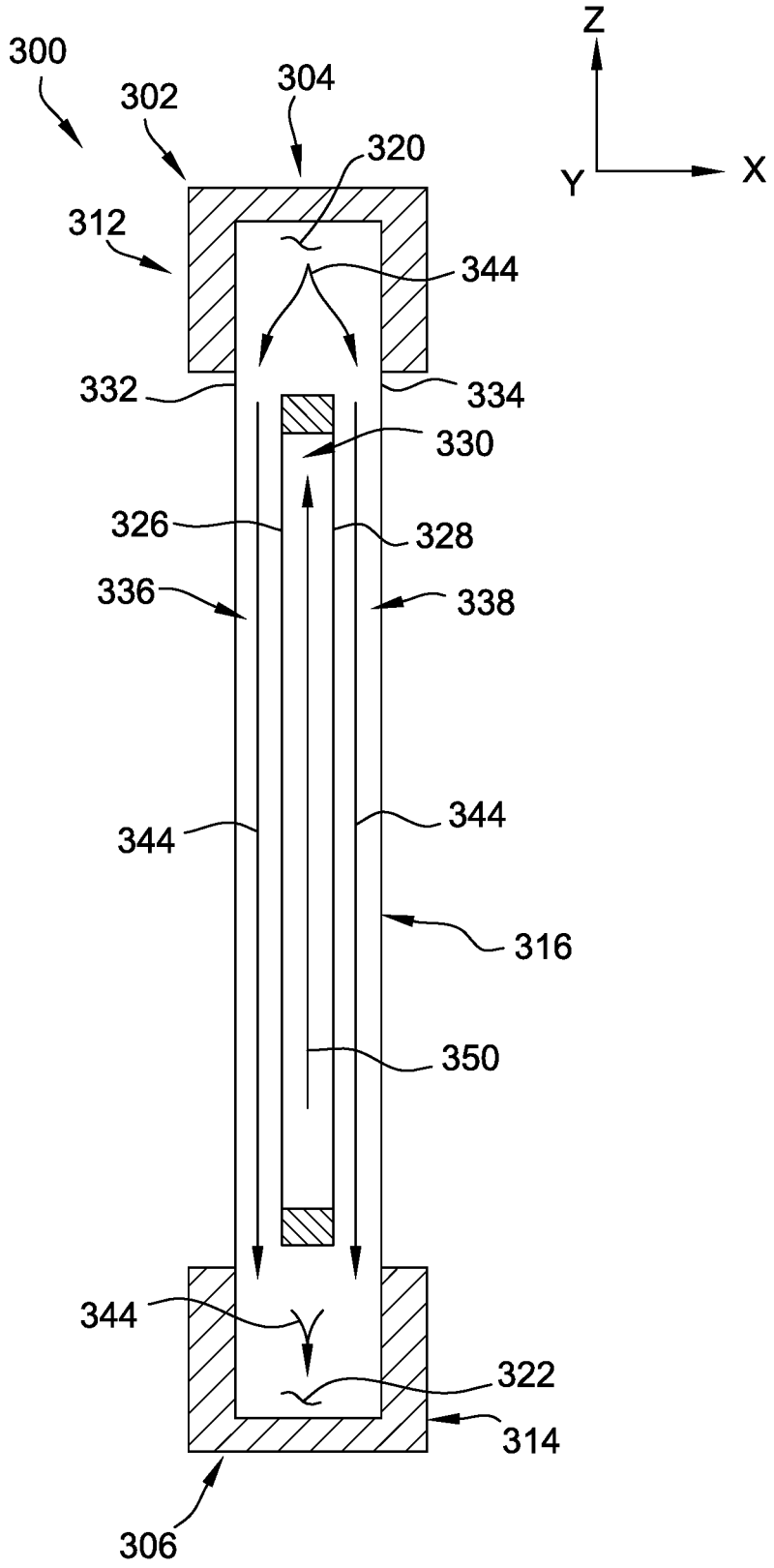
FIG. 9 is a schematic section of the panel assembly taken along section line 9-9 in FIG. 7.

Referring to FIGS. 7-9, an example panel assembly 300 suitable for use as the individual panel assemblies 214 will now be described. In the example three-way heat exchanger 200, all the panel assemblies 214 have substantially the same configuration as the panel assembly 300 shown in FIGS. 7-9. The panel assemblies 214 will be referred to as the panel assemblies 300 hereinafter for convenience of description. Some of or all the panel assemblies 214 may include additional components, fewer components, or other components than the panel assembly 300.

FIG. 7 is a right side elevation of the example panel assembly 300. FIG. 8 is an exploded view of the panel assembly 300. FIG. 9 is a schematic section of the panel assembly 300 taken along section line 9-9 in FIG. 7. The spatial relation of components of the panel assembly 300 will be described with respect to the X-axis, Y-axis, and Z-axis, and the lateral direction, longitudinal direction, and vertical direction defined by the three-way heat exchanger 200. The panel assembly 300 will also be described in the orientation when implemented and installed in the three-way heat exchanger 200. Directional terms are used to describe components of the panel assembly 300 solely for convenience of description. The examples shown and described are not limited to any particular orientation.

The panel assembly 300 includes a frame 302 that defines first and second vertical ends 304 and 306, in the Z-axis, first and second lateral faces 305 and 307, in the X-axis, and first and second longitudinal ends 308 and 310, in the Y-axis, of the panel assembly 300. The frame 302 includes opposite first and second header sections 312 and 314 respectively located at the first and second vertical ends 304 and 306. The frame 302 also includes a middle section 316 between the opposite header sections 312 and 314. The header sections 312 and 314 respectively define liquid desiccant header areas 320 and 322. The middle section 316 defines a heat transfer fluid area 324. The liquid desiccant header areas 320 and 322 are separated from the heat transfer fluid area 324 by portions of the frame 302 that respectively extend between the heat transfer fluid area 324 and one of the liquid desiccant header areas 320 and 322.

The panel assembly 300 also includes first and second plates 326 and 328 disposed on opposite lateral faces of the frame 302, covering the middle section 316 of the frame 302. The first and second plates 326 and 328 be a sheet of material that is, for example, less than 0.5 inch thick, or less than 0.25 inch thick, and the plates 326, 328 may also be referred to as sheets. The first and second plates 326 and 328 may be attached to the frame 302 or may be made integral with the frame 302. Suitable techniques for attaching the plates 326 and 328 to the frame 302 may include, for example, welding (e.g., laser, induction, or radio-frequency welding), adhesive bonding, thermal bonding, or another suitable technique for joining materials together. The frame 302 and the plates 326 and 328 may be made from dissimilar but compatible materials for welding together. For example, the frame 302 and the plates 326 and 328 may each be made from the same or different thermoplastic or polymeric materials. The material used for the frame 302 and the plates 326 and 328 may also be selected based on its compatibility with the liquid desiccant used in the three-way heat exchanger 200. Suitable polymer materials for the frame 302 and the plates 326 and 328 include, for example, polyolefins (e.g., polypropylene and/or polyethylene), acrylonitrile butadiene styrene (ABS), and combinations thereof. The plates 326 and 328 may include additives that improve properties such as laser-absorbing and conductivity properties, as well as the strength and/or stiffness of the plates 326 and 328. In other examples, the frame 302 and the plates 326 and 328 may be made from any other suitable materials that enable the three-way heat exchanger 200 to function as described.

The plates 326 and 328 envelop and seal the heat transfer fluid area 324 of the frame, defining a heat transfer fluid channel 330 of the panel assembly 300 between the plates 326 and 328 (see FIG. 9). As described below, in operation of the three-way heat exchanger 200, heat transfer fluid flows between the plates 326 and 328 through the heat transfer fluid channel 330 and liquid desiccant flows over an outer surface of the plates 326 and 328, opposite the heat transfer fluid channel 330. The plates 326 and 328 isolate the liquid desiccant from the heat transfer fluid in the channel 330, and allow heat to transfer between the liquid desiccant and the heat transfer fluid. The plates 326 and 328 may extend over one or both of liquid desiccant header areas 320 and 322 and define openings (e.g., apertures 360) that align with the one or both of the liquid desiccant header areas 320 and 322 to enable liquid desiccant to flow therethrough. In the example panel assembly 300, each of the plates 326 and 328 includes a series of apertures 360 located adjacent the liquid desiccant header 320 and a series of apertures 362 located adjacent the liquid desiccant header area 322. Liquid desiccant may flow through the apertures 360 and 362 of each plate 326 and 328 to enter and/or exit the liquid desiccant header area 320 and 322, respectively.

A netting or mesh (not shown) may be disposed in the heat transfer fluid channel 330 to maintain a width of the heat transfer fluid channel under negative pressure. The netting or mesh may also facilitate more constant flow rates of the heat transfer fluid through the channel 330. The netting or mesh may also facilitate improving flow distribution of the heat transfer fluid between the panel assemblies 300 in the three-way heat exchanger 200. The netting or mesh may also provide turbulation of the heat transfer fluid to increase heat transfer with the liquid desiccant flowing over the outer surfaces of the plates 326 and 328. A wide variety of materials may be used for the netting or mesh. For example, the netting or mesh may include the same polymer material as the plates (e.g., polyolefins, ABS, or combinations thereof).

The panel assembly 300 also includes membranes 332 and 334 disposed on the opposite lateral faces 305 and 307 of the frame 302. In other examples, only one of the membranes 332 or 334 may be included in the panel assembly 300. The membranes 332 and 334 cover the outer surfaces of the plates 326 and 328. As shown in FIG. 9, liquid desiccant channels 336 and 338 are respectively defined between the membrane 332 and the plate 326 and the membrane 334 and the plate 328. The membranes 332 and 334 also envelop and seal the liquid desiccant header areas 320 and 322. Each liquid desiccant channel 336 and 338 connects the liquid desiccant header areas 320 and 322 in fluid communication. As described below, in operation of the three-way heat exchanger 200, liquid desiccant flows through one of the liquid desiccant header areas 320 or 322, into the liquid desiccant channels 336 and 338, over the outer surfaces of the plates 326 and 328 and behind the membranes 332 and 334, and finally into the other one of the liquid desiccant header areas 320 or 322. The plates 326 and 328 limit contact between the liquid desiccant flowing in the liquid desiccant channels 336 and 338 and heat transfer fluid flowing through the heat transfer fluid channel 330, and enable heat to transfer therebetween. In examples where only one of the membranes 332 or 334 is included in the panel assembly 300, only one liquid desiccant channel 336 or 338 may be defined between the membrane 332 or 334 and the plate 326 or 328. In these examples, the plate 326 or 328 on the lateral face 305 or 307 opposite the liquid desiccant channel 336 or 338 may envelop and seal the liquid desiccant header areas 320 and 322 and restrict flow of liquid desiccant opposite the liquid desiccant channel 336 or 338.

The membranes 332 and 334 are attached to one of the lateral faces 305 and 307, respectively, of the frame 302 to envelop and seal the liquid desiccant header areas 320 and 322. The membranes 332 and 334 may also be attached to the outer surface of the respective plate 326 and 328, which may facilitate maintaining a width of the liquid desiccant channels 336 and 338 and/or limiting a propensity of the membranes 332 and 334 to bulge outward when liquid desiccant flows through the liquid desiccant channels 336 and 338. The membranes 332 and 334 may be attached to the lateral faces 305 and 307 of the frame 302 and/or the outer surfaces of the plates 326 and 328 using any suitable technique, such as adhesive bonding or heat sealing (e.g., welding), for example. The membranes 332 and 334 may be respectively attached to the plates 326 and 328 directly by heat sealing (e.g., welding) where compatible materials (e.g., polyolefins) are used for the membranes 332 and 334 and the respective plates 326 and 328. An outer bonding layer (not shown) may be applied over the outer surfaces of the plates 326 and 328 to improve the quality or ease of forming the heat seals (e.g., welds) with the respective membranes 332 and 334. The outer surfaces of the plates 326 and 328 may include raised patterns or dot features (not shown) to which the membranes 332 and 334 are adhered, heat sealed, or otherwise attached. The raised patterns may be formed on the frame 302 and/or plates 326 and 328 by thermoforming, embossing, or other suitable techniques. Attaching the membranes 332 and 334 to the dot features or raised patterns may provide an additional advantage of facilitating uniform distribution of the liquid desiccant across the liquid desiccant channels 336 and 338 in the longitudinal direction and reducing stresses that can lead to warping of the plates 326 and 328. Warping of the plates 326 and 328 may degrade the ability to transfer heat and moisture between the heat transfer fluid, the liquid desiccant, and air that flows across the membranes 332 and 334 in operation of the three-way heat exchanger 200. Additional detail on attaching the membranes 332 and 334 to the frame 302 and the respective plates 326 and 328 is described in U.S. Pat. No. 11,022,330, issued on Jun. 1, 2021, and U.S. Pat. No. 10,921,001, issued on Feb. 16, 2021, the disclosures of each of which are hereby incorporated herein by reference in their entirety.

The membranes 332 and 334 are made of a vapor-permeable material that permits transfer of water vapor therethrough to enable liquid desiccant flowing in the liquid desiccant channels 336 and 338 to absorb moisture from and desorb moisture into air flowing across the membranes 332 and 334. In some examples, the membranes 332 and 334 may each be made from a polypropylene material or other suitable vapor-permeable polymeric material. The vapor-permeable material used for the membranes 332 and 334 may be microporous (e.g., having a pore size less than 0.5 micrometers (μm)). Examples of suitable microporous membranes are disclosed in U.S. Pat. No. 9,101,874, issued on Aug. 11, 2015, the disclosure of which is hereby incorporated by reference herein in its entirety. By way of example, suitable commercially available membrane include the EZ2090 polypropylene, microporous membrane from Celgard. Microporous membranes 332 and 334 may have 40-80% open area, pore sizes of less than 0.5 μm, and a thickness of less than 100 μm. Some example microporous membranes may have greater than 80% open area. One suitable membrane is approximately 65% open area and has a thickness of approximate 20 μm. This type of membrane is structurally very uniform in pore size and is thin enough to not create a significant thermal barrier. Other possible membranes include membranes from 3M, Lydall, and other manufacturers. The membranes 332 and 334 may include any suitable vapor-permeable material that permits water transfer therethrough to enable the liquid desiccant in the liquid desiccant channels 336 and 338 to absorb moisture from or desorb moisture into air flowing over the membranes 332 and 334.

The frame 302 defines a liquid desiccant inlet port 340 that feeds liquid desiccant into the liquid desiccant header area 320 and a liquid desiccant outlet port 342 that receives liquid desiccant from the liquid desiccant header area 322. The liquid desiccant inlet port 340 is defined in a first corner flange 364 of the frame 302. The first corner flange 364 of the frame 302 is part of the first header section 312 and is located adjacent to the liquid desiccant header area 320 at the first vertical end 304 and the second longitudinal end 310 of the panel assembly 300. The liquid desiccant outlet port 342 is defined in a second corner flange 366 of the frame 302. The second corner flange 366 is part of the second header section 314, and is located adjacent to the liquid desiccant header area 322 at the second vertical end 306 and the first longitudinal end 308 of the panel assembly 300. Thus, the first and second corner flanges 364 and 366, and the liquid desiccant inlet and outlet ports 340 and 342 respectively defined therein, are located on opposite longitudinal and vertical ends of the panel assembly 300.

As represented by the flow lines 344 in FIGS. 7 and 9, in operation of the three-way heat exchanger 200, liquid desiccant is supplied into the liquid desiccant header area 320 of the panel assembly 300 via the liquid desiccant inlet port 340, flows through each of the liquid desiccant channels 336 and 338 and into the liquid desiccant header area 322, and exits the panel assembly 300 via the liquid desiccant outlet port 342. In the illustrated example, the flow direction of the liquid desiccant is vertically downward. The liquid desiccant may have alternative flow directions. For example, the liquid desiccant may flow vertically upward through the liquid desiccant channels 336 and 338, being supplied into the liquid desiccant header area 322 and exiting via the liquid desiccant header area 320. In other examples, the orientation of the panel 300 in the three-way heat exchanger 200 may be such that the liquid desiccant flows in a substantially horizontal flow direction. In yet other examples, the panel 300 may be oriented at an oblique angle in the three-way heat exchanger 200 such that the liquid desiccant flows in both a vertical and horizontal direction.

The frame 302 also defines a heat transfer fluid inlet port 346 that feeds heat transfer fluid into the heat transfer fluid channel 330 and a heat transfer fluid outlet port 348 that receives heat transfer fluid from the heat transfer fluid channel 330. The heat transfer fluid inlet port 346 is defined in a third corner flange 368 of the frame 302. The third corner flange 368 of the frame 302 is part of the second header section 314 and the middle section 316. The third corner flange 368 is located adjacent to heat transfer fluid channel 330, at the second longitudinal end 310 and proximate to the second vertical end 306 of the panel assembly 300. The heat transfer fluid outlet port 348 is defined in a fourth corner flange 370 of the frame 302. The fourth corner flange 370 is part of the first header section 312 and the middle section 316. The fourth corner flange 370 is located adjacent to the heat transfer fluid channel 330, at the first longitudinal end 308 and proximate to the first vertical end 304 of the panel assembly 300. Thus, the third and fourth corner flanges 368 and 370, and the heat transfer fluid inlet and outlet ports 346 and 348 respectively defined therein, are located on opposite longitudinal and vertical ends of the panel assembly 300. Additionally, the first and fourth corner flanges 364 and 370, and the liquid desiccant inlet port 340 and the heat transfer fluid outlet port 348 respectively defined therein, are both located proximate to the first vertical end 304, on opposite longitudinal ends of the panel assembly. The second and third corner flanges 366 and 368, and the liquid desiccant outlet port 342 and the heat transfer fluid inlet port 346 respectively defined therein, are both located proximate to the second vertical end 306, on opposite longitudinal ends of the panel assembly.

As represented by the flow lines 350 in FIGS. 7 and 9, in operation of the three-way heat exchanger 200, heat transfer fluid is supplied into the heat transfer fluid channel 330 of the panel assembly 300 via the heat transfer fluid inlet port 346, flows therethrough, and exits the panel assembly 300 via the heat transfer fluid outlet port 348. In the illustrated example, the flow direction of the heat transfer fluid is vertically upward. The heat transfer fluid may have alternative flow directions. For example, the heat transfer fluid may flow vertically downward through the heat transfer fluid channel 330. In other examples, the orientation of the panel 300 in the three-way heat exchanger 200 may be such that the heat transfer fluid flows in a substantially horizontal flow direction. In yet other examples, the panel 300 may be oriented at an oblique angle in the three-way heat exchanger 200 such that the heat transfer fluid flows in both a vertical and horizontal direction. In the illustrated example, the heat transfer fluid and the liquid desiccant flow in counter-flow relation to one another through the panel assembly 300. In other examples, the heat transfer fluid and the liquid desiccant may flow in the same flow direction through the panel assembly 300.

Figure 10A:
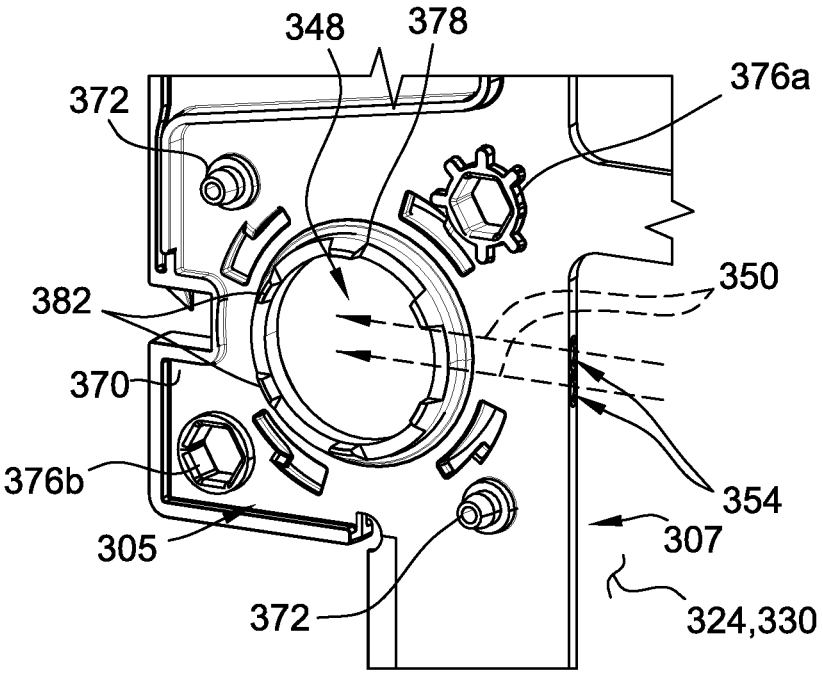
FIGS. 10A-10D are enlarged views of the sections A, B, C, D, respectively, shown in FIG. 8.
Figure 10B:
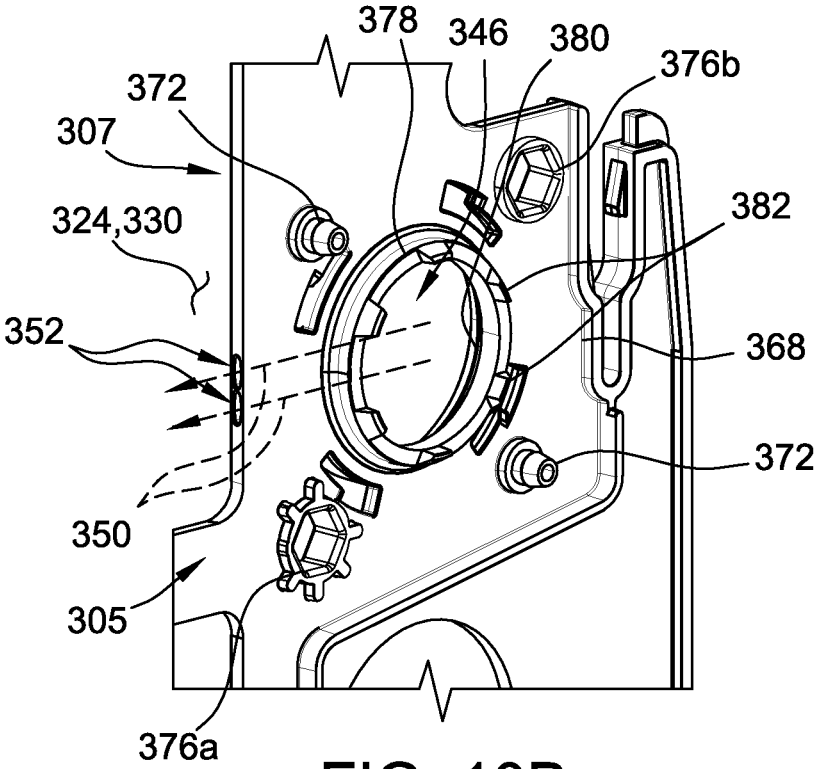

FIGS. 10A-10D are enlarged views of the sections A, B, C, D, respectively, of the frame 302 shown in FIG. 8, and depict the corner flanges 364-370 in greater detail. In particular, FIGS. 10A-10D show microchannels or apertures that provide fluid connection between the ports 340, 342, 346, and 348 and the respective fluid areas defined in the panel assembly 300. As shown in FIGS. 10A and 10B, the heat transfer fluid inlet port 346 is connected to the heat transfer fluid area 324 by apertures 352 (FIG. 10B) and the heat transfer fluid outlet port 348 is connected to the heat transfer fluid area 324 by apertures 354 (FIG. 10A). The heat transfer fluid area 324 defines the heat transfer fluid channel 330 when sealed on the opposite lateral faces 305 and 307 of the frame 302 by the plates 326 and 328. As indicated by the flow lines 350 in FIGS. 10A and 10B, heat transfer fluid enters the heat transfer fluid channel 330 from the inlet port 346 via the apertures 352 and exits the channel 330 into the outlet port 348 via the apertures 354.

Figure 10C:
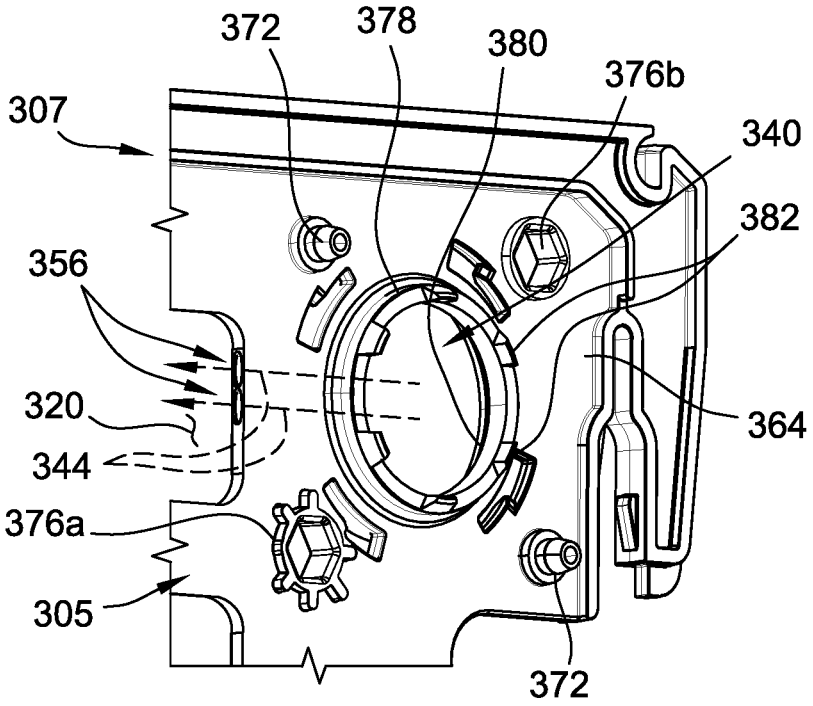
Figure 10D:
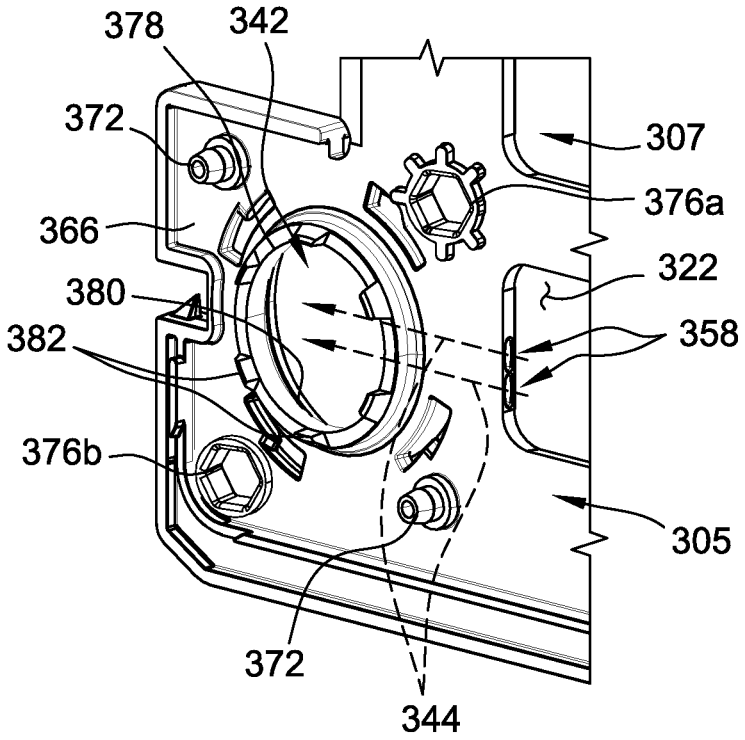

As shown in FIGS. 10C and 10D, the liquid desiccant inlet port 340 is connected to the first liquid desiccant header area 320 by apertures 356 (FIG. 10C) and the liquid desiccant outlet port 342 is connected to the second liquid desiccant header area 322 by apertures 358 (FIG. 10D). As indicated by the flow lines 344 in FIGS. 10C and 10D, liquid desiccant enters the first liquid desiccant header area 320 from the inlet port 340 via the apertures 356, flows into and through the liquid desiccant channels 336 and 338 (FIG. 9), into the second liquid desiccant header area 322, and exits the header area 322 into the outlet port 342 via the apertures 358. In the illustrated example of FIGS. 10A-10D, each of the apertures 352-358 include two apertures. Any suitable number of apertures may be used for the apertures 352-358. In some examples, a greater number of apertures may be used for some of the apertures 352-358 than the other apertures 352-358. The number, size, and/or shape of the apertures 352-358 may be the same or different. The number of apertures, as well as the size and shape, used for each of the apertures 352-358 may also vary between panel assemblies 300.

FIGS. 10A-10D also show the features of the panel assembly 300 that facilitate connecting adjacent panel assemblies 300 together when installed in the three-way heat exchanger 200. In particular, when panel assembles 300 are arranged in series and installed in the heat exchanger 200, the corner flanges 364-370 of the frames 302 of adjacent panel assemblies 300 are connected. As shown, each corner flange 364-370 includes one or more snap fittings 372. The snap fittings 372 extend in the lateral direction from the first lateral face 305 of the frame 302, and a corresponding bore 374 (shown in FIG. 6) depends into the second lateral face 307 at the location laterally opposite the snap fitting 372. Each corner flange 364-370 includes two snap fittings 372 and corresponding bores 374 in the illustrated example. In other examples, more or fewer snap fittings 372 and corresponding bores 374 may be included at the corner flanges 364-370. The corner flanges 364-370 may include the same or a different number of snap fittings 372 and corresponding bores 374. Suitably, a corresponding bore 374 is included for each snap fitting 372 in each corner flange 364-370. When the panel assemblies 300 are arranged in series and installed in the heat exchanger 200, each snap fitting 372 of the corner flanges 364-370 of the frame 302 of one of the panel assemblies 300 is received by one of the corresponding bores 374 of the corner flanges 364-370 of the frame 302 of one of the panel assemblies 300 of a laterally adjacent panel assembly 300 to directly connect adjacent panel assemblies 300.

Each corner flange 364-370 also includes one or more alignment holes 376 extending therethrough in the lateral direction. In the illustrated embodiment, the corner flanges 364-370 each include two alignment holes 376, labeled in FIGS. 10A-D as a first alignment hole 376*a* and a second alignment hole 376*b*. The first alignment holes 376*a* of each corner flange 364-370 are located longitudinally inboard of the second alignment holes 376*b* and adjacent to respective corners of the heat transfer fluid area 324. In other examples, more or fewer alignment holes 376 may be included at the corner flanges 364-370. The corner flanges 364-370 may include the same or a different number of alignment holes 376. When the panel assemblies are arranged in series and installed in the heat exchanger 200, the alignment holes 376 of the corner flanges 364-370 of the frames 302 of the panel assemblies 300 receive a corresponding clamping assembly 400*a* and 400*b* (shown in FIGS. 12-18) used to clamp the panel assemblies 300 together. The clamping assemblies 400*a* and 400*b* will be described in more detail below. The alignment holes 376 have a suitable shape for anti-rotation of the clamping assemblies 400*a* and 400*b* therein. In the illustrated example, the alignment holes 376 and clamping assemblies 400*a* and 400*b* have a complementing hexagonal shape for anti-rotation of the clamping assemblies in the alignment holes. In other examples, the alignment holes 376 and clamping assemblies 400*a* and 400*b* may have any suitable anti-rotation shape, such as other polygonal shapes (e.g., triangle, rectangular, pentagonal, and the like).

The first alignment holes 376*a* of the panel assemblies 300 correspond to one of the alignment apertures 258 of the first end plate 218 and one of the alignment apertures 260 of the second end plate 220 (shown in FIGS. 2 and 4). A clamping assembly 400*a*, also referred to as an exterior clamping assembly 400*a*, is received by a corresponding group of the alignment aperture 258, the alignment holes 376*a*, and the alignment aperture 260. As such, in the illustrated embodiment, four exterior clamping assemblies 400*a* are received by the four corresponding groups of the alignment aperture 258, the alignment holes 376*a*, and the alignment aperture 260, and extend through the end plates 218 and 220 and the panel assemblies 300. In other examples, more or fewer exterior clamping assemblies 400*a* may be received by a suitable number of corresponding groups of the alignment aperture 258, the alignment holes 376*a*, and the alignment aperture 260. The second alignment holes 376*b* receive a corresponding clamping assembly 400*b*, also referred to as an interior clamping assembly 400*b*. The second alignment holes 376*b* do not correspond to alignment apertures 258 and 260 in the end plates 218 and 220, such that the interior clamping assemblies 400*b* received by the second alignment holes 376*b* extend through the panel assemblies 300 but not the end plates 218 and 220. In the illustrated example, four interior clamping assemblies 400*b* are received by the four corresponding groups of second alignment holes 376*b* in the panel assemblies 300. In other examples, more or fewer interior clamping assemblies 400*b* may be received by a suitable number of corresponding groups of the second alignment holes 376*b* of the panel assemblies 300.

Still referring to FIGS. 10A-10D, each of the corner flanges 364-370 includes flange collar 378 circumscribing the respective fluid port 340, 342, 346, 348 defined in the corner flange. The flange collars 378 extend in the lateral direction from the first lateral face 305 of the frame 302. Each corner flange 364-370 also includes a corresponding grooved mouth 380 that depends into the second lateral face 307 and circumscribes the respective fluid port 340, 342, 346, 348 at the location laterally opposite the flange collar 378. When the panel assemblies 300 are arranged in series and installed in the heat exchanger 200, each flange collar 378 of the corner flanges 364-370 of the frame 302 of one of the panel assemblies 300 is received by one of the corresponding grooved mouths 380 of the corner flanges 364-370 of the frame 302 of one of the panel assemblies 300 of a laterally adjacent panel assembly 300 to directly connect adjacent panel assemblies 300. The flange collars 378 each include a set of piloting teeth 382 that facilitate aligning the flange collars 378 with the corresponding grooved mouths 380 and inserting the flange collars 378 therein. The piloting teeth 382 may include a piloting feature (e.g., a chamfer) for easier insertion of the teeth and the flange collar 378 into the corresponding grooved mouth 380. Elastomeric seals 384 (shown in FIGS. 17 and 18), such as an O-ring, may be seated within each of the grooved mouths 380 and to create a fluid-tight seal between the adjacent panel assemblies 300 at the adjacent fluid ports 340, 342, 346, 348 when the flange collars 378 are inserted into the grooved mouths 380.

Figure 6:
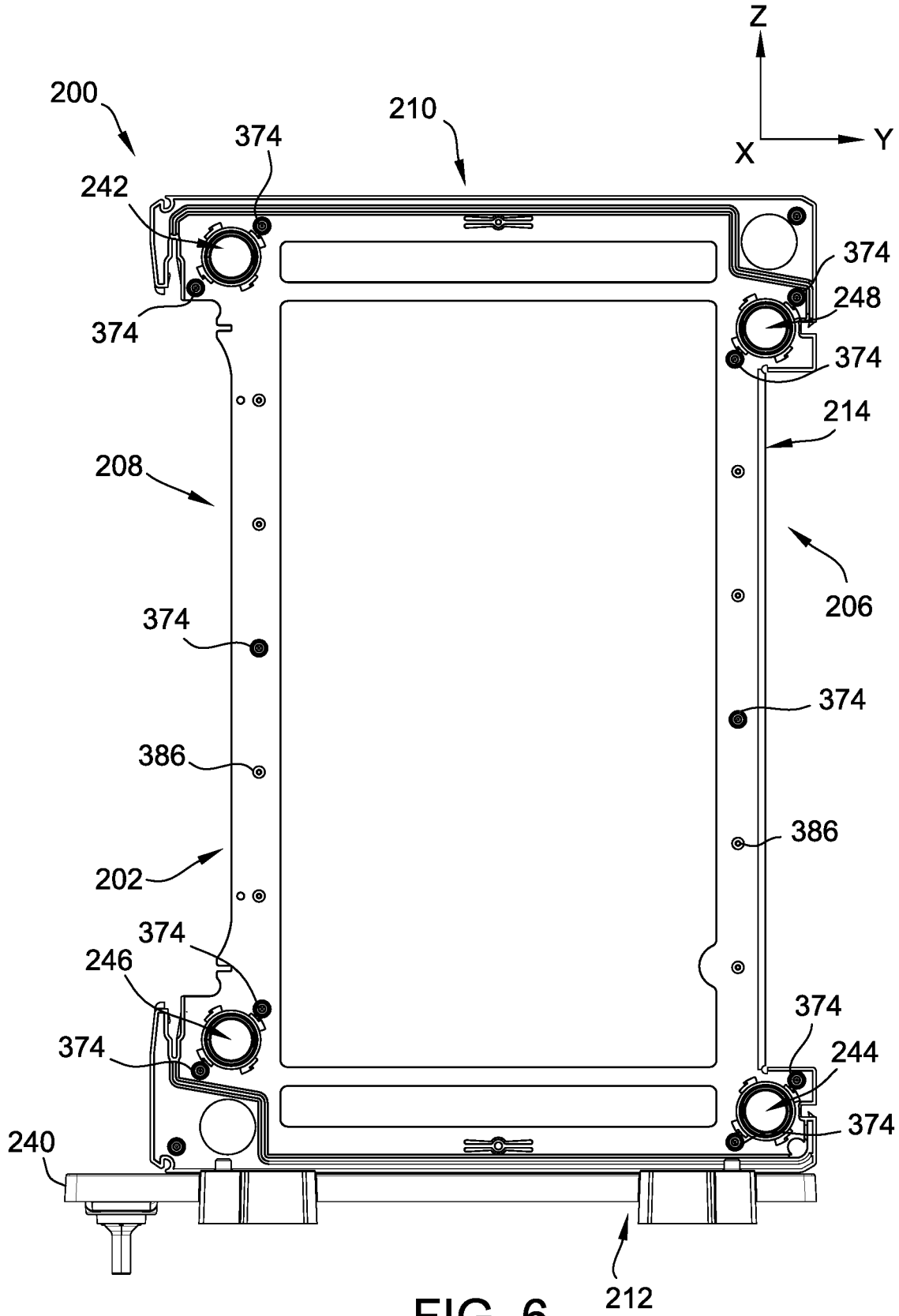
FIG. 6 is a left side elevation of the three-way heat exchanger with various components omitted, similar to FIGS. 3 and 5.

To assemble the panel assemblies 300 in the three-way heat exchanger 200, the corner flanges 364-370 of adjacent panel assemblies 300 are connected by inserting the snap fittings 372 and the collar flanges 378 of one of the panel assemblies 300 into the corresponding bores 374 and corresponding grooved mouths 380 of the adjacent panel assembly 300. Each panel assembly 300 may include additional elements for directly connecting adjacent panel assemblies 300. For example, as shown in FIGS. 6 and 7, the frame 302 of each panel assembly 300 may include snap fittings 372 and corresponding bores 374 in the middle section 316 extending adjacent to the heat transfer fluid area 324, along the opposite longitudinal ends 308 and 310. Additionally and/or alternatively, the frame 302 may include standoffs or spacers 386 extending in the lateral direction from the middle section 316 along the opposite longitudinal ends 308 and 310, on one or both lateral faces 305 and 307 of the frame. The standoffs or spacers 386 may facilitate additional connection between adjacent panel assemblies 300 and/or maintain spacing between adjacent panel assemblies 300 along the middle sections 316 to define the airflow gaps 216 therebetween.

Once all the panel assemblies 300 are connected to at least one adjacent panel assembly 300, four interior clamping assemblies 400*b* may be inserted into the four groups of alignment holes 376*b* to exert a lateral clamping force on the panel assemblies 300. The interior clamping assemblies 400*b* may be inserted into the corresponding groups of alignment holes 376*b* before or after positioning the panel assemblies 300 within the interior 222 of the heat exchanger 200. When the panel assemblies 300 are positioned in the interior of the heat exchanger 200, the end plates 218 and 220 may be installed and four exterior clamping assemblies 400*a* may be inserted into the four groups of the alignment aperture 258, the alignment holes 376*a*, and the alignment aperture 260 to exert a lateral clamping force on the panel assemblies 300 and the end plates 218 and 220.

With additional references to FIGS. 3 and 5, and to FIG. 6 which shows a left elevation of the three-way heat exchanger 200 with various components omitted similar to FIGS. 3 and 5, the panel assemblies 300 are arranged in succession or series in the lateral direction as described above. In FIGS. 3, 5, and 6, the plates 326 and 328 and the membranes 332 and 334 are omitted for convenience of illustration. When assembled and installed in the three-way heat exchanger 200, for each pair of adjacent panel assemblies 300, the membrane 332 of one of the panel assemblies 300 faces the membrane 334 of the other one of the panel assemblies 300. The airflow gaps 216 are defined between the adjacent membranes 332 and 334. Each panel assembly 300 may have a reduced width over the middle section 316, such that the panel assemblies 300 are spaced apart over their adjacent middle sections 316 to define the airflow gaps 216. Additionally and/or alternatively, the airflow gaps 216 may be defined and maintained by the standoffs or spacers 386 between the middle sections 316 of adjacent panel assemblies 300.

The panel assemblies 300 are arranged in the three-way heat exchanger 200 such that, for each panel assembly, the first and second lateral faces 305 and 307 of the frame 302 are respectively oriented toward the first and second lateral sides 202 and 204 of the three-way heat exchanger 200. The first and second longitudinal ends 308 and 310 are respectively located at the first and second longitudinal sides 206 and 208 of the three-way heat exchanger 200, and the first and second vertical ends 304 and 306 are respectively located at the first and second vertical sides 210 and 212 of the three-way heat exchanger 200.

The ports 340, 342, 346, and 348 of the panel assemblies 300 align to define respective manifolds of the three-way heat exchanger 200 extending in the lateral direction through which heat transfer fluid and liquid desiccant flow to and from the panel assemblies 300 between the first and second lateral sides 202 and 204. The liquid desiccant inlet ports 340 of the panel assemblies 300 align to form a liquid desiccant inlet manifold 242 that extends between the first and second lateral sides 202 and 204 proximate to the first vertical side 210 and the second longitudinal side 208 of the three-way heat exchanger 200. The liquid desiccant outlet ports 342 of the panel assemblies 300 align to form a liquid desiccant outlet manifold 244 that extends between the first and second lateral sides 202 and 204 proximate to the second vertical side 212 and the first longitudinal side 206 of the three-way heat exchanger 200. The heat transfer fluid inlet ports 346 of the panel assemblies 300 align to form a heat transfer fluid inlet manifold 246 that extends between the first and second lateral sides 202 and 204 proximate to the second vertical side 212 and the second longitudinal side 208 of the three-way heat exchanger 200. The heat transfer fluid outlet ports 348 of the panel assemblies 300 align to form a heat transfer fluid outlet manifold 248 that extends between the first and second lateral sides 202 and 204 proximate to the first vertical side 210 and the first longitudinal side 206 of the three-way heat exchanger 200.

The panel assemblies 300 may include O-rings or other elastomeric sealing members that form liquid-tight seals between the aligning ports 340, 342, 346, and 348 of the adjacent panel assemblies to prevent fluid from leaking out of the respective manifolds 242-248. For example, as described above, elastomeric seals 384 (shown in FIGS. 17 and 18), such as an O-ring, may be seated within each of the grooved mouths 380 and to create a fluid-tight seal between the adjacent panel assemblies 300 at the adjacent fluid ports 340, 342, 346, 348 when the flange collars 378 are inserted into the grooved mouths 380. In some examples, the elastomeric seals 384 are radial seals (e.g., radial O-ring seals). Radial seals used as the elastomeric seals 384 may provide an additional advantage of allowing some movement of the panel assemblies 300 relative to one another in the vertical or longitudinal directions while maintaining a fluid-tight seal of the manifolds 242-248. Moreover, in each of the corner flanges 364-370, the snap fittings 372, corresponding bores 374, and the alignment holes 376 collectively surround the fluid port 340, 342, 346, 348 defined in the corner flange, which may facilitate creating and maintaining a fluid-tight seal between the adjacent ports 340, 342, 346, 348 that define the manifolds 242-248. As described in further detail below, the clamping assemblies 400*a* and 400*b* may enable some movement of the panel assemblies 300 in the lateral direction (e.g., via thermal expansion or thermal contraction) while maintaining the fluid-tight seals of the manifolds 242-248.

As shown in FIGS. 3 and 5, conduits 250, 252, 254, and 256 are used to fluidly connect the heat transfer fluid inlet 232 and outlet 234 and the liquid desiccant inlet 236 and outlet 238 to a respective manifold for heat transfer fluid and liquid desiccant entering and exiting the three-way heat exchanger 200. The liquid desiccant inlet 236 is fluidly connected to the liquid desiccant inlet manifold 242 by the conduit 250. The liquid desiccant outlet 238 is fluidly connected to the liquid desiccant outlet manifold 244 by the conduit 252. The heat transfer fluid inlet 232 is fluidly connected to the heat transfer fluid inlet manifold 246 by the conduit 254. The heat transfer fluid outlet 234 is fluidly connected to the heat transfer fluid outlet manifold 248 by the conduit 256. The conduits 250-256 may include any suitable fluid conduit (rigid and/or flexible) that enables heat transfer fluid and liquid desiccant to flow between the respective inlet and outlet and manifold, including, for example and without limitation, pipes, hoses, tubes, and combinations thereof. Each conduit 250-256 may be attached to the respective manifold 242-248 by coupling an end of the conduit to an end panel assembly 300 (i.e., the panel assembly 300 immediately adjacent to the lateral side 202 or 204) at the appropriate one of the ports 340, 342, 346, and 348. The conduits 250-256 may be attached to the appropriate port 340, 342, 346, and 348 of an end panel assembly 300 using any suitable means, include fasteners, threads, clamps, and the like.

Each of the manifolds 242-248 may be closed at the lateral side 202 or 204 of the heat exchanger 200 opposite of the inlet or outlet to which the manifold is connected. The liquid desiccant inlet manifold 242 may be closed at the second lateral side 204, the liquid desiccant outlet manifold 244 may be closed at the first lateral side 202 opposite the liquid desiccant inlet manifold 242, the heat transfer fluid inlet manifold 246 may be closed at the first lateral side 202, and the heat transfer fluid outlet manifold 248 may be closed at the second lateral side 204 opposite the heat transfer fluid inlet manifold 246. The manifolds 242-248 may be closed at the respective lateral sides 202 or 204 by the end plate 218 or 220 (shown in FIGS. 2 and 4). In particular, the end plate 218 may plug the ports 342 and 346 of the panel assembly 300 at the end of the panel assemblies 300 that is adjacent to the first lateral side 202 to close the manifolds 244 and 246 at the first lateral side 202. The end plate 220 may plug the ports 340 and 348 of the panel assembly 300 at the end of the panel assemblies 300 that is adjacent to the second lateral side 204 to close the manifolds 244 and 246 at the second lateral side 204. Additionally and/or alternatively, end caps or plugs 272 and 274 (see FIG. 11) may be inserted into or otherwise disposed over the ports 342 and 346, respectively, of the panel assembly 300 adjacent to the first lateral side 202 to close the manifolds 244 and 246 at the first lateral side 202, and end caps or plugs 270 and 276 (see FIG. 11) may be inserted into or otherwise disposed over the ports 340 and 348, respectively, of the panel assembly 300 adjacent to the second lateral side 204 to close the manifolds 244 and 246 at the second lateral side 204.

The conduits 250 and 256 extend between the end plate 218 and the end panel assembly 300 at the first lateral side 202. The conduits 252 and 254 extend between the end plate 220 and the end panel assembly 300 at the second lateral side 204. The conduits 250 and 256 may extend through the end plate 218 to respectively define the inlet 236 or the outlet 234, may be coupled to the respective inlet 236 or outlet 234 that is defined by the end plate 218, or may be made integral with the end plate 218 and the respective inlet 236 or outlet 234 defined by the end plate 218. The conduits 252 and 254 may extend through the end plate 220 to respectively define the outlet 238 or the inlet 232, may be coupled to the respective outlet 238 or inlet 232 that is defined by the end plate 220, or may be made integral with the end plate 220 and the respective outlet 238 or inlet 232 defined by the end plate 220.

Figure 11:
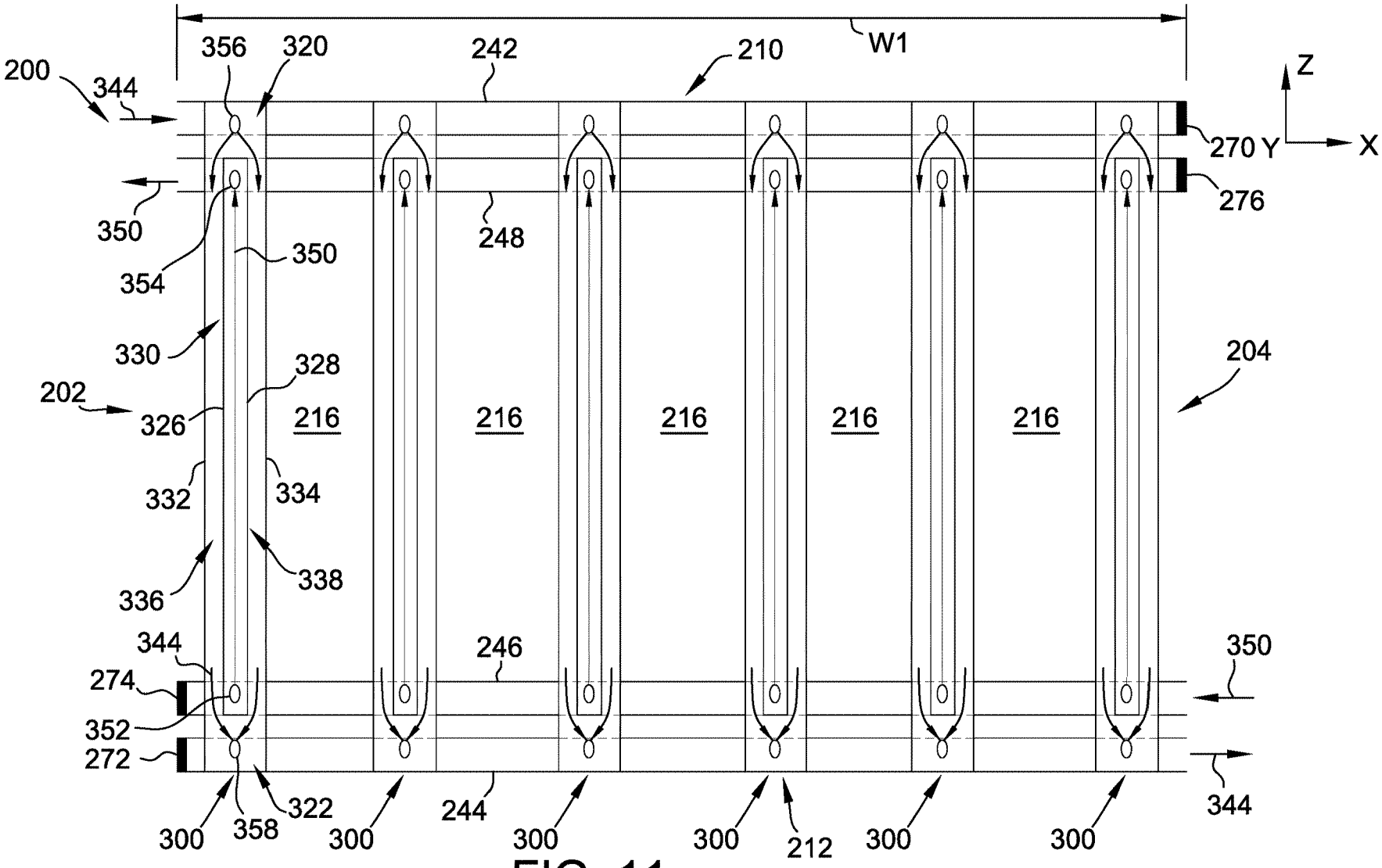
FIG. 11 is a schematic showing flow of liquid desiccant and heat transfer fluid through the three-way heat exchanger of FIGS. 2-6.

Referring now to FIG. 11, operation of the three-way heat exchanger 200 will now be described. FIG. 11 is a schematic showing an interior view of the three-way heat exchanger 200 to depict flow of liquid desiccant and the heat transfer fluid through the manifolds 242-248 and the panel assemblies 300. In the schematic of FIG. 11, panel assemblies 300 are depicted with features exaggerated and/or simplified for convenience of illustration and description.

In operation of the heat exchanger 200, an inlet air stream (e.g., the first or second inlet air stream 110 or 114 shown in FIG. 1) enters via the airflow inlet 224 and flows through the air gaps 216 defined between adjacent panel assemblies 300 in the longitudinal direction. The air flowing through the air gaps 216 is treated by liquid desiccant, indicated by the flow lines 344, and heat transfer fluid, indicated by the flow lines 350, that are channeled through each of the panel assemblies 300. In some operations, the liquid desiccant 344 is concentrated liquid desiccant 152 from the liquid desiccant circuit 108 and the heat transfer fluid 350 is conditioner heat transfer fluid from the conditioner sub-system 104 shown in FIG. 1, and the heat exchanger 200 is used to cool and dehumidify the air flowing through the air gaps 216. In other operations, the liquid desiccant 344 is diluted liquid desiccant 154 from the liquid desiccant circuit 108 and the heat transfer fluid 350 is regenerator heat transfer fluid from the regenerator sub-system 106 shown in FIG. 1, and the heat exchanger 200 is used to heat and reject moisture into the air flowing through the air gaps 216.

The liquid desiccant 344 flows into the liquid desiccant inlet manifold 242 from the first lateral side 202, via the liquid desiccant inlet 236 and the conduit 250 (shown in FIGS. 3-5). The liquid desiccant 344 enters into the liquid desiccant header area 320 of each panel assembly 300 from the liquid desiccant inlet manifold 242 via the apertures 356. In each panel assembly 300, the liquid desiccant 344 flows from the liquid desiccant header area 320, into the liquid desiccant channels 336 and 338 via the apertures 360 on each plate 326 and 328 (shown in FIGS. 7 and 8), downward through the liquid desiccant channels 336 and 338, and into the liquid desiccant header area 322 via the apertures 362 on each plate 326 and 328 (shown in FIGS. 7 and 8). As the liquid desiccant 344 flows behind the membranes 332 and 334 of the panel assemblies 300, the liquid desiccant 344 absorbs moisture from or desorbs moisture into the air flowing through the air gaps 216 adjacent to the membranes 332 and 334. Moisture is permitted to permeate through each of the membranes 332 and 334 to enable the moisture to transfer between the liquid desiccant 344 and air in the air gaps 216. The liquid desiccant 344, having absorbed or desorbed moisture, exits each panel assembly 300 from the respective liquid desiccant header area 322 via the apertures 358, and flows through the liquid desiccant outlet manifold 244 toward the second lateral side 204. The liquid desiccant 344 exits the heat exchanger 200 via the conduit 252 and the liquid desiccant outlet 238 (shown in FIG. 5).

The heat transfer fluid 350 flows into the heat transfer fluid inlet manifold 246 from the second lateral side 204, via the heat transfer fluid inlet 232 and the conduit 254 (shown in FIGS. 4 and 5). The heat transfer fluid 350 enters into each panel assembly 300 from the heat transfer fluid inlet manifold 246 via the apertures 352. In each panel assembly 300, the heat transfer fluid 350 flows upward through the heat transfer fluid channel 330. The heat transfer fluid 350 flowing through the channel 330 is in thermal communication with the liquid desiccant 344 flowing through the liquid desiccant channels 336 and 338. Heat is transferred between the heat transfer fluid 350 and the liquid desiccant 344 to remove heat from or reject heat into the air flowing through the air gaps 216, depending on the operating mode of the heat exchanger 200. The heat transfer fluid 350, having absorbed or rejected heat, exits each panel assembly 300 via the apertures 354, and flows through the heat transfer fluid outlet manifold 248 toward the first lateral side 202. The heat transfer fluid 350 exits the heat exchanger 200 via the conduit 256 and the heat transfer fluid outlet 234 (shown in FIGS. 3-5).

The direction of flow of the heat transfer fluid 350 and the liquid desiccant 344 in the illustrated embodiment is by way of example only, and may change in other embodiments of the heat exchanger 200. For example, the liquid desiccant 344 may flow upward through the desiccant channels 336 and 338 on the panel assemblies 300. In these examples, the direction of flow of the liquid desiccant 344 through the liquid desiccant inlet 236 and outlet 238 and the liquid desiccant inlet and outlet manifolds 242 and 244 would also be reversed. The heat transfer fluid 350 may flow downward through the heat transfer channels 330 of the panel assemblies 300. In these examples, the direction of flow of the heat transfer fluid 350 through the heat transfer fluid inlet and outlets 232 and 234 and the heat transfer fluid inlet and outlet manifolds 246 and 248 would also be reversed. The liquid desiccant 344 and the heat transfer fluid 350 flow in counter-flow relation in the illustrated example, but may flow in the same direction through the panel assemblies in alternative examples.

Still referring to FIG. 11, during operation of the three-way heat exchanger 200, the panel assemblies 300 may experience a wide range of temperature changes depending on the operational environment of the three-way heat exchanger. As described above, the heat exchanger 200 may be implemented in the HVAC system 100 (FIG. 1), which may be operable in both a warm weather operating mode and a cold weather operating mode. As such, the panel assemblies 300 may experience temperatures across a range of, for example, −30° C. to 60° C. in operation. Over this temperature range, the panel assemblies 300 may increase in width at higher temperatures (e.g., between 20° C. to 60° C.) and reduce in width at lower temperatures (e.g., between −30° C. to 20° C.). In particular, as described above, the panel assemblies 300 may include materials, such as the thermoplastic or polymeric materials included in the frame 302 and the plates 326 and 328, that expand at higher temperatures and contract at lower temperatures. As such, during operation of the heat exchanger 200, the total width $W_1$ of the panel assemblies 300, measured in the X-axis direction, may increase or decrease, depending on the temperature of the operating environment.

Size variations of the panel assemblies, and in particularly a change in the total width $W_1$ of the panel assemblies 300, may negatively impact performance of the heat exchanger 200. For example, as the total width $W_1$ of the panel assemblies 300 decreases, the seals between the adjacent ports 340, 342, 346, 348 that define the manifolds 242-248 may weaken (e.g., as the elastomeric seals 384 become loose), and heat transfer fluid and/or liquid desiccant may leak from the manifolds 242-248 as a result. Leakage of heat transfer fluid and/or liquid desiccant limits the flow rate through the panel assemblies 300, which degrades performance of the heat exchanger 200, and may allow the heat transfer fluid and/or liquid desiccant to become entrained in the treated air stream and enter into the conditioned air space. As the total width $W_1$ of the panel assemblies 300 increases, the expanded panel assemblies 300 may experience stresses at connection points (e.g., adjacent the alignment holes 376 that receive the clamping assemblies 400*a* and 400*b*) if the increase in width is not accommodated for, resulting in undesired deformation of the panel assemblies 300.

Referring now to FIGS. 12-18, the clamping assemblies 400*a* and 400*b* that are received by the alignment holes 376 are operable to exert a clamping force on the panel assemblies 300 and accommodate size variations of the panel assemblies 300. In particular, the clamping assemblies 400*a* and 400*b* are operable to allow the total width $W_1$ of the panel assemblies 300 to increase or reduce in size, due to materials (e.g., thermoplastic or polymeric materials) included in the panel assemblies 300 expanding and contracting at different temperatures (e.g., temperatures within a range of from −30° C. to 60° C.). The clamping assemblies 400*a* and 400*b* accommodate the size variations of the panel assemblies 300 at the different temperatures while maintaining a suitable clamping force on the panel assemblies 300 to prevent leakage of the heat transfer fluid and/or liquid desiccant from the manifolds 242-248 and without causing deformation of the panel assemblies 300.

Figure 12:
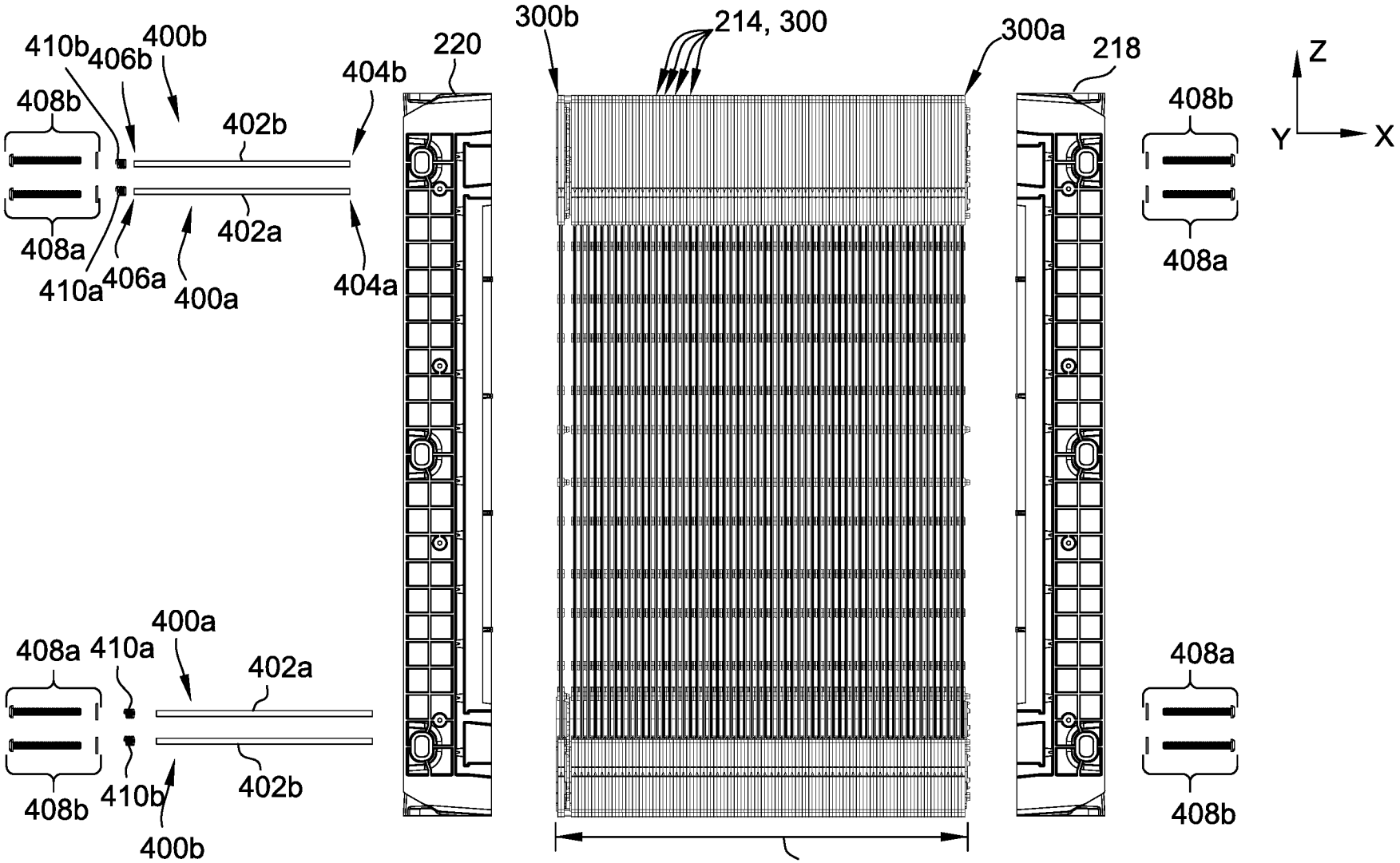
FIG. 12 is a rear elevation of the panel assemblies and end plates of the three-way heat exchanger of FIGS. 2-6, shown in a partially exploded arrangement with clamping assemblies used to exert a clamping force on the panel assemblies.

FIG. 12 is a rear elevation of the panel assemblies 300 and the end plates 218, 220 of the three-way heat exchanger 200, shown in a partially exploded arrangement with some of the exterior clamping assemblies 400*a* and some of the interior clamping assemblies 400*b*. In the example heat exchanger 200, four interior clamping assemblies 400*b* are included and are inserted into the four corresponding groups of alignment holes 376*b* (FIGS. 10A-10D) of the panel assemblies 300, and four exterior clamping assemblies 400*a* are included and are inserted into the four groups of the alignment aperture 258 of the first end plate 218 (FIG. 2), the alignment aperture 260 of the second end plate 220 (FIG. 4), and the alignment holes 376*a* of the panel assemblies 300 (FIGS. 10A-10D). Only two of the four exterior clamping assemblies 400*a* and two of the four interior clamping assemblies 400*b* are shown in FIG. 12. In other examples, any suitable number of the exterior clamping assemblies 400*a* and the interior clamping assemblies 400*b* may be included.

Each exterior clamping assembly 400*a* includes a tie rod 402*a* that extends through a corresponding group of the alignment holes 376*a* of the panel assemblies 300. The tie rod 402*a* has a first end 404*a* and a second end 406*a*. When the tie rod 402*a* is inserted into the corresponding group of the alignment holes 376*a*, the tie rod 402*a* may extend through the apertures 258 and 260 of the end plates 218, 220 such that the first end 404*a* is located at the alignment aperture 258 and the second end 406*a* is located at the alignment aperture 260. Alternatively, when the tie rod 402*a* is inserted into the corresponding group of the alignment holes 376*a*, the tie rod 402*a* may terminate in length prior to the end plates 218, 220 such that the first end 404*a* is located at the alignment hole 376*a* of the panel assembly 300 positioned adjacent to the first end plate 218 (indicated as a first panel assembly 300*a* in FIG. 12) and the second end 406*a* is located at the alignment hole 376*a* of the panel assembly 300 positioned adjacent to the second end plate 220 (indicated as a last panel assembly 300*b* in FIG. 12).

Each interior clamping assembly 400*b* includes a tie rod 402*b* that extends through a corresponding group of the alignment holes 376*b* of the panel assemblies 300. The tie rod 402*b* has a first end 404*b* and a second end 406*b*. When the tie rod 402*b* is inserted into the corresponding group of the alignment holes 376*b*, the first end 404*b* is located at the alignment hole 376*b* of the first panel assembly 300*a* and the second end 406*b* is located at the alignment hole 376*b* of the last panel assembly 300*b*.

The tie rod 402*b* may have a smaller length, measured between the ends 404*b* and 406*b*, than a length of the tie rod 402*a* measured between the ends 404*a* and 406*a*, such that the tie rod 402*b* does not extend to the end plates 218 and 220 when positioned in the corresponding group of alignment holes 376*b*. The tie rods 402*a* and 402*b* may be similarly dimensioned in aspects (e.g., outer diameter, shape, etc.) other than length. In some examples, the tie rods 402*a* and 402*b* have the same length.

Each tie rod 402*a* and 402*b* has an outer cross-sectional shape that complements the shape of the alignment holes 376*a* and 376*b*, respectively, to facilitate anti-rotation of the tie rods 402*a* and 402*b* when positioned in the alignment holes 376*a* and 376*b*. In the illustrated example, the alignment holes 376*a* and 376*b* and the tie rods 402*a* and 402*b* have complementing hexagonal shapes for anti-rotation of the tie rods in the alignment holes. In other examples, the alignment holes 376*a* and 376*b* and tie rods 402*a* and 402*b* may have any suitable anti-rotation shape, such as other polygonal shapes (e.g., triangle, rectangular, pentagonal, and the like).

Each exterior clamping assembly 400*a* also includes retainers 408*a* that are connected to each one of the ends 404*a* and 406*a* of the tie rod 402*a*. In the example clamping assembly 400*a*, each retainer 408*a* includes a threaded fastener 412*a* (e.g., a bolt or a screw) that is connected to a threaded opening defined at the end 404*a* or 406*a* of the tie rod 402*a* and a first washer 414*a* positioned between a head of the fastener 412*a* and the end 404*a* or 406*a* of the tie rod 402*a*. The retainers 408*a* fix the tie rod 402*a* within the corresponding group of the alignment aperture 258, the alignment holes 376*a*, and the alignment aperture 260. The retainers 408*a* also operate to exert a clamping force in the lateral direction on the end plates 218, 220 and the panel assemblies 300.

Each interior clamping assembly 400*b* also includes retainers 408*b* that are connected to each one of the ends 404*b* and 406*b* of the tie rod 402*b*. In the example clamping assembly 400*b*, like the retainers 408*a*, each retainer 408*b* includes a threaded fastener 412*b* (e.g., a bolt or a screw) that is connected to a threaded opening defined at the end 404*b* or 406*b* of the tie rod 402*b* and a first washer 414*b* positioned between a head of the fastener 412*b* and the end 404*b* or 406*b* of the tie rod 402*b*. The retainers 408*b* fix the tie rod 402*b* within the corresponding group of the alignment holes 376*b*. The retainers 408*b* also operate to exert a clamping force in the lateral direction on the panel assemblies 300.

The clamping assemblies 400*a*, 400*b* each include a resilient element 410*a*, 410*b* that facilitates accommodating size variations (e.g., changes in the total width $W_1$) of the panel assemblies 300 at different temperatures while maintaining the clamping force exerted on the panel assemblies 300. Each resilient element 410*a*, 410*b* suitably expands and compresses depending on the nature of an external force acting on the resilient element 410*a*, 410*b*. Each resilient element 410*a*, 410*b* is a bias spring in the example clamping assemblies 400*a*, 400*b*. The resilient elements 410*a*, 410*b* may also be referred to as springs 410*a*, 410*b*. The springs 410*a*, 410*b* may be coil springs or other suitable types of bias springs (e.g., disc springs, such as Belleville springs or wave washers) that enable the clamping assemblies 400*a*, 400*b* to function as described.

In the illustrated example, the clamping assemblies 400*a*, 400*b* each include one spring 410*a*, 410*b*, and each spring 410*a*, 410*b* is positioned at the second end 406*a*, 406*b* of the respective tie rod 402*a*, 402*b*. In other examples, one or more of the clamping assemblies 400*a* and/or one or more of the clamping assemblies 400*b* may include two springs 410*a*, 410*b*, one located at each end of the tie rod 402*a*, 402*b*. In yet other examples, the clamping assemblies 400*a* and/or 400*b* may include the single spring 410*a*, 410*b* located at the first end 404*a*, 404*b* of the respective tie rod 402*a*, 402*b*.

In the interior clamping assemblies 400*b*, the springs 410*b* are each located between the retainer 408*b* connected to the second end 406*b* of the tie rod 402*b* and the last panel assembly 300*b*. Two springs 410*b* may be included in the interior clamping assemblies 400*b*, one located between the retainer 408*b* connected to the second end 406*b* of the tie rod 402*b* and the last panel assembly 300*b* and one located between the retainer 408*b* connected to the first end 404*b* of the tie rod 402*b* and the first panel assembly 300*a*. A single spring 410*b* may alternatively be included in interior clamping assemblies 400*b* and located between the retainer 408*b* connected to the first end 404*b* of the tie rod 402*b* and the first panel assembly 300*a*.

In the exterior clamping assemblies 400*a*, the springs 410*a* are each located between the retainer 408*a* connected to the second end 406*a* of the tie rod 402*a* and the second end plate 220. Two springs 410*a* may be included in the exterior clamping assemblies 400*a*, one located between the retainer 408*a* connected to the second end 406*a* of the tie rod 402*a* and the second end plate 220 and one located between the retainer 408*a* connected to the first end 404*a* of the tie rod 402*a* and the first end plate 218. A single spring 410*a* may alternatively be included in exterior clamping assemblies 400*a* and located between the retainer 408*a* connected to the first end 404*a* of the tie rod 402*a* and the first end plate 218.

Figure 13:
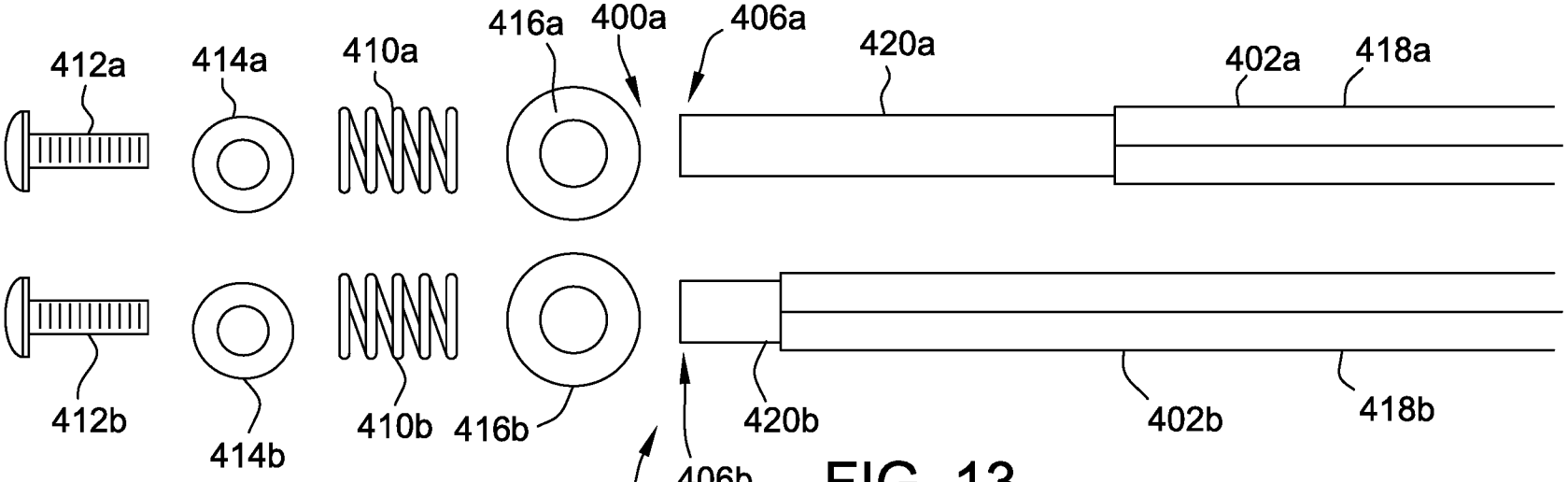
FIG. 13 is an enlarged, partial view of a first example of the clamping assemblies of FIG. 12, shown disassembled.
Figure 14:
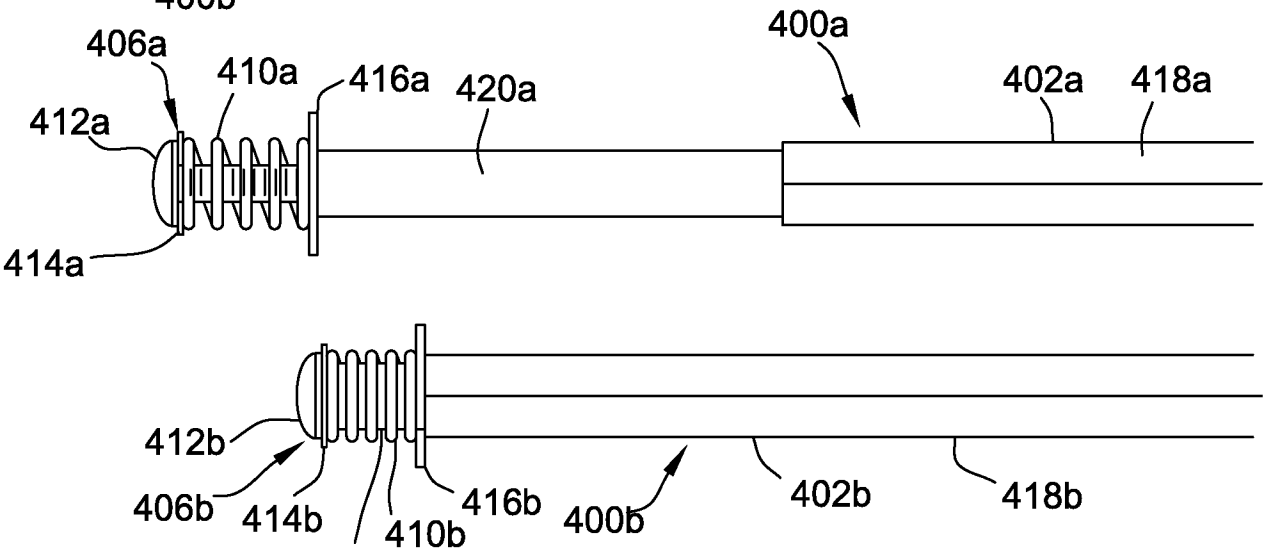
FIG. 14 is an enlarged, partial view of the first example clamping assemblies of FIG. 13, shown assembled.

FIGS. 13 and 14 are enlarged, partial views of the clamping assemblies 400*a* and 400*b*, shown disassembled in FIG. 13 and assembled in FIG. 14, and depict a first example of the springs 410*a* and 410*b* retained on the clamping assemblies 400*a* and 400*b* at the second ends 406*a* and 406*b* of the tie rods 402*a* and 402*b*. In this example, the clamping assemblies 400*a* and 400*b* include the tie rods 402*a* and 402*b* that respectively include anti-rotation segments 418*a* and 418*b* and extension segments 420*a* and 420*b*. The anti-rotation segments 418*a* and 418*b* terminate in length prior to the second ends 406*a* and 406*b* of the tie rods 402*a* and 402*b*. The anti-rotation segments 418*a* and 418*b* are the portion of the tie rods 402*a* and 402*b* that respectively extend through the alignment holes 376*a* and 376*b* of the panel assemblies 300. The anti-rotation segments 418*a* and 418*b* have the anti-rotation shape (e.g., hexagonal or another polygonal shape) that complements the shape of the alignment holes 376*a* and 376*b*. The extension segments 420*a* and 420*b* extend from the anti-rotation segments 418*a* and 418*b* to the second ends 406*a* and 406*b* of the tie rods 402*a* and 402*b*. The extension segments 420*a* and 420*b* are cylindrical in shape.

The tie rods 402*a* and 402*b* have coextensive anti-rotation segments 418*a* and 418*a* (as shown in FIG. 14), relative to the second ends 406*a* and 406*b* of the tie rods. When the tie rods 402*a* and 402*b* are respectively inserted into the alignment holes 376*a* and 376*b*, the anti-rotation segments 418*a* and 418*b* each terminate at alignment holes of the last panel assembly 300*b*. The extension segments 420*a* and 420*b* of the tie rods 402*a* and 402*b* are different in length. In particular, the extension segment 420*a* of the tie rod 402*a* is longer in length than the extension segment 420*b* of the tie rod 402*b*, such that the extension segment 420*a* extends through the alignment aperture 260 of the second end plate 220 and the extension segment 420*b* terminates prior to the second end plate.

In the example shown in FIGS. 13 and 14, the springs 410*a* and 410*b* (e.g., coil springs) are retained on the extension segments 420*a* and 420*b* of the tie rods 402*a* and 402*b*. The cylindrical shape of the extension segments 420*a* and 420*b* enable the springs 410*a* and 410*b* to be retained thereon without impeding the compression and expansion of the springs in response to an external force. Each spring 410*a* and 410*b* abuts the first washer 414*a* and 414*b* at one end. The first washers 414*a* and 414*b* are sandwiched between the spring 410*a* and 410*b* and the fastener 412*a* and 412*b*. The fasteners 412*a* and 412*b* are mushroom-head bolts in this example. Each spring 410*a* and 410*b* abuts a second washer 416*a* and 416*b* at an opposite end. Each of the first washers 414*a* and 414*b* and second washers 416*a* and 416*b* are flat disc washers in the illustrated example. Any suitable type of washer may be used as the first washers 414*a* and 414*b* and/or the second washers 416*a* and 416*b* in other examples. Each second washer 416*a* is sandwiched between the spring 410*a* and the second end plate 220. Each second washer 416*b* is sandwiched between the spring 410*b* and the last panel assembly 300*b*. The second washers 416*a* and 416*b* enable the springs 410*a* and 410*b* to exert a clamping force on the second end plate 220 and the last panel assembly 300*b*, respectively. The second washers 416*a* and 416*b* also exert a compression force, opposite the clamping force, on the springs 410*a* and 410*b*, respectively.

Figure 15:
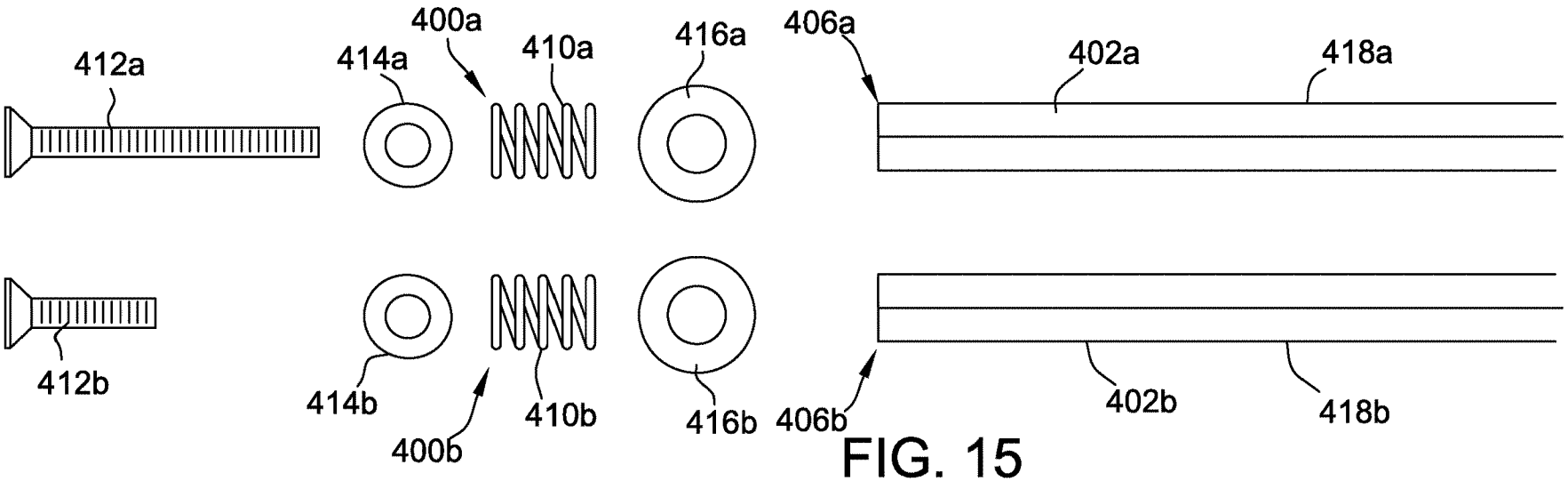
FIG. 15 is an enlarged, partial view of a second example of the clamping assemblies of FIG. 12, shown disassembled.
Figure 16:
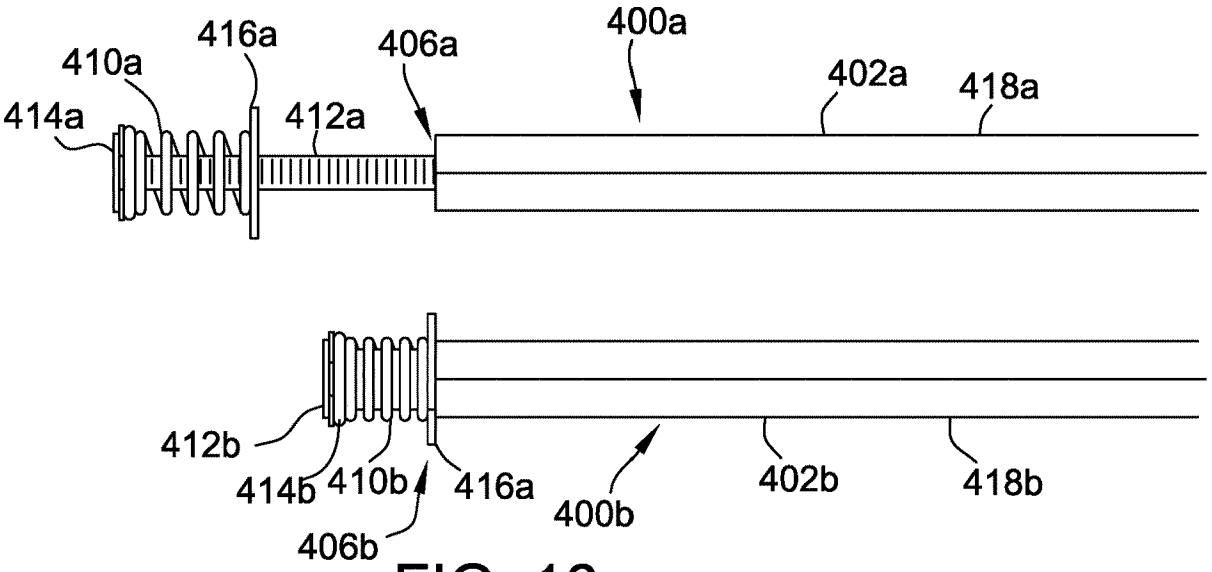
FIG. 16 is an enlarged, partial view of the second example clamping assemblies of FIG. 15, shown assembled.

FIGS. 15 and 16 are enlarged, partial views of the clamping assemblies 400*a* and 400*b*, shown disassembled in FIG. 15 and assembled in FIG. 16, and depict a second example embodiment of the springs 410*a* and 410*b* retained on the clamping assemblies 400*a* and 400*b* at the second ends 406*a* and 406*b* of the tie rods 402*a* and 402*b*. In this example, the tie rods 402*a* and 402*b* respectively include the anti-rotation segments 418*a* and 418*b*, and do not include the extension segments 420*a* and 420*b* shown in FIGS. 13 and 14 at the second ends 406*a* and 406*b*. The anti-rotation segments 418*a* and 418*b* terminate in length at the second ends 406*a* and 406*b* of the tie rods 402*a* and 402*b*, and define coextensive second ends of the tie rods. When the tie rods 402*a* and 402*b* are respectively inserted into the alignment holes 376*a* and 376*b*, the anti-rotation segments 418*a* and 418*b* and the second ends 406*a* and 406*b* each terminate at the alignment holes of the last panel assembly 300*b*.

In the example shown in FIGS. 15 and 16, the springs 410*a* and 410*b* (e.g., coil springs) surround the tails of the threaded fasteners 412*a* and 412*b*. The fastener 412*a* has a longer tail than the threaded fastener 412*b*, such that the tail of the fastener 412*a* extends through the alignment aperture 360 of the second end plate 220 to the second end 404*a* of the tie rod 402*a*. The springs 410*a* and 410*b* are centered and retained by the first washers 414*a* and 414*b*, which are countersunk washers in this example. The springs 410*a* and 410*b*, and the second washers 416*a* and 416*b* abutting the springs opposite the countersunk washers, are sized (e.g., have a suitable inner diameter) to be moveable along the tails of the fasteners 412*a* and 412*b*. The second washers 416*a* and 416*b* are flat disc washers in the illustrated example. Any suitable type of washer may be used as the second washers 416*a* and 416*b* in other examples.

The other end of the clamping assemblies 400*a* and 400*b*, proximate the first panel assembly 300*a* and the first end plate 218, may be similarly configured as the ends of the clamping assemblies 400*a* and 400*b* proximate the last panel assembly 300*b* and the last end plate 218 as shown in the first embodiment of FIGS. 13 and 14 and/or as shown in the second embodiment of FIGS. 13 and 14. In some examples, the anti-rotation segments 418*a* and 418*b* of the tie rods 402*a* and 402*b* may terminate at the alignment holes 376*a* and 378*b* of the first panel assembly 300*a*. The tie rods 402*a* and 402*b* may include the extension segments 418*a* and 418*b* at the first ends 404*a* and 404*b*, as shown in FIGS. 13 and 14 for the second ends 406*a* and 406*b*. Alternatively, the first ends 404*a* and 404*b* may terminate at the alignment holes 376*a* and 376*b* of the first panel assembly 300*a* and the tails of the threaded fasteners 412*a* and 412*b* connected to the first ends of the tie rods have different lengths as shown in FIGS. 15 and 16. In some examples, the anti-rotation segments 418*a* and 418*b* may respectively extend to and terminate at the alignment aperture 258 of the first end plate 218 and the alignment hole 376*b* of the first panel assembly 300*a*.

Figure 17:
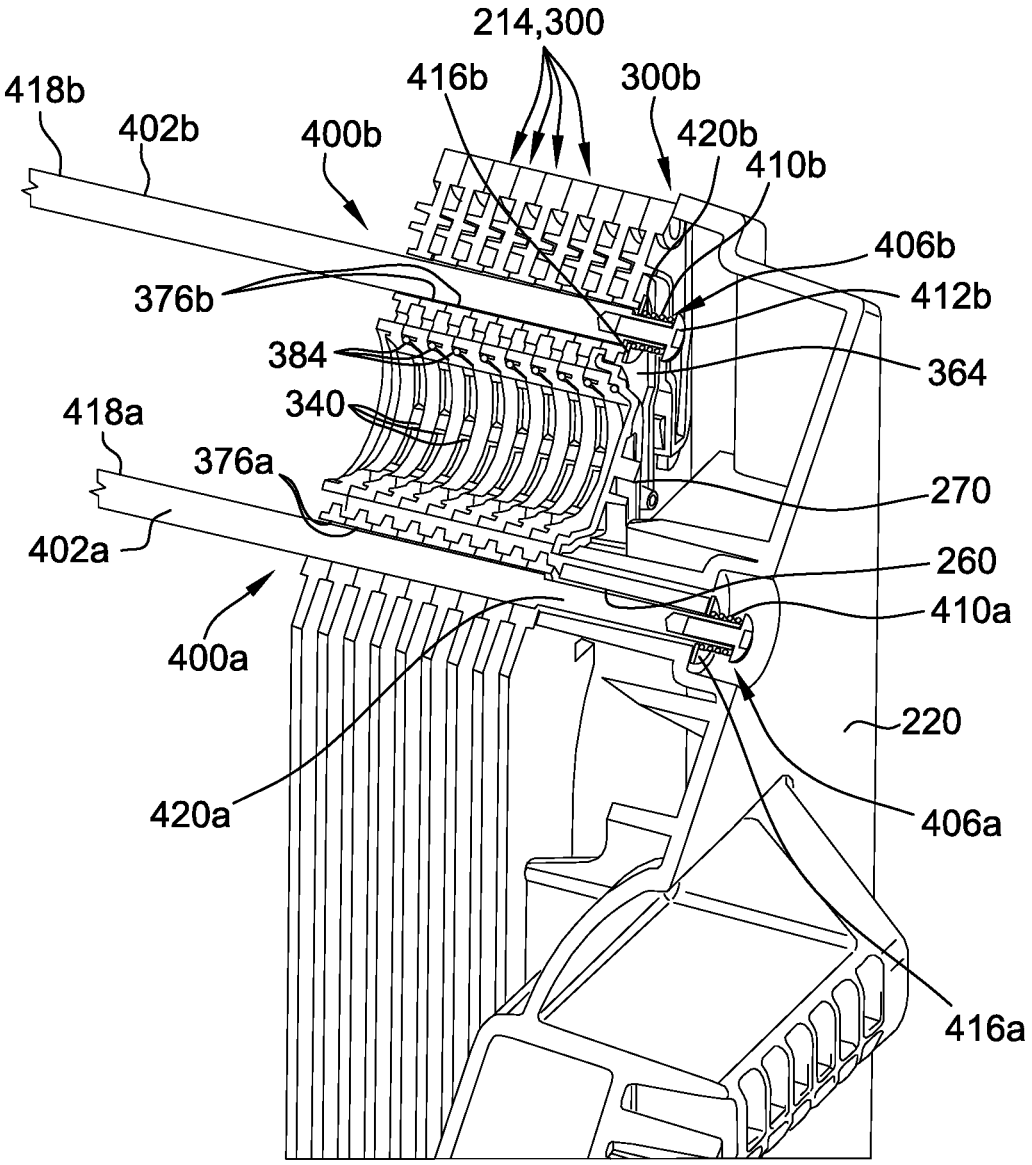
FIG. 17 is a partial section of the three-way heat exchanger of FIGS. 2-6, showing a portion of the first example clamping assemblies of FIGS. 13 and 14 installed the panel assemblies.
Figure 18:
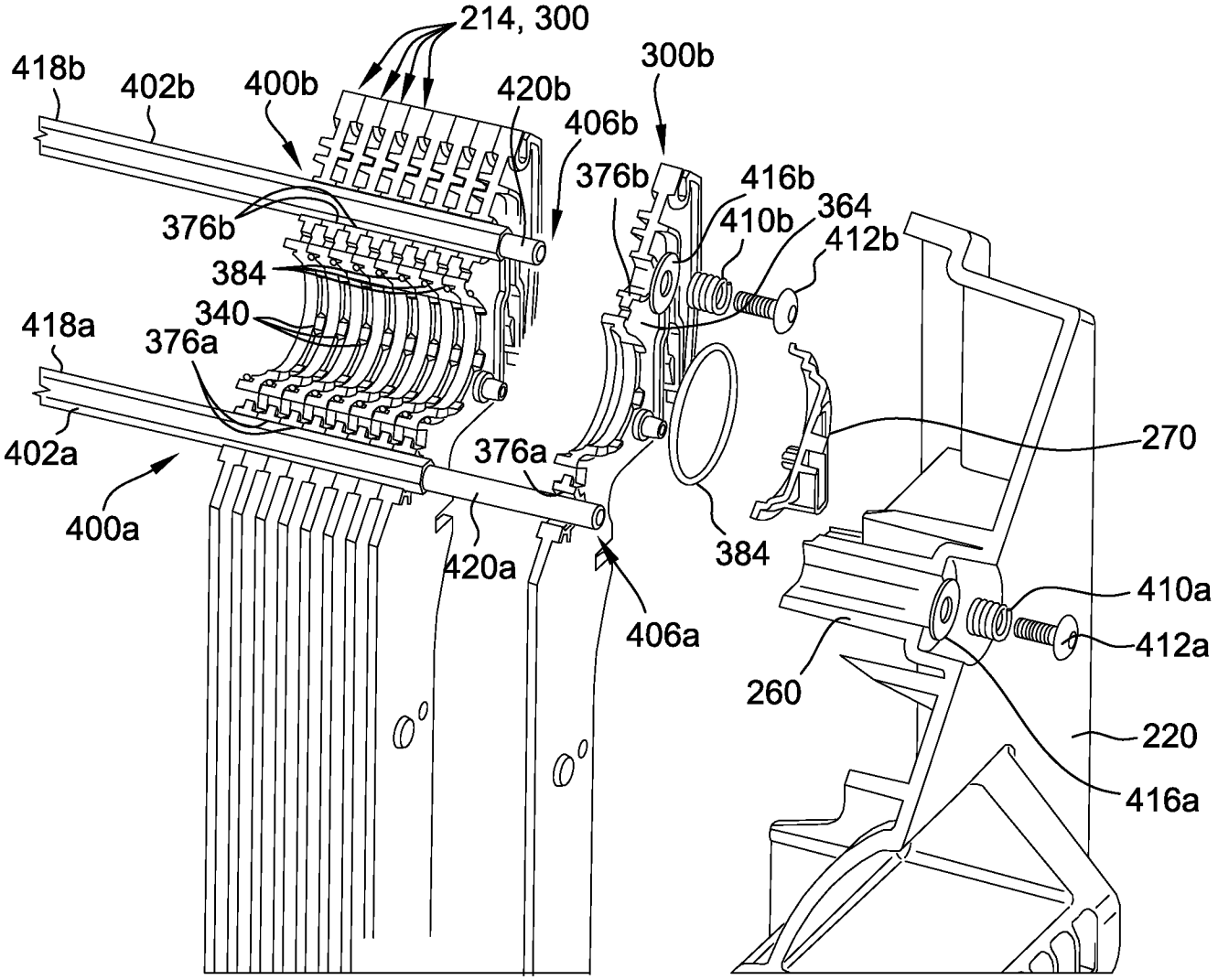
FIG. 18 is a partially exploded view of the section shown in FIG. 17.

With reference to FIGS. 17 and 18, assembly of the clamping assemblies 400*a* and 400*b* will now be described. FIG. 17 is a partial section of the three-way heat exchanger 200, depicting the portion of the clamping assemblies 400*a* and 400*b* shown in FIGS. 13 and 14 respectively installed in the alignment holes 376*a* and the alignment holes 376*b* defined in the first corner flange 364 of the panel assemblies 300 (see FIG. 10C). FIG. 18 is a partially exploded view of the section shown in FIG. 17. The clamping assemblies 400*a* and 400*b* respectively installed in the alignment holes 376*a* and the alignment holes 376*b* defined in the second corner flange 366 (FIG. 10D), the third corner flange 368 (FIG. 10B), and the fourth corner flange 370 (FIG. 10A) of the panel assemblies 300 are similarly installed and operated as shown and described with reference to FIGS. 17 and 18.

As shown in FIGS. 17 and 18, the tie rod 402*a* of the exterior clamping assembly 400*a* is inserted into the alignment holes 376*a* of the panel assemblies 300 and the tie rod 402*b* of the interior clamping assembly 400*b* is inserted into the alignment holes 376*b* of the panel assemblies. The anti-rotation segments 418*a* and 418*b* are rotationally fixed within the alignment holes 376*a* and 376*b* by the complementing anti-rotation shape. This enables the retainers 408*a* and 408*b* to be more easily connected at the ends 404*a*, 406*a* and 404*b*, 406*b* of the tie rods 402*a* and 402*b*. In particular, the complementing anti-rotation shape of the anti-rotation segments 418*a* and 418*b* and the alignment holes 376*a* and 376*b* facilitates preventing rotation of the tie rods 402*a* and 402*b* when the threaded fasteners 412*a* and 412*b* are connected to the ends 404*a*, 406*a* and 404*b*, 406*b* of the tie rods.

With the tie rods 402*a* and 402*b* inserted into the respective alignment holes 376*a* and 376*b* of the panel assemblies 300, the tie rod 402*b* of the interior clamping assembly 400*b* is fixed within the alignment holes 376*b* by connecting the retainers 408*b* at the first end 404*b* and the second end 406*b* of the tie rod 402*b*. A spring 410*b* is installed at the second end 406*b* of the tie rod 402*b* between the retainer 408*b* and the last panel assembly 300*b*. The spring 410*b* may be retained between first and second washers 414*b*, 416*b* on an extension segment 420*b* that extends laterally outward from the alignment hole 376*b* of the last panel assembly 300*b*. Alternatively, the first and second washers 414*b*, 416*b* and the spring 410*b* may be arranged on a tail of the threaded fastener 412*b*, with the spring 410*b* positioned between the washers and retained by one of the washers (e.g., a countersunk washer as shown in FIGS. 15 and 16). The first washer 414*b* abuts the head of the fastener 412*b* and the spring 410*b*. The second washer 416*b* abuts the last panel assembly 300*b* adjacent the alignment hole 376*b* and the spring 410*b* opposite the first washer 414*b*. The spring 410*b* and the second washer 416*b* cooperate to exert a clamping force on the last panel assembly 300*b*, which translates the clamping force to the panel assemblies 300 inboard of the last panel assembly 300*b*. Additionally and/or alternatively, a spring 410*b* may be installed at the first end 404*b* of the tie rod 402*b* between the retainer 408*b* and the first panel assembly 300*a*. The spring 410*b* installed at the first end 404*b* of the tie rod 402*b* is positioned between first and second washers 414*b*, 416*b*, which may be arranged on an extension segment 420*b* of the tie rod 402*b* or on a tail of the threaded fastener 412*b* as described for the spring 410*b* at the second end 406*b*. The spring 410*b* and the second washer 416*b* at the first end 404*b* may cooperate to exert a clamping force on the first panel assembly 300*a*, which translates the clamping force to the panel assemblies 300 inboard of the first panel assembly 300*a*.

The first and second end plates 218, 220 may be installed when the tie rod 402*b* of the interior clamping assembly 400*b* is fixed within the alignment holes 376*b* by the retainers 408*b* connected at each end of the tie rod 402*b*. The tie rod 402*a* of the exterior clamping assembly 400*a* is then fixed within the alignment holes 376*a* by connecting the retainers 408*a* at the first end 404*a* and the second end 406*a* of the tie rod 402*a*. The retainer 408*a* connected at the first end 404*a* of the tie rod 402*a* is exterior to the first end plate 218 and the retainer 408*a* connected at the second end 406*a* is exterior to the second end plate 220. The tie rod 402*a* may include the extension segments 420*a*, one extension segment extending laterally through the alignment aperture 258 of the first end plate 218 and the other extension segment extending laterally through the alignment aperture 260 of the second end plate 220. The retainers 408*a* may respectively connect to the extension segments 420*a* extending through the alignment apertures 258, 260 of the end plates 218, 220. Alternatively, the tails of the threaded fasteners 412*a* of the retainers 408*a* may respectively extend through the alignment apertures 258, 260 to connect to the ends 404*a* and 406*a* of the tie rod 402*a* that terminate prior to the end plates 218 and 220.

A spring 410*a* is installed at the second end 406*a* of the tie rod 402*a* between the retainer 408*a* and the second end plate 220. The spring 410*a* may be retained between first and second washers 414*a*, 416*a* on the extension segment 420*a* that extends laterally outward from the alignment aperture 260 of the second end plate 220. Alternatively, the first and second washers 414*a*, 416*a* and the spring 410*a* may be arranged on a tail of the threaded fastener 412*a*, exterior to the second end plate 220, with the spring 410*a* positioned between the washers and retained by one of the washers (e.g., a countersunk washer as shown in FIGS. 15 and 16). The first washer 414*a* abuts the head of the fastener 412*a* and the spring 410*a*. The second washer 416*a* abuts the second end plate 220 adjacent the alignment aperture 260 and the spring 410*a* opposite the first washer 414*a*. The spring 410*a* and the second washer 416*a* cooperate to exert a clamping force on the second end plate 220, which translates the clamping force to the panel assemblies 300 inboard of the second end plate. Additionally and/or alternatively, a spring 410*a* may be installed at the first end 404*a* of the tie rod 402*a* between the retainer 408*a* and the first end plate 218. The spring 410*a* installed at the first end 404*a* of the tie rod 402*a* is positioned between first and second washers 414*a*, 416*a*, which may be arranged on an extension segment 420*a* of the tie rod 402*a* extending laterally outward from the alignment aperture 258 or on a tail of the threaded fastener 412*a* exterior to the first end plate 218 as described for the spring 410*a* at the second end 406*a*. The spring 410*a* and the second washer 416*a* at the first end 404*a* may cooperate to exert a clamping force on the first end plate 218, which translates the clamping force to the panel assemblies 300 inboard of the first end plate.

Figure 19:
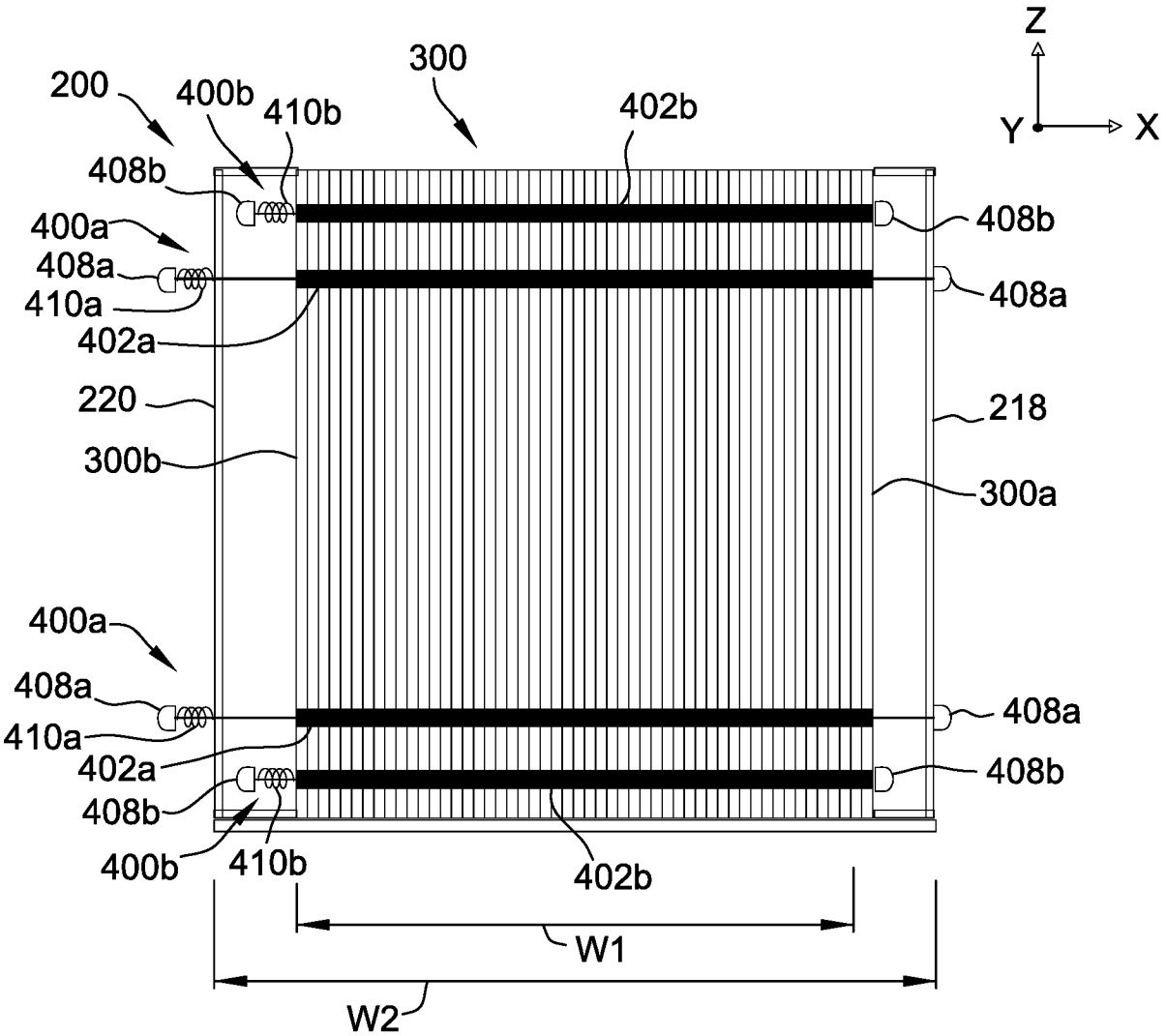
FIG. 19 is a schematic section of the three-way heat exchanger with the end plates, panel assemblies, and clamping assemblies assembled, the clamping assemblies each having a single resilient element with some resilient elements located exterior to the end plates.
Figure 20:
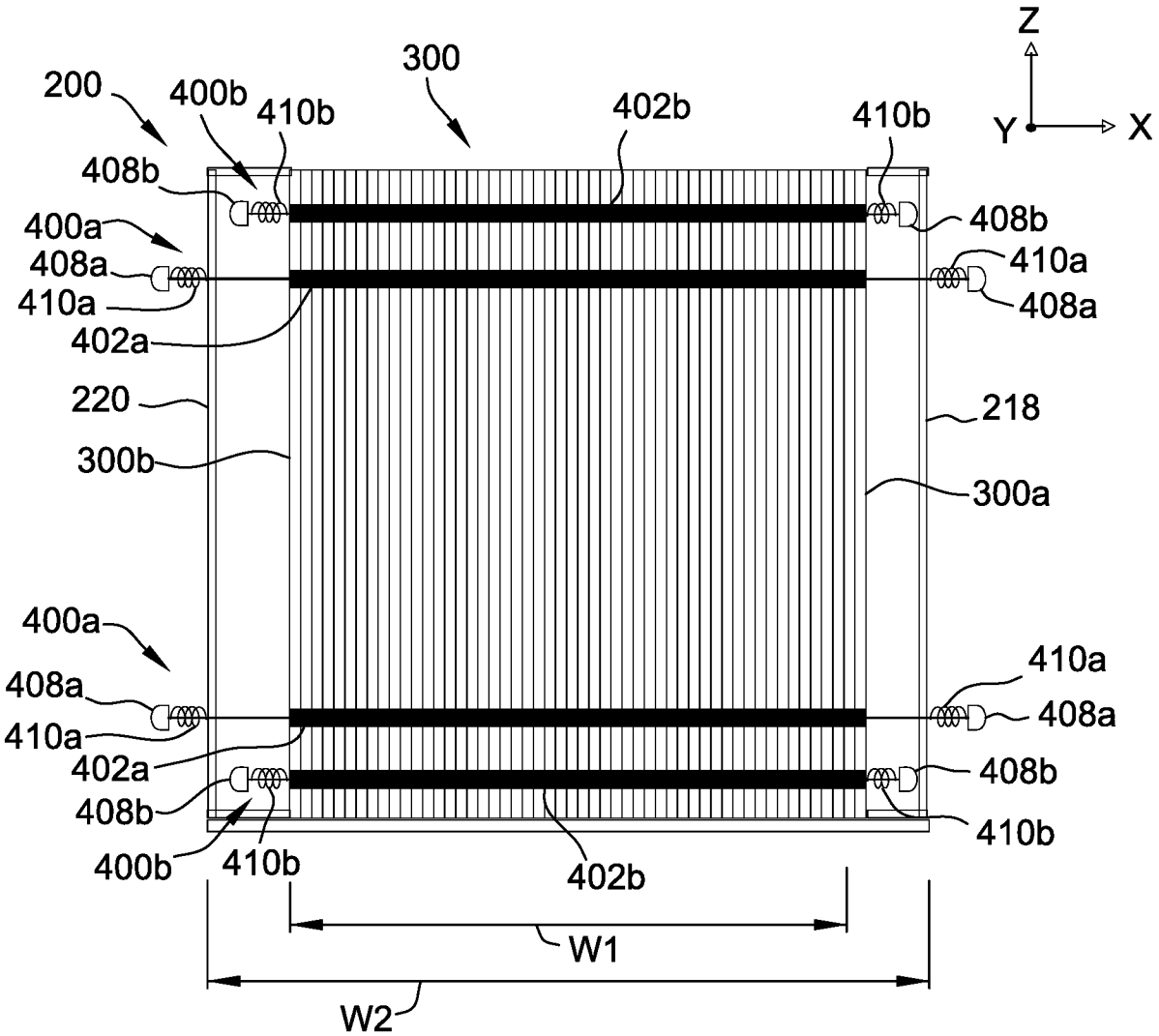
FIG. 20 is a schematic section of the three-way heat exchanger with the end plates, panel assemblies, and clamping assemblies assembled, the clamping assemblies each having two resilient elements with some resilient elements located exterior to the end plates.

FIGS. 19 and 20 are schematic sections of the three-way heat exchanger 200 (FIGS. 2-6) with the end plates 218, 220, panel assemblies 300, and clamping assemblies 400*a* and 400*b* assembled and depicted with features exaggerated and/or simplified for convenience of illustration and description. In the example shown in FIG. 19, the interior clamping assemblies 400*b* include one spring 410*b* between the retainer 408*b* and the last panel assembly 300*b*, and the exterior clamping assemblies 400*a* include one spring 410*a* between the retainer 408*a* and the second end plate 220. In this example, springs 410*b* are not included in the interior clamping assemblies 400*b* between the retainer 408*b* and the first panel assembly 300*a*, and springs 410*a* are not included in the exterior clamping assemblies 400*a* between the retainer 408*a* and the first end plate 218. In the example shown in FIG. 20, the interior clamping assemblies 400*b* include springs 410*b* between the retainers 408*b* and each of the first panel assembly 300*a* and the last panel assembly 300*b*, and the exterior clamping assemblies 400*a* include springs 410*a* between the retainers 408*a* and each of the first end plate 218 and the second end plate 220.

In both examples, the springs 410*b* of the interior clamping assemblies 400*b* maintain a clamping force on the panel assemblies 300 while allowing the total width $W_1$ of the panel assemblies to increase or reduce in size, in response to the panel assemblies expanding and contracting at different temperatures (e.g., temperatures within a range of from −30° C. to 60° C.). The springs 410*a* of the exterior clamping assemblies 400*a* maintain a clamping force on the end plates 218, 220 while allowing a total width $W_2$ of the heat exchanger 200, measured in the X-axis direction between the first end plate 218 and the second end plate 220, to increase or reduce in size, in response to the end plates and the panel assemblies expanding and contracting at different temperatures.

The clamping forces exerted by the clamping assemblies 400*a* and 400*b* operate to compress the elastomeric seals 384 seated between adjacent fluid ports, e.g., the liquid desiccant inlet ports 340 of adjacent panel assemblies 300 which form the liquid desiccant inlet manifold 242 (FIGS. 5 and 6). Similar clamping forces are applied by the other clamping assemblies 400*a* and 400*b* to compress the elastomeric seals 384 seated between adjacent liquid desiccant outlet ports 342 defined in the second corner flanges 366 (FIG. 10D), the elastomeric seals 384 seated between adjacent heat transfer fluid inlet ports 346 defined in the third corner flanges 368 (FIG. 10B), and the elastomeric seals 384 seated between adjacent heat transfer fluid outlet ports 348 defined in the fourth corner flanges 370 (FIG. 10A). The clamping assemblies 400*a* and 400*b* thus operate to maintain the seals for each of the fluid manifolds 242-248 of the three-way heat exchanger 200 and prevent leakage of the liquid desiccant and heat transfer fluid from the manifolds, while allowing the width $W_1$ of the panel assemblies 300 and the width $W_2$ of the heat exchanger 200 to increase or decrease in size.

The tie rods 402*a*, 402*b* and the retainers 408*a*, 408*b* may include suitable materials (e.g., stainless steel, glass-filled plastics) to reduce costs and enable the tie rods and retainers to be readily sourced. Materials that may be included in the tie rods 402*a*, 402*b* and the retainers 408*a*, 408*b* have different rates of thermal expansion and contraction than the materials (e.g., thermoplastic or polymeric materials) included in the panel assemblies 300. The springs 410*a* and 410*b* compensate for these differences in thermal expansion and contraction rates to facilitate preventing leakage of the heat transfer fluid and/or liquid desiccant from the fluid manifolds 242-248 due to contraction at low temperature conditions and to facilitate reducing or eliminating the propensity for the panel assemblies 300 to deform due to expansion at high temperature conditions. In particular, at relatively low operating temperatures of the three-way heat exchanger 200 (e.g., between −30° C. to 20° C.), the springs 410*b* expand in response to a reduction in the total width $W_1$ of the panel assemblies 300 and the springs 410*a* expand in response to a reduction in the total width $W_2$ of the heat exchanger 200 to maintain the clamping force exerted by the clamping assemblies. At relatively high operating temperatures of the three-way heat exchanger 200 (e.g., between 20° C. to 60° C.), the springs 410*b* compress in response to an increase in the total width $W_1$ of the panel assemblies 300 and the springs 410*a* compress in response to an increase in the total width $W_2$ of the heat exchanger 200 to maintain the clamping force exerted by the clamping assemblies while limiting or eliminating any stresses or strains in the panel assemblies 300 adjacent the alignment holes 376*a* and 376*b* and/or in the end plates 218 and 220 adjacent the alignment apertures 258 and 260.

As described above, the springs 410*a* and 410*b* may be coil springs that deform in response to an external force acting on the coil spring. The coil springs used as the springs 410*a* and 410*b* may include any suitable material, such as stainless steel for example. The coil springs are suitably dimensioned (e.g., sized and shaped) to enable the springs to function as described. For example, the coil springs may have a length and width selected to enable the springs 410*a* and 410*b* to function as described, as well as a suitable number of coils. The coil springs used for the springs 410*a* may be similarly dimensioned as the coil springs used for the springs 410*b* or the coil springs may have different dimensions. The dimensions selected for the coil springs may vary depending on the size or intended application (e.g., intended environment) of the heat exchanger 200.

Example coil springs used for the springs may have a free length between about 0.1 inches to about 2 inches (or about 2.5 mm to about 51 mm), or any subrange therebetween, such as between about 0.25 inches to about 1.5 inches (or about 6 mm to about 40 mm), or between about 0.5 inches to about 1 inch (or about 12 mm to about 26 mm). In various examples, the free length of the coil springs may be about 0.25 inches (about 6.4 mm), about 0.5 inches (about 12.7 mm), about 0.75 inches (about 19.1 mm), about 1 inch (about 25.4 mm), about 1.25 inches (about 31.8 mm), or about 1.5 inches (about 38.1 mm), or any combination, sub-combination, or range between and including these example free length values.

Example coil springs may have an outer diameter of between about 0.1 inches to about 1 inches (or about 2.5 mm to about 26 mm), or any subrange therebetween, such as between about such as between about 0.2 inches to about 0.8 inches (or about 5 mm to about 21 mm), or between about 0.3 inches to about 0.5 inches (or about 7.6 mm to about 12.7 mm). In various examples, the outer diameter of the coil springs may be between about 0.1 inches (about 2.5 mm) to about 0.2 inches (about 5 mm), between about 0.2 inches to about 0.3 inches (about 7.6 mm), between about 0.3 inches to about 0.4 inches (about 10.2 mm), between about 0.4 inches to about 0.5 inches (about 12.7 mm), between about 0.5 inches to about 0.6 inches (about 15.2 mm), between about 0.6 inches to about 0.7 inches (about 17.8 mm), between about 0.7 inches to about 0.8 inches (about 20.3 mm), between about 0.8 inches to about 0.9 inches (about 22.9 mm), or between about 0.9 inches to about 1 inch (about 25.4 mm), or any combination, sub-combination, or subrange of these ranges.

A wire diameter of example coil springs may be between about 0.01 inches to about 0.1 inches (or about 0.25 mm to about 2.6 mm), or any subrange therebetween, such as between about 0.02 inches to about 0.08 inches (or about 0.5 mm to about 2.1 mm), or between about 0.04 inches to about 0.07 inches (or about 1.0 mm to about 1.7 mm). In various examples, the wire diameter of the coil springs may be between about 0.01 inches (about 0.25 mm) to about 0.02 inches (about 0.51 mm), between about 0.02 inches to about 0.03 inches (about 0.76 mm), between about 0.03 inches to about 0.04 inches (about 1.02 mm), between about 0.04 inches to about 0.05 inches (about 1.27 mm), between about 0.05 inches to about 0.06 inches (about 1.52 mm), between about 0.06 inches to about 0.07 inches (about 1.78 mm), between about 0.07 inches to about 0.08 inches (about 2.03 mm), between about 0.08 inches to about 0.09 inches (about 2.29 mm), or between about 0.09 inches to about 0.1 inches (about 2.54 mm), or any combination, sub-combination, or subrange of these ranges.

The springs 410*b* suitably have a spring rate that enables the springs to expand and compress in response to changes in the total width $W_1$ of the panel assemblies 300 while maintaining a suitable clamping force on the panel assemblies 300 in the X-axis direction. Similarly, the springs 410*a* suitably have a spring rate that enables the springs to expand and compress in response to changes in the total width $W_2$ of the heat exchanger 200 while maintaining a suitable clamping force on the end plates 218, 220 and the panel assemblies 300 in the X-axis direction. The spring rate of the springs 410*a* and 410*b* may vary depending on the size or intended application (e.g., intended environment) of the heat exchanger 200. The spring rate of the springs 410*a* may be the same as the spring rate of the springs 410*b*, or the springs may have different spring rates. The spring rate of the springs 410*a* and/or the springs 410*b* may be, for example, between about 20 lbs./inch to about 100 lbs./inch, or any subrange therebetween, such as between about 25 lbs./inch to about 50 lbs./inch, between about 50 lbs./inch to about 75 lbs./inch, or between about 75 lbs./inch to about 100 lbs./inch. For example, the spring rate of the springs 410*a* and/or the springs 410*b* may be between about 20 lbs./inch to about 30 lbs./inch, between about 30 lbs./inch to about 40 lbs./inch, between about 40 lbs./inch to about 50 lbs./inch, between about 50 lbs./inch to about 60 lbs./inch, between about 60 lbs./inch to about 70 lbs./inch, between about 70 lbs./inch to about 80 lbs./inch, between about 80 lbs./inch to about 90 lbs./inch, or between about 90 lbs./inch to about 100 lbs./inch, or any combination, sub-combination, or subrange of these ranges.

The dimensions and/or the spring rate of the springs 410*a* and 410*b* may be selected such that the springs maintain a clamping force within a suitable clamping force range at various temperatures (e.g., across a range of from −30° C. to 60° C.). At any of the temperatures within this range, the clamping force exerted on the panel assemblies 300 and the end plates 218, 220 is suitably strong enough to maintain fluid-tight seals of the manifolds 242-248 of the heat exchanger 200, that is, between the adjacent panel assemblies 300 at the adjacent fluid ports 340, 342, 346, 348, while also not reaching or exceeding too strong a clamping force that otherwise deforms the panel assemblies 300 and/or the end plates 218, 220. For example, across a temperature range from −30° C. to 60° C., the springs 410*b* may facilitate maintaining a clamping force of between about 1 lb. to about 25 lbs., such as between about 4 lbs. to about 20 lbs., on the panel assemblies 300 and the springs 410*a* may facilitate maintaining a clamping force of between about 1 lb. to about 25 lbs., such as between about 4 lbs. to about 20 lbs., on the end plates 218, 220. The spring 410*a* may facilitate maintaining the same clamping force on the end plates 218, 220 as the clamping force maintained on the panel assemblies 300 by the springs 410*b*, or the clamping forces may be different. The clamping force exerted on the end plates 218, 220 and the panel assemblies 300 may be at a higher end of the clamping force range (e.g., from about 10 lbs. to about 25 lbs., or about 10 lbs. to about 20 lbs.) at relatively higher operating temperatures (e.g., between 20° C. to 60° C.), when the panel assemblies 300 and end plates 218, 220 increase in size. The clamping force exerted on the end plates 218, 220 and the panel assemblies 300 may be at a lower end of the clamping force range (e.g., from about 1 lb. to about 12 lbs., or about 4 lbs. to about 10 lbs.) at relatively lower operating temperatures (e.g., between −30° C. to 20° C.), when the panel assemblies 300 and end plates 218, 220 reduce in size.

The springs 410*b* of the interior clamping assemblies 400*b* may maintain a suitable clamping force (e.g., a clamping force between about 1 lb. to about 25 lbs.) on the panel assemblies 300 across a range of widths $W_1$ of the panel assemblies 300 at different operating temperatures. For example, the springs 410*b* may expand and compress to accommodate variations in the total width $W_1$ of the panel assemblies 300 across a range of +/− about 2% of the total width $W_1$ at room temperature (e.g., about 20° C.), while maintaining a suitable clamping force (e.g., between about 1 lb. to about 25 lbs.) on the panel assemblies. The springs 410*a* of the exterior clamping assemblies 400*a* may maintain a suitable clamping force (e.g., a clamping force between about 1 lb. to about 25 lbs.) on the end plates 218, 220 across a range of widths $W_2$ of the heat exchanger 200 at different operating temperatures. For example, the springs 410*a* may expand and compress to accommodate variations in the total width $W_2$ of the heat exchanger 200 across a range of +/− about 2% of the total width $W_2$ at room temperature (e.g., about 20° C.), while maintaining a suitable clamping force (e.g., between about 1 lb. to about 25 lbs.) on the end plates.

Figure 21:
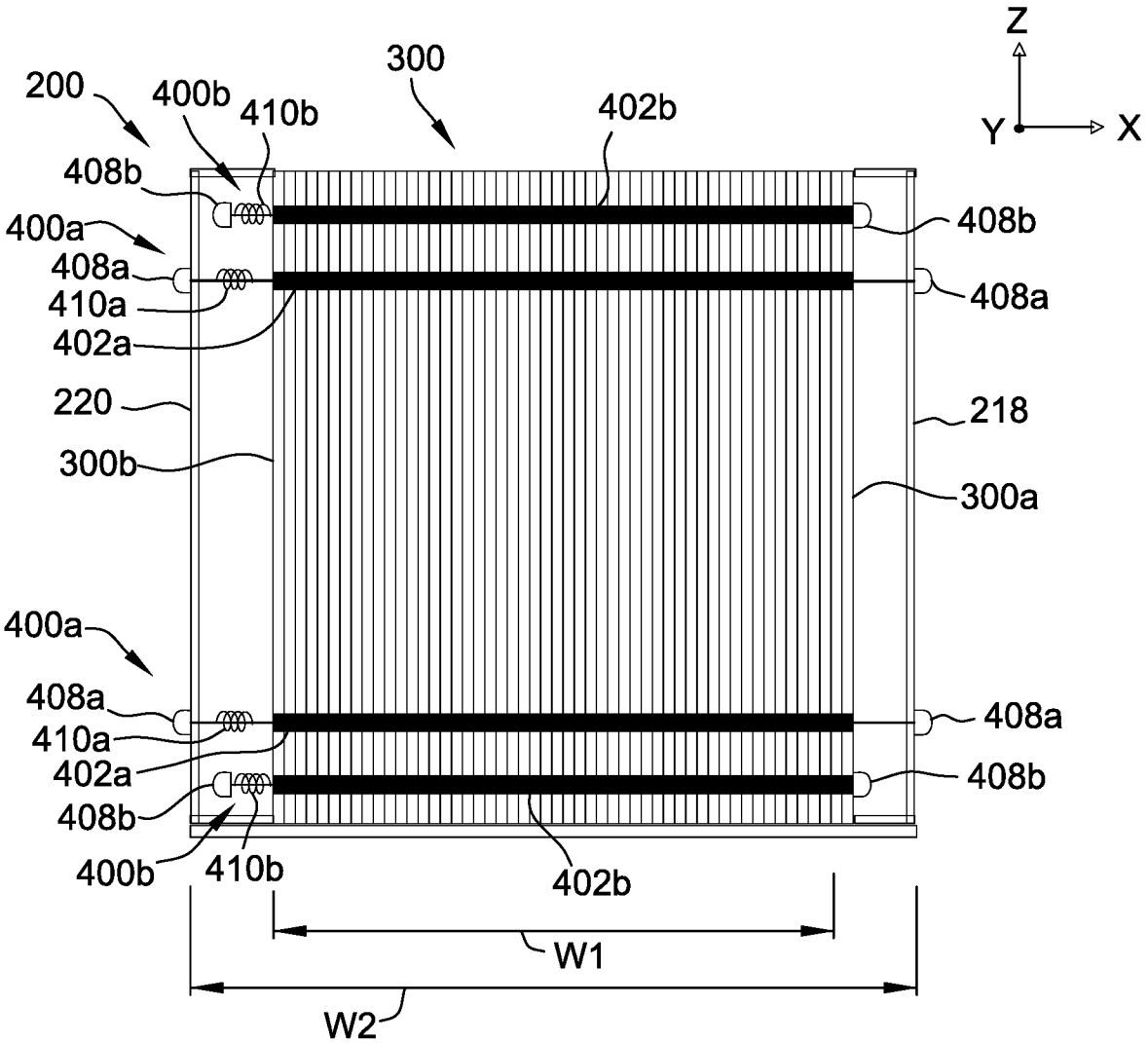
FIG. 21 is a schematic section of the three-way heat exchanger with the end plates, panel assemblies, and clamping assemblies assembled, the clamping assemblies each having a single resilient element with each resilient elements located interior to the end plates.
Figure 22:
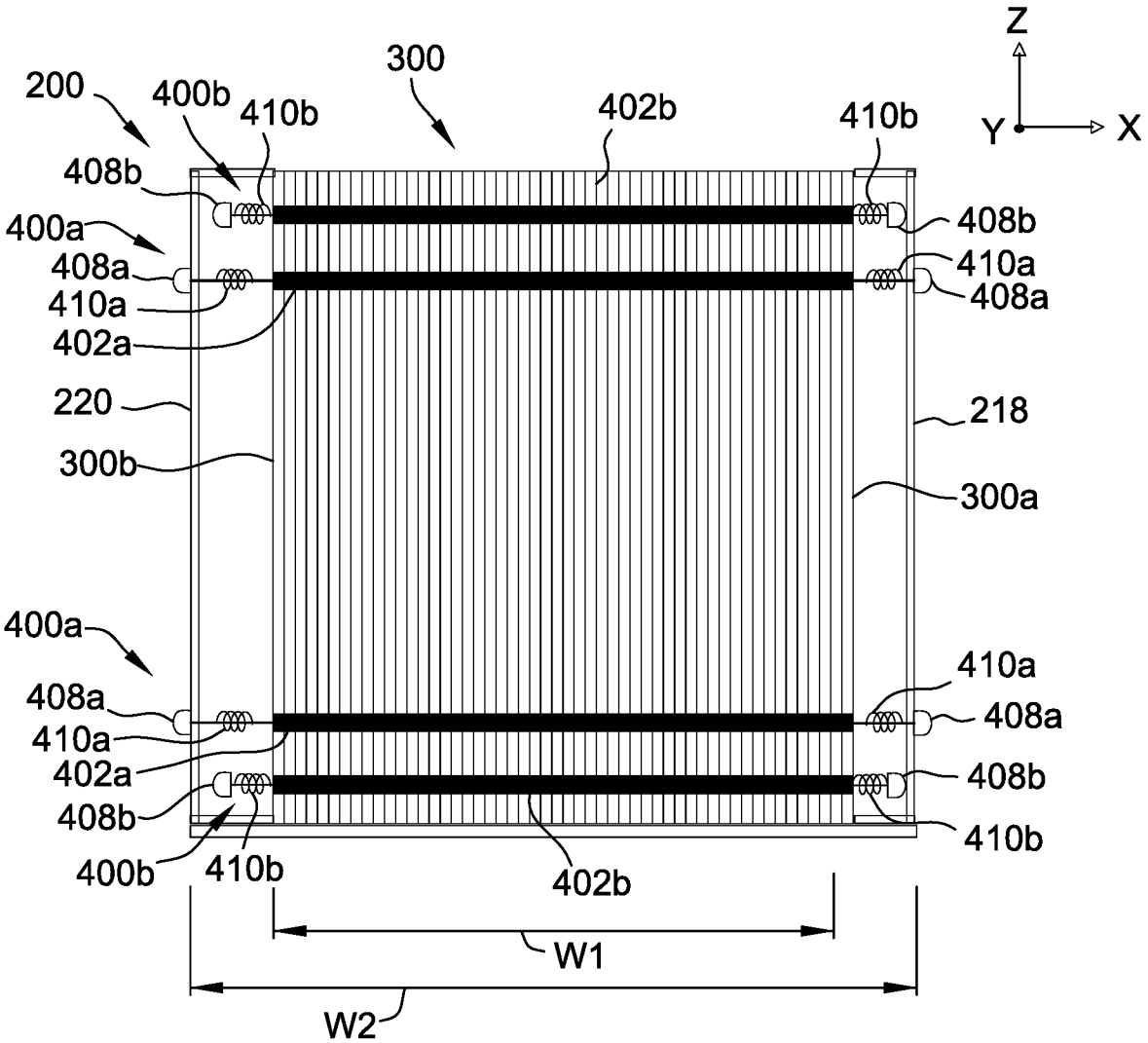
FIG. 22 is a schematic section of the three-way heat exchanger with the end plates, panel assemblies, and clamping assemblies assembled, the clamping assemblies each having two resilient elements with each resilient element located interior to the end plates.

Referring to FIGS. 21 and 22, in some examples, the springs 410*a* of the exterior clamping assemblies 400*a* are located inside or interior to the end plates 218, 220, while the retainers 408*a* are located outside or exterior to the end plates 218, 220. FIGS. 21 and 22 are schematic sections of the three-way heat exchanger 200 (FIGS. 2-6), similar to FIGS. 19 and 20, with the end plates 218, 220, panel assemblies 300, and clamping assemblies 400*a* and 400*b* assembled and depicted with features exaggerated and/or simplified for convenience of illustration and description. In the example shown in FIG. 21, the interior clamping assemblies 400*b* are similar to the interior clamping assemblies 400*b* in the example of FIG. 19. The exterior clamping assemblies 400*a* in FIG. 21 include retainers 408*a* connected to both ends of the tie rod 402*a* and located outside the end plates 218, 220, and one spring 410*a* between the second end plate 220 and the last panel assembly 300*b*. In the example shown in FIG. 22, the interior clamping assemblies 400*b* are similar to the interior clamping assemblies 400*b* shown in FIG. 20. The exterior clamping assemblies 400*a* in FIG. 22 include a spring 410*a* between the first end plate 218 and the first panel assembly 300*a* and a spring 410*a* between the second end plate 220 and the last panel assembly 300*b*. The springs 410*a* may be differently dimensioned from the springs 410*b* in this example, to enable the springs 410*a* to extend between the last panel assembly 300*b* and the second end plate 220 or between the first panel assembly 300*a* and the first end plate 218. For example, the springs 410*a* may have a greater free length than the springs 410*b*. Suitably, the springs 410*a* and the springs 410*b* are dimensioned to each function as described elsewhere.

In the examples of FIGS. 21 and 22, like the examples of FIGS. 19 and 20, the springs 410*b* of the interior clamping assemblies 400*b* maintain a clamping force on the panel assemblies 300 while allowing the total width $W_1$ of the panel assemblies to increase or reduce in size at different temperatures (e.g., temperatures within a range of from −30° C. to 60° C.). The springs 410*a* of the exterior clamping assemblies 400*a* likewise maintain a clamping force on the panel assemblies 300 while allowing the total width $W_1$ to change. Unlike the examples of FIGS. 19 and 20, the exterior clamping assemblies 400*a* in FIGS. 21 and 22 do not allow the total width $W_2$ of the heat exchanger 200 to increase or reduce in size. It may be desirable to limit or prevent changes in the total width $W_2$ of the heat exchanger 200 in some implementations, for example, where changes in the overall footprint of the heat exchanger 200 relative to the HVAC system in which it is utilized are not desired. This may simplify installation of the heat exchanger 200, for example. Locating the springs 410*a* of the exterior clamping assemblies 400*a* inside the second end plate 220, and the first end plate 218 if a second spring 410*a* is included, enables the springs 410*a* to maintain suitable clamping force on the panel assemblies 300 while allowing for changes in the total width $W_1$ of the panel assemblies 300 and limiting or preventing changes in the total width $W_2$ of the heat exchanger 200.

Example HVAC systems described include one or more three-way heat exchangers for removing heat and moisture from a flow of air and/or rejecting heat and moisture into a flow of air. An example three-way heat exchanger includes panel assemblies arranged in series and defining air gaps for air to flow therebetween. Heat transfer fluid and liquid desiccant are channeled through manifolds to each panel assembly to treat the air flowing through the air gaps. The operational efficiency and lifetime of the three-way heat exchanger is improved by clamping assemblies that facilitate accommodating size variations in the panel assemblies over a wide range of operating temperatures. In particular, the clamping assemblies include springs that selectively deform (e.g., compress or expand) in response to changes in a total width of the panel assemblies at different temperatures. The clamping assemblies are provided adjacent to liquid desiccant and heat transfer fluid manifolds of the panel assemblies to ensure that the manifolds remain sealed during operation and panel assembly size changes. In this way, the clamping assemblies facilitate preventing leakage of the heat transfer fluid and liquid desiccant. Additionally, the clamping assemblies accommodate increases in size of the panel assemblies to facilitate preventing deformations in the panel assemblies due to stresses and strains.

Example embodiments of HVAC systems and methods of operating the systems are described above in detail. The systems and methods are not limited to the specific embodiments described herein, but rather, components of the system and methods may be used independently and separately from other components described herein. For example, the systems described herein may be used in systems other than HVAC systems.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", "vertical", "lateral", "longitudinal", etc.) is for convenience of description and does not require any particular orientation of the item described.

The terms "about," "substantially," "essentially" and "approximately," and their equivalents, when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A three-way heat exchanger operable to transfer heat between a heat transfer fluid, a liquid desiccant, and air, the three-way heat exchanger comprising:

panel assemblies arranged in series, airflow gaps being defined between adjacent panel assemblies to allow the air to flow through the three-way heat exchanger, each panel assembly comprising:

a frame defining a heat transfer fluid channel; and a vapor-permeable membrane positioned on the frame to define a desiccant channel separated from the heat transfer fluid channel;

clamping assemblies for exerting a clamping force on the panel assemblies, each clamping assembly comprising:

a tie rod extending through the frames of the panel assemblies and including opposite ends;

retainers connected to the opposite ends of the tie rod; and a resilient element positioned between one of the retainers and one of the panel assemblies at one of the ends of the tie rod, wherein the resilient element is deformable to accommodate size variations of the panel assemblies; and two end plates, the panel assemblies being arranged in series between the end plates, wherein the retainers of one of the clamping assemblies are located exterior to the end plates and the retainers of another one of the clamping assemblies are located interior to the end plates, wherein the resilient element of each of the clamping assemblies is located interior to the end plates.

2. The three-way heat exchanger of claim 1, wherein each tie rod extends through alignment holes defined in each of the frames of the panel assemblies, and wherein each tie rod and the alignment holes have a complementing polygonal shape.

3. The three-way heat exchanger of claim 2, wherein each tie rod and the alignment holes have a complementing hexagonal shape.

4. The three-way heat exchanger of claim 1, wherein the resilient element of each clamping assembly is a spring.

5. The three-way heat exchanger of claim 4, wherein each spring controls the clamping force exerted on the panel assemblies within a range of 1 lb. to 20 lbs.

6. The three-way heat exchanger of claim 5, wherein each spring controls the clamping force exerted on the panel assemblies at any temperature in a range of between −30° C. to 60° C.

7. The three-way heat exchanger of claim 4, wherein each spring is retained by one of a countersunk washer abutting the respective one of the retainers and an extension segment of the tie rod.

8. A heat exchanger operable to transfer heat between a heat transfer fluid and air, the heat exchanger comprising:

panel assemblies arranged in series, airflow gaps being defined between adjacent panel assemblies to allow the air to flow through the heat exchanger, each panel assembly comprising a frame defining a heat transfer fluid channel, a heat transfer fluid inlet port, and a heat transfer fluid outlet port, wherein the heat transfer fluid inlet ports define a heat transfer fluid inlet manifold of the heat exchanger and the heat transfer fluid outlet ports define a heat transfer fluid outlet manifold of the heat exchanger;

clamping assemblies for exerting a clamping force on the panel assemblies, each clamping assembly comprising:

a tie rod extending through the frames of the panel assemblies and including opposite ends;

retainers connected to the opposite ends of the tie rod; and a resilient element positioned between one of the retainers and one of the panel assemblies at one of the ends of the tie rod, wherein the resilient element is deformable to accommodate size variations of the panel assemblies; and two end plates, the panel assemblies arranged in series between the end plates, wherein the retainers of one of the clamping assemblies are located exterior to the end plates and the retainers of another one of the clamping assemblies are located interior to the end plates, wherein the resilient element of each of the clamping assemblies is located interior to the end plates, wherein the tie rod of a first clamping assembly extends adjacent the heat transfer fluid inlet manifold and the tie rod of a second clamping assembly extends adjacent the heat transfer fluid outlet manifold.

9. The heat exchanger of claim 8, wherein elastomeric seals are positioned between the heat transfer fluid inlet ports and between the heat transfer fluid outlet ports of adjacent panel assemblies to seal the heat transfer fluid inlet and outlet manifolds.

10. The heat exchanger of claim 9, wherein the resilient element of the first clamping assembly is deformable to accommodate the size variations of the panel assemblies and maintain a seal of the heat transfer fluid inlet manifold.

11. The heat exchanger of claim 9, wherein the resilient element of the second clamping assembly is deformable to accommodate the size variations of the panel assemblies and maintain a seal of the heat transfer fluid outlet manifold.

12. The heat exchanger of claim 9, wherein the elastomeric seals are radial seals.

13. The heat exchanger of claim 8, wherein the heat exchanger is a three-way heat exchanger operable to transfer heat between the heat transfer fluid, a liquid desiccant, and the air, wherein:

each panel assembly comprises a vapor-permeable membrane disposed on the frame to define a desiccant channel separated from the heat transfer fluid channel;

the frame of each panel assembly defines a desiccant inlet port and a desiccant outlet port;

the desiccant inlet ports of the panel assemblies define a desiccant inlet manifold of the heat exchanger and the desiccant outlet ports of the panel assemblies define a desiccant outlet manifold of the heat exchanger; and the tie rod of a third clamping assembly extends adjacent the desiccant inlet manifold and the tie rod of a fourth clamping assembly extends adjacent the desiccant outlet manifold.

14. The heat exchanger of claim 13, wherein elastomeric seals are positioned between the heat transfer fluid inlet ports, the heat transfer fluid outlet ports, the desiccant inlet ports, and the desiccant outlet ports of adjacent panel assemblies to seal the heat transfer fluid inlet manifold, the heat transfer fluid outlet manifold, the desiccant inlet manifold, and the desiccant outlet manifold, and the resilient elements of the first, second, third, and fourth clamping assemblies are deformable to accommodate the size variations of the panel assemblies and respectively maintain a seal of the heat transfer fluid inlet manifold, the heat transfer fluid outlet manifold, the desiccant inlet manifold, and the desiccant outlet manifold.

15. The heat exchanger of claim 13, wherein, for each panel assembly, the heat transfer fluid inlet and outlet ports and the desiccant inlet and outlet ports are defined at respective corners of the frame.

16. A heat exchanger operable to transfer heat between a heat transfer fluid and air, the heat exchanger comprising:

panel assemblies arranged in succession, airflow gaps being defined between adjacent panel assemblies to allow the air to flow through the heat exchanger, each panel assembly comprising a frame defining a heat transfer fluid channel, a first alignment hole, and a second alignment hole, wherein the first and second alignment holes are defined on opposite sides of the heat transfer fluid channel;

clamping assemblies for exerting a clamping force on the panel assemblies, each clamping assembly comprising:

a tie rod extending through the frames of the panel assemblies;

retainers connected to opposite ends of the tie rod; and a resilient element between one of the retainers and one of the panel assemblies at one of the ends of the tie rod, wherein the resilient element is deformable to accommodate size variations of the panel assemblies; and two end plates, the panel assemblies arranged in succession between the end plates, wherein the retainers of one of the clamping assemblies are located exterior to the end plates and the retainers of another one of the clamping assemblies are located interior to the end plates, wherein the resilient element of each of the clamping assemblies is located interior to the end plates, wherein the tie rod of a first clamping assembly extends through the first alignment holes of the panel assemblies and the tie rod of a second clamping assembly extends through the second alignment holes of the panel assemblies, wherein each tie rod and the respective alignment holes have a complementing anti-rotation shape.

17. The heat exchanger of claim 16, wherein the complementing anti-rotation shape is a complementing polygonal shape.

18. The heat exchanger of claim 16, wherein the complementing anti-rotation shape is a complementing hexagonal shape.

* * * * *